US008002680B2

(12) United States Patent
Crawford et al.

(10) Patent No.: US 8,002,680 B2
(45) **Date of Patent: *Aug. 23, 2011**

(54) ADJUSTABLE DUMBBELL SYSTEM

(75) Inventors: Douglas A. Crawford, Lafayette, CO (US); Patrick A. Warner, Boulder, CO (US); Eric D. Golesh, Arvada, CO (US); Edward L. Flick, Portland, OR (US); Lopin Wang, Taichung (TW)

(73) Assignee: Nautilus, Inc., Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/882,018

(22) Filed: Sep. 14, 2010

(65) Prior Publication Data

US 2011/0003668 A1 Jan. 6, 2011

Related U.S. Application Data

(63) Continuation of application No. 12/579,122, filed on Oct. 14, 2009, now Pat. No. 7,794,373, which is a continuation of application No. 11/844,565, filed on Aug. 24, 2007, now Pat. No. 7,614,982, which is a continuation of application No. 10/456,977, filed on Jun. 5, 2003, now Pat. No. 7,261,678.

(60) Provisional application No. 60/387,298, filed on Jun. 7, 2002, provisional application No. 60/400,244, filed on Jul. 31, 2002, provisional application No. 60/400,894, filed on Aug. 1, 2002.

(51) Int. Cl.
*A63B 21/075* (2006.01)

(52) U.S. Cl. ..... 482/108; 482/94; 482/107

(58) Field of Classification Search ..... 482/92–94, 482/98, 104, 106–109
See application file for complete search history.

(56) References Cited

U.S. PATENT DOCUMENTS 470,815 A 3/1892 Barton
772,906 A 10/1904 Reach
848,272 A 3/1907 Thornley
883,977 A 4/1908 Schwedtman
(Continued)

FOREIGN PATENT DOCUMENTS

DE 33 32 150 A1 3/1985
(Continued)

OTHER PUBLICATIONS

U.S. Appl. No. 29/278,771, filed Apr. 9, 2007, Crawford et al.
(Continued)

*Primary Examiner* — Loan Thanh
*Assistant Examiner* — Victor K Hwang
(74) *Attorney, Agent, or Firm* — Dorsey & Whitney LLP

(57) ABSTRACT

A dumbbell is described including a handle having a grip and at least one end, an inner plate mounted on the handle adjacent the grip, in a fixed rotational orientation, a support plate rotationally mounted on the handle adjacent the inner plate, at least one collar rotationally mounted on the handle adjacent the support plate, and rotationally fixed with the support plate, a selector knob rotationally mounted on the handle adjacent the at least one collar, and rotationally fixed with the collar, a weight plate removably mounted on the handle adjacent the at least one collar, and a means for selectively securing the support plate to the inner plate to resist the rotation of the support plate, collar and selector knob with respect to the inner plate and handle.

20 Claims, 55 Drawing Sheets

U.S. PATENT DOCUMENTS 1,853,916 A 4/1932 McLaughlin
2,447,218 A 8/1948 Trzesniewski
2,855,199 A 10/1958 Noland et al.
2,970,448 A 2/1961 DiJulio
3,612,523 A 10/1971 Glynn
3,647,209 A 3/1972 La Lanne
3,771,785 A 11/1973 Speyer
D230,752 S 3/1974 Speyer
3,807,728 A 4/1974 Chillier
3,913,908 A 10/1975 Speyer
RE31,113 E 12/1982 Coker et al.
4,453,710 A 6/1984 Plotz
4,513,963 A 4/1985 Nelson et al.
4,529,197 A 7/1985 Gogarty
4,529,198 A 7/1985 Hettick, Jr.
4,538,805 A 9/1985 Parviainen
4,540,171 A 9/1985 Clark et al.
4,546,971 A 10/1985 Raasoch
4,566,690 A 1/1986 Schook
4,568,078 A 2/1986 Weiss
4,601,466 A 7/1986 Lais
4,610,449 A 9/1986 Diercks, Jr.
4,624,457 A 11/1986 Silberman et al.
4,627,615 A 12/1986 Nurkowski
4,730,828 A 3/1988 Lane
4,756,526 A 7/1988 Broussard
4,822,034 A * 4/1989 Shields ..... 482/106
4,834,365 A 5/1989 Jones
4,834,396 A 5/1989 Schnell
4,854,578 A 8/1989 Fulks
4,878,662 A 11/1989 Chern
4,951,939 A 8/1990 Peters
4,982,957 A * 1/1991 Shields ..... 482/104
5,123,885 A * 6/1992 Shields ..... 482/106
D329,563 S 9/1992 Rasmussen
5,169,372 A 12/1992 Tecco
5,221,244 A 6/1993 Doss
5,256,121 A 10/1993 Brotman
5,284,463 A 2/1994 Shields
5,306,221 A 4/1994 Itaru
5,429,570 A 7/1995 Beyer
5,435,800 A 7/1995 Nelson
D362,776 S 10/1995 Thorn
5,556,362 A 9/1996 Whipps
5,628,716 A 5/1997 Brice
5,630,776 A 5/1997 Yang
5,637,064 A 6/1997 Olson et al.
5,669,861 A 9/1997 Toups
5,735,777 A 4/1998 Benoit et al.
5,749,813 A 5/1998 Domsalski
5,749,814 A 5/1998 Chen
5,839,997 A 11/1998 Roth et al.
5,876,313 A 3/1999 Krull
5,967,952 A 10/1999 Bronstein et al.
6,014,078 A 1/2000 Rojas et al.
6,033,350 A 3/2000 Krull
6,039,678 A 3/2000 Dawson
D422,654 S 4/2000 Chen
6,083,144 A 7/2000 Towley, III et al.
6,099,443 A 8/2000 Landfair
6,117,049 A 9/2000 Lowe
6,120,420 A 9/2000 Pearson et al.
6,123,651 A 9/2000 Ellenburg
6,149,558 A 11/2000 Chen
6,174,265 B1 1/2001 Alessandri
6,186,927 B1 2/2001 Krull
6,193,635 B1 2/2001 Webber et al.
6,196,952 B1 3/2001 Chen
6,224,519 B1 5/2001 Doolittle
6,228,003 B1 5/2001 Hald et al.
6,261,022 B1 7/2001 Dalebout et al.
6,319,176 B1 11/2001 Landfair
6,322,481 B1 11/2001 Krull
6,402,666 B2 6/2002 Krull
6,416,446 B1 7/2002 Krull
6,422,979 B1 7/2002 Krull
6,447,430 B1 9/2002 Webb et al.
6,500,101 B1 12/2002 Chen
D468,946 S 1/2003 Harms et al.
D469,294 S 1/2003 Harms et al.
6,540,650 B1 * 4/2003 Krull ..... 482/107
6,551,223 B2 4/2003 Cheng
D474,522 S 5/2003 Monroe
6,629,910 B1 10/2003 Krull
6,656,093 B2 12/2003 Chen
6,669,606 B2 12/2003 Krull
6,682,464 B2 1/2004 Shifferaw
6,702,723 B2 3/2004 Landfair
6,719,672 B1 4/2004 Ellis et al.
6,719,674 B2 4/2004 Krull
6,746,381 B2 6/2004 Krull
6,749,547 B2 6/2004 Krull
6,802,800 B1 10/2004 Hobson
D498,272 S 11/2004 Sanford-Schwentke et al.
6,814,708 B1 11/2004 Jennings
D500,820 S 1/2005 Krull
6,837,833 B2 1/2005 Elledge
6,893,385 B2 5/2005 Smithberg
D508,628 S 8/2005 Crawford et al.
7,018,325 B2 3/2006 Shifferaw
7,077,790 B1 7/2006 Krull
7,077,791 B2 7/2006 Krull
D528,173 S 9/2006 Flick et al.
D528,611 S 9/2006 Flick et al.
7,121,988 B2 10/2006 Walkerdine
7,137,931 B2 11/2006 Liu
7,137,932 B2 11/2006 Doudiet
7,153,243 B1 12/2006 Krull
7,153,244 B2 12/2006 Towley et al.
D536,752 S 2/2007 Walkerdine
7,172,536 B2 2/2007 Liu
7,182,715 B2 2/2007 Anderson
D540,405 S 4/2007 Crawford et al.
D540,894 S 4/2007 Crawford et al.
7,201,711 B2 4/2007 Towley et al.
7,223,214 B2 5/2007 Chen
D544,271 S 6/2007 Savage
7,252,627 B2 8/2007 Carter
7,261,678 B2 * 8/2007 Crawford et al. ..... 482/107
7,285,078 B1 10/2007 Liu
7,291,098 B1 11/2007 Krull
7,306,549 B2 12/2007 Francis
7,377,885 B2 5/2008 Doudiet
7,387,595 B2 6/2008 Towley et al.
7,413,532 B1 8/2008 Monsrud et al.
7,413,533 B2 8/2008 Lin
7,429,235 B2 9/2008 Lin
7,452,312 B2 11/2008 Liu
D584,086 S 1/2009 Gettle
7,485,077 B2 2/2009 Chen
7,507,189 B2 3/2009 Krull
7,534,199 B2 5/2009 Krull
7,540,832 B2 6/2009 Krull
7,553,265 B2 * 6/2009 Crawford et al. ..... 482/108
7,578,772 B2 8/2009 Lippitt
7,591,770 B2 9/2009 Stewart et al.
D603,002 S 10/2009 Gettle et al.
D603,469 S 11/2009 Golesh et al.
D603,915 S 11/2009 Golesh et al.
7,614,982 B2 * 11/2009 Crawford et al. ..... 482/107
7,625,322 B1 12/2009 Krull
D610,636 S 2/2010 Golesh et al.
7,662,074 B2 2/2010 Webb
D617,854 S 6/2010 Gettle
7,794,373 B2 * 9/2010 Crawford et al. ..... 482/107
2001/0003723 A1 6/2001 Krull
2001/0024999 A1 9/2001 Pappert
2002/0002106 A1 1/2002 Krull
2002/0025888 A1 2/2002 Germanton et al.
2002/0183174 A1 12/2002 Chen
2003/0092542 A1 5/2003 Bartholomew et al.
2003/0148862 A1 8/2003 Chen et al.
2003/0199368 A1 10/2003 Krull
2004/0005968 A1 1/2004 Crawford et al.
2004/0005969 A1 1/2004 Chen
2004/0162197 A1 8/2004 Towley et al.
2005/0143228 A1 6/2005 Lee

| | | | | |
|---|---|---|---|---|
| 2005/0176559 | A1 | 8/2005 | Carter | |
| 2005/0277525 | A1 | 12/2005 | Liu | |
| 2006/0025287 | A1 | 2/2006 | Chermack | |
| 2006/0035767 | A1 | 2/2006 | Ekhaus | |
| 2006/0105889 | A1 | 5/2006 | Webb | |
| 2006/0135328 | A1 | 6/2006 | Doudiet | |
| 2006/0189458 | A1 | 8/2006 | Walkerdine | |
| 2006/0205571 | A1 | 9/2006 | Krull | |
| 2006/0211550 | A1 | 9/2006 | Crawford et al. | |
| 2006/0217245 | A1 | 9/2006 | Golesh et al. | |
| 2007/0167300 | A1 | 7/2007 | Krull | |
| 2007/0275836 | A1 | 11/2007 | Parviainen | |
| 2008/0026921 | A1 | 1/2008 | Liu | |
| 2008/0085821 | A1 | 4/2008 | Webb | |
| 2008/0254952 | A1 | 10/2008 | Webb | |
| 2009/0186748 | A1 * | 7/2009 | Golesh et al. | 482/107 |
| 2010/0311550 | A1 | 12/2010 | Webb | |

FOREIGN PATENT DOCUMENTS

| | | | |
|---|---|---|---|
| DE | 278 064 | A | 4/1990 |
| EP | 0 177 643 | A1 | 4/1986 |
| EP | 0 617 986 | A1 | 10/1994 |
| EP | 1 614 450 | A1 | 1/2006 |
| FR | 1 263 930 | | 5/1961 |
| FR | 2 459 056 | A | 2/1981 |
| FR | 2 613 237 | A1 | 10/1988 |
| JP | 2003010357 | A | 1/2003 |
| KR | 9105716 | B | 8/1991 |
| SE | 455 573 | B | 7/1988 |
| SU | 1 258 447 | A | 9/1986 |
| SU | 1 389 789 | A2 | 4/1988 |
| WO | WO 2006/008767 | A1 | 10/2006 |

OTHER PUBLICATIONS

U.S. Appl. No. 29/278,785, filed Apr. 10, 2007, Crawford et al.
U.S. Appl. No. 29/278,953, filed Apr. 16, 2007, Crawford et al.
U.S. Appl. No. 29/363,868, filed Jun. 15, 2010, Gettle.
UK Fitness Supplies, Co., U.K., located at www.ukfitnesssupplies.co.uk, 2002, 1 page.

* cited by examiner

ADJUSTABLE DUMBBELL SYSTEM

CROSS REFERENCE TO RELATED APPLICATIONS

This application is a continuation of U.S. patent application Ser. No. 12/579,122 entitled "Adjustable Dumbbell System" filed on Oct. 14, 2009, now U.S. Pat. No. 7,794,373, which is a continuation of U.S. patent application Ser. No. 11/844,565 entitled "Adjustable Dumbbell System" filed on Aug. 24, 2007, now U.S. Pat. No. 7,614,982, which is a continuation of U.S. patent application Ser. No. 10/456,977 entitled "Adjustable Dumbbell System" filed on Jun. 5, 2003, now U.S. Pat. No. 7,261,678, which claims the benefit of and priority to U.S. Provisional Application No. 60/387,298 entitled "Adjustable Dumbbell System" filed on Jun. 7, 2002, U.S. Provisional Application No. 60/400,244 entitled "Adjustable Dumbbell System" filed on Jul. 31, 2002, and U.S. Provisional Application No. 60/400,894 entitled "Adjustable Dumbbell System" filed on Aug. 1, 2002, each of which is hereby incorporated herein by reference.

INCORPORATION BY REFERENCE

U.S. Design application Ser. No. 29/164,826 titled "Adjustable Dumbbell" filed on Jul. 31, 2002, now U.S. Pat. No. D540,405, U.S. Design application Ser. No. 29/164,931 titled "Adjustable Dumbbell Support Base" filed on Jul. 31, 2002, now U.S. Pat. No. D508,628, and U.S. Design application Ser. No. 29/164,972 titled "Adjustable Dumbbell" filed on Aug. 1, 2002, now U.S. Pat. No. D540,894, are each hereby incorporated herein by reference.

U.S. patent application Ser. No. 10/127,049 filed on Apr. 18, 2002, now U.S. Pat. No. 7,077,791 is hereby incorporated herein by reference.

FIELD OF THE INVENTION

The present invention relates generally to an adjustable dumbbell system, and more specifically to an adjustable dumbbell system that allows a user to adjust the weight of the dumbbell utilizing rotating collars, and that secures the dumbbell in the base until the proper weight selection has been made.

BACKGROUND OF THE INVENTION

Dumbbells are widely used exercise devices for providing resistance training in a wide variety of exercises such as bicep curls, bench presses, shoulder presses, triceps extensions, and the like. Due to the number of exercises that may be performed with dumbbells, users often need many different dumbbells, each with different weights, to perform an exercise routine. Traditional dumbbells are somewhat inconvenient to use because each time one desires to change the weight of the dumbbell, the user either has to select a heavier dumbbell, or disassemble the dumbbell he is using and change the weight. A single adjustable dumbbell allows a user to perform a varied exercise routine without requiring a large number of different weight dumbbells.

In response to these issues, dumbbells have been designed that allow the weight to be changed on a single dumbbell. These dumbbells typically have more complicated structures that allow the weight load to be selected, and also typically have a relatively large weight differential between weight settings. Where the weight differential is reasonable, the total weight lifted is often relatively low, requiring the use of a second set of heavier adjustable dumbbells for a more heavy workout.

Further, some existing variable weight dumbbells are noisy due to the fact that the weights are sometimes loosely attached to the handle, and thus the weights are able to bang against one another, causing noise and scratching the weights themselves.

What is needed is an adjustable weight dumbbell that is easy to use, securely holds the weights to the bar, and allows more weight options on a single bar.

BRIEF SUMMARY OF THE INVENTION

The invention described herein addresses these issues. The inventive dumbbell has variable weight capabilities, with a locking mechanism to help keep the weights from being rotating with respect to the handle during use, thus helping avoid inadvertent disengagement. The invention also includes an automatic release of the locking mechanism when the dumbbell is set down on a support surface or in a specially designed base structure. The instant invention also includes a unique layered weight plate structure that provides for precisely-weighted plates, and coated weight plates to avoid undesirable noise and damage to the surface of the weights. Further, the instant invention includes a weight selector knob having an indicator strip assembled therein.

In one embodiment, the invention described herein includes a dumbbell having a handle with a grip and at least one end, an inner plate mounted on the handle adjacent the grip, in a fixed rotational orientation, a support plate rotationally mounted on the handle adjacent the inner plate, at least one collar rotationally mounted on the handle adjacent the support plate, and rotationally fixed with the support plate, a selector knob rotationally mounted on the handle adjacent the at least one collar, and rotationally fixed with the collar, a weight plate removably mounted on the handle adjacent the at least one collar, and a means for selectively securing the support plate to the inner plate to resist the rotation of the support plate, collar and selector knob with respect to the inner plate and handle.

Additionally, the means for selectively securing includes a recess formed in the inner plate; a locking device positioned in the recess and engageable with the support plate to engage the support plate to rotationally fix the support plate on the handle.

Further, the support plate can define at least one aperture; and the locking device in the inner plate is selectively received in the aperture to rotationally fix the support plate on the handle.

The locking device can be a post member that moves from a first position being positioned in the recess and disengaged from the support plate to a second position at least partially extending from the recess to engage the support plate.

The means for disengaging the locking device includes a base for receiving the dumbbell; an engagement shoulder on the base for at least partial insertion into the recess in the inner plate; and wherein the engagement shoulder causes the locking device to retract from the support plate when the dumbbell is received in the base and the engagement shoulder is received in the recess.

Additionally, the instant invention includes a dumbbell with plates being made of several sheets of metal bonded together, such as by rivets, to create a weight plate that is economical to use, as well as manufacture. Principally, the weight plate for use on the dumbbell includes a main body having an opening formed through a central portion thereof, the main body including a plurality of plate members bound together to achieve the desired weight value for the weight plate; and the main body at least partially over molded with a coating of a plastic or more particularly a material with thermoplastic characteristics. The weight plate can have a main body including at least one plate having a smaller peripheral size than the main body, and the at least one plate is a plurality of plates having a smaller peripheral size than the main body, and being bound to a common side of the main body at symmetrical or asymmetrical locations.

Other features, utilities and advantages of various embodiments of the invention will be apparent from the following more particular description of embodiments of the invention as illustrated in the accompanying drawings and defined in the appended claims.

BRIEF DESCRIPTION OF THE DRAWINGS

The preferred embodiments of the invention will be described in detail with reference to the following figures, wherein like numerals refer to like elements, and wherein.

DETAILED DESCRIPTION OF THE INVENTION

An adjustable dumbbell system of the present invention provides an adjustable dumbbell 10 that allows a user to easily select the weight of the dumbbell. The adjustable dumbbell system of the present invention allows the user to place the adjustable dumbbell in a support base 12, turn a selector knob 14 or knobs to engage a desired combination of weights 16, and lift the adjustable dumbbell out of the base support to perform a desired exercise. The adjustable dumbbell will have the desired combination of weights, and the unnecessary weights are left in the base support. Should the user desire a different dumbbell weight, the user places the adjustable dumbbell back in the support base, turns the selector knob to engage the desired weight, and lifts the adjustable dumbbell off of the support base with the desired weight. During exercise-type use, i.e., when the adjustable dumbbell is not in the support base, the adjustable dumbbell is configured such that it is difficult or impossible to turn the selector knob to add or remove weights.

Figure 1:
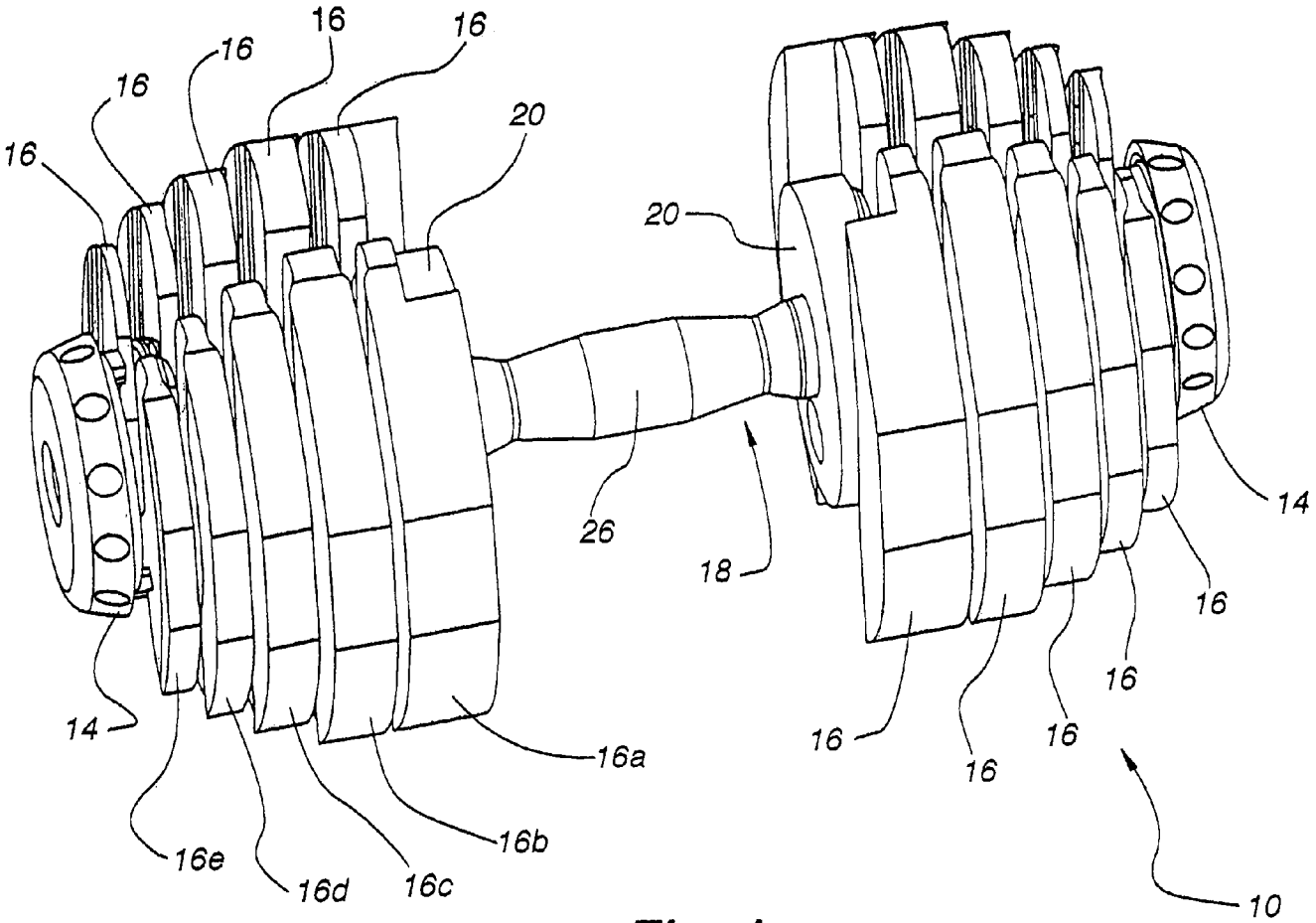
FIG. 1 is an isometric view of an adjustable dumbbell, in accordance with one embodiment of the present invention.
Figure 2:
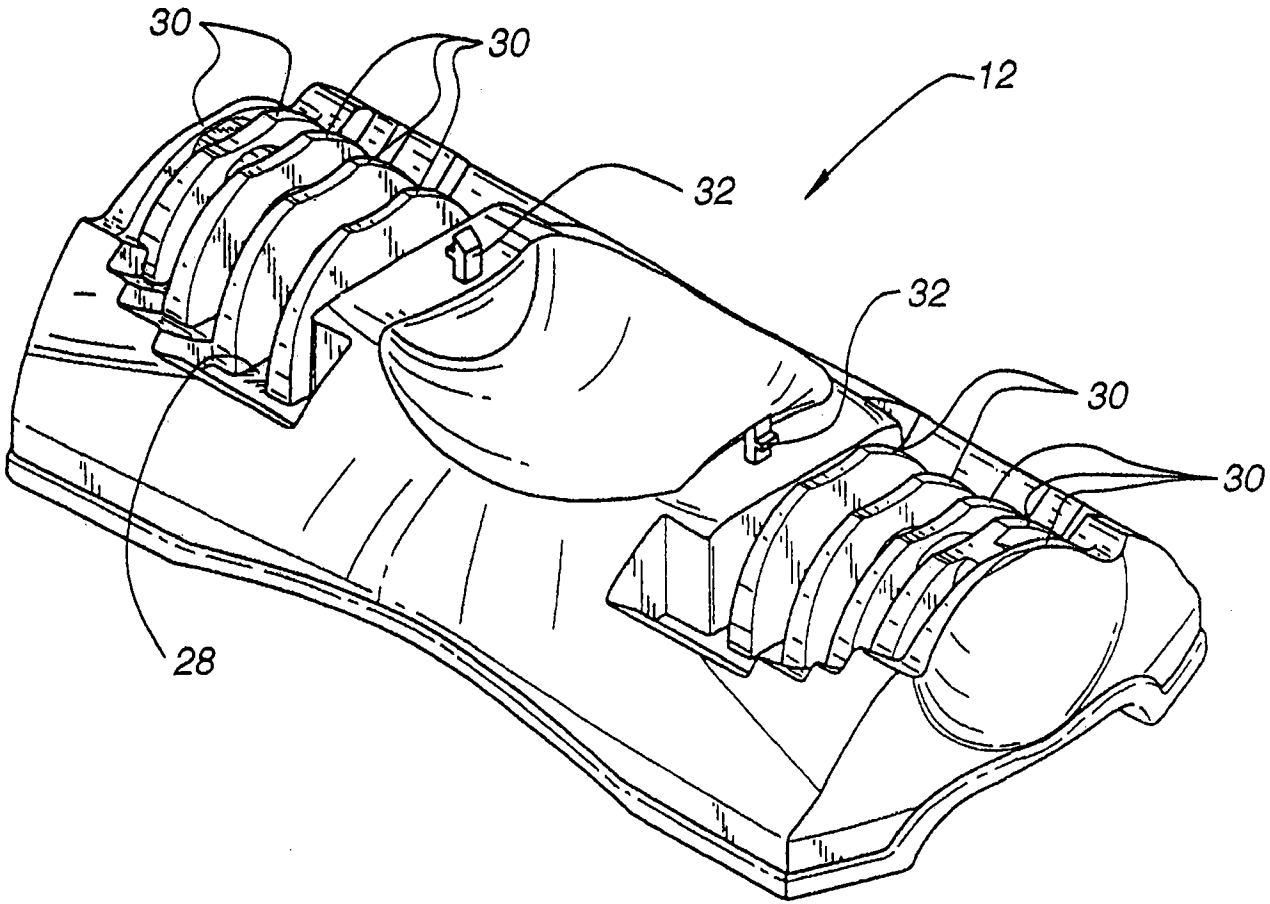
FIG. 2 is an isometric view of a support base, in accordance with one embodiment of the present invention.
Figure 7:
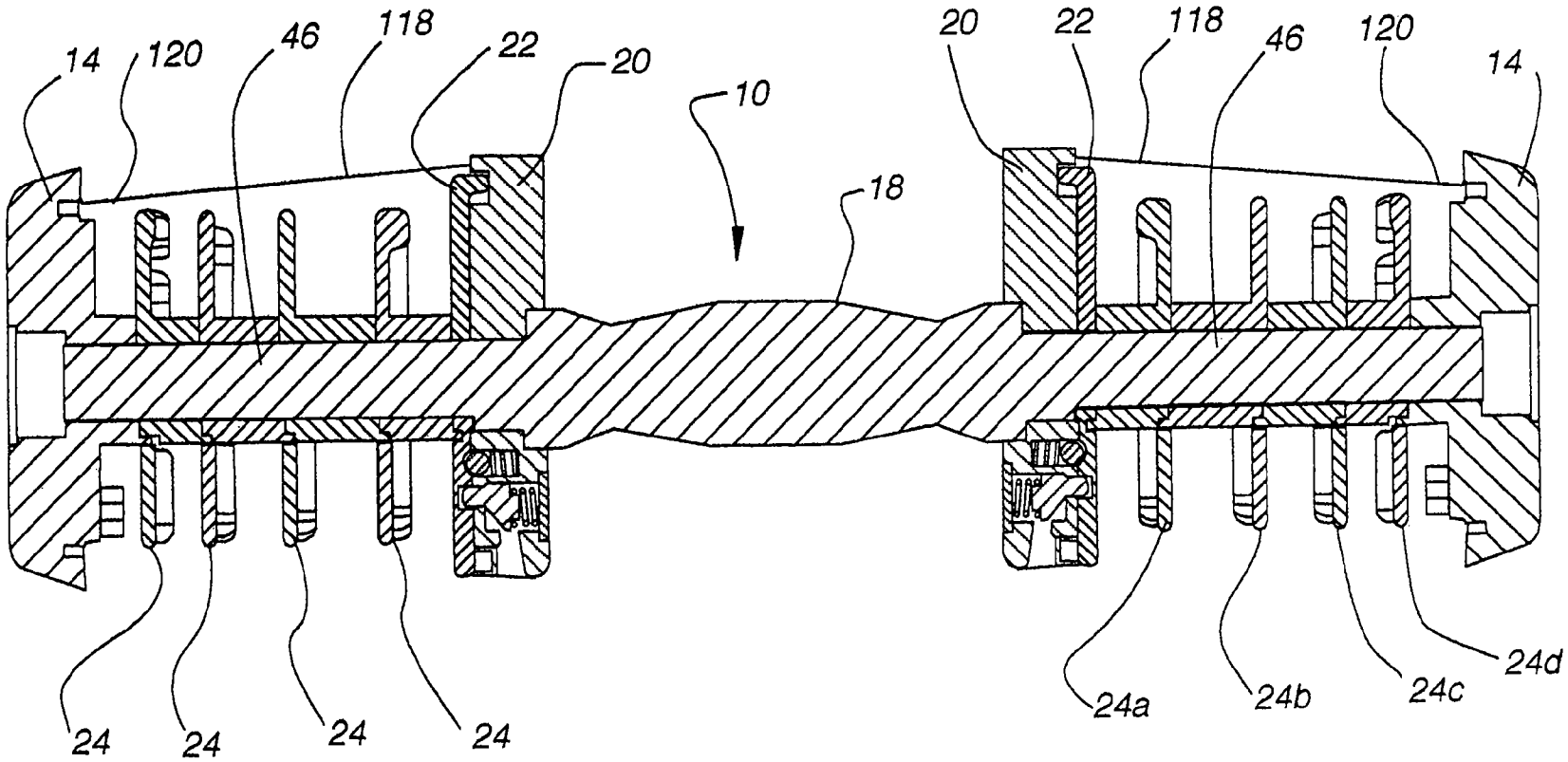
FIG. 7 is a front view of the adjustable dumbbell of FIG. 1, with the weight plates removed.

The adjustable dumbbell system includes an adjustable dumbbell 10, such as shown in FIG. 1, and a support base 12, such as shown in FIG. 2. As shown in FIGS. 1 and 7, the adjustable dumbbell 10 includes a handle 18, a pair of inner supports 20, a pair of inner discs 22, a plurality of weights 16 separated by a plurality of collars 24, and a pair of outer selector knobs 14. The adjustable dumbbell 10 includes two end regions that, except as where otherwise described, are generally identical. Thus, when reference is made to one or more parts on one side of the adjustable dumbbell or base, it is to be understood that corresponding or similar part(s) are disposed on the other side or end region of the adjustable dumbbell or base. The inner support is mounted on the handle adjacent to a central grip portion 26 of the handle. As described in more detail below, the inner support does not rotate with respect to the handle. The inner disc is mounted on the handle immediately distal, or outside, of the inner support 20. The plurality of collars are positioned on the handle and extend distally along the handle 18 from the inner disc. The collars are interlocked together (i.e., with the adjacent collars), and with the inner disc 22, such that the collars and the inner disc rotate together about the handle. The outer selector knob 14 is positioned on the handle at the outer end of the outermost of the adjacent collars 24. The outer selector knob is also interlocked with the adjacent collar so that as the outer selector knob is rotated, the outer selector knob also rotates the collars and the inner disc around the handle. The plurality of weights 16 are spaced between adjacent collars and are selectively engaged by the collars depending upon the orientation of the outer selector knob 14, as is described in more detail below.

Figure 25:
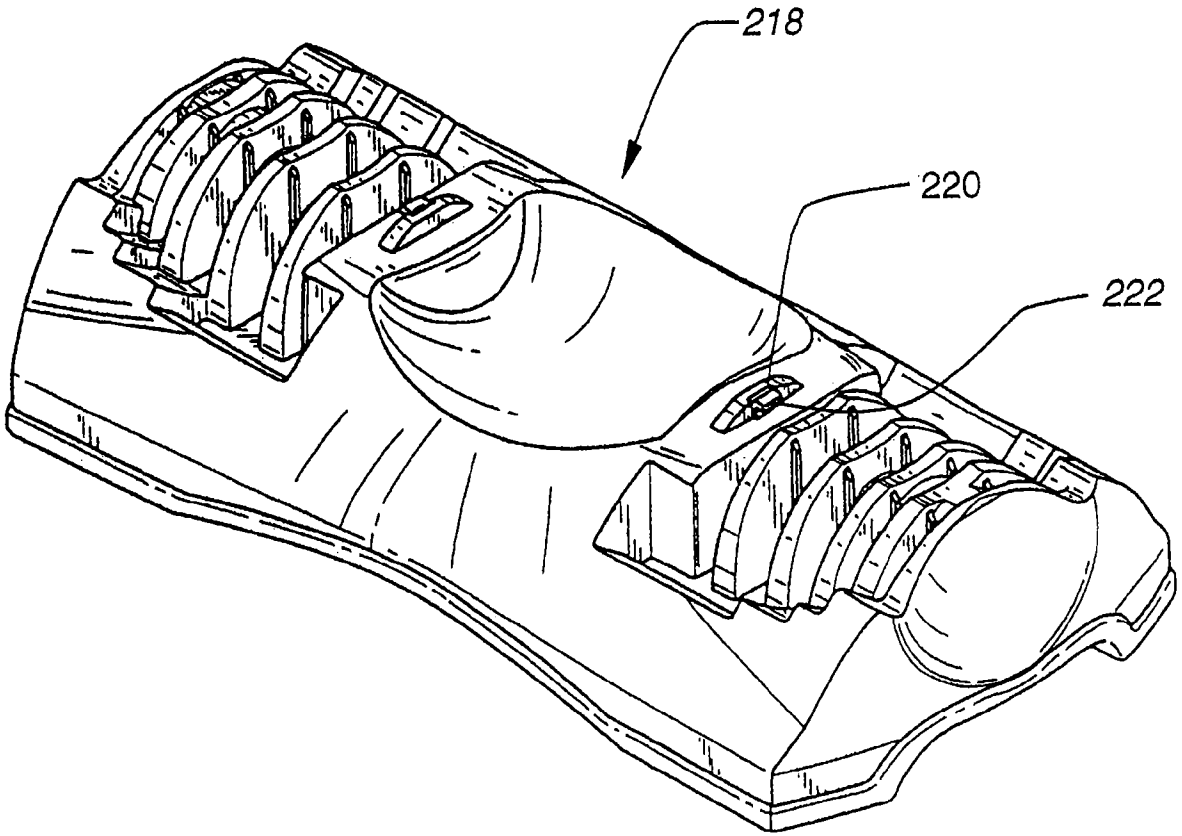
FIG. 25 is an isometric view of one implementation of a support base.

The support base 12, shown in FIGS. 2, 24, 25, 26, and others, receives the dumbbell 10, when not in use, and allows a user to adjust the weight of the dumbbell, as well as to hold the weights that are not attached to the dumbbell. Before using the dumbbell 10, the user first determines the weight to be lifted and sets the respective selector knob 14 at each end of the dumbbell 10 while the dumbbell is in the support base 12. The selector knobs cause a pair or combination of pairs of weight plates 16 to be retained on the handle 18. The user then lifts the dumbbell out of the base. Any weight not retained with the adjustable dumbbell is left in the base. As shown in FIGS. 2 and 25, the support base includes a bottom wall 28, a plurality of positioning walls 30, and a pair of plungers 32. The bottom wall supports the adjustable dumbbell and the weights. The positioning walls 30 ensure that the adjustable dumbbell is properly aligned when it is inserted into the support base. Further, the positioning walls hold the weights upright and in the proper location relative to the adjustable dumbbell so that the adjustable dumbbell may be easily inserted into and removed from the support base. The positioning walls 30 are spaced so as to fit between adjacent weights 16 when the dumbbell 10 rests in the support base 12, and to keep any weight not attached to the dumbbell upright when the dumbbell is removed from the support base. The plungers extend upwardly from the support base. Each plunger is positioned to extend into a cavity formed in the inner support 20 of the adjustable dumbbell when the dumbbell is placed in the support base. The plungers 32 deactivate a locking device, as described further below, to allow selection of different weights when the adjustable dumbbell is in the support base.

Figure 3:
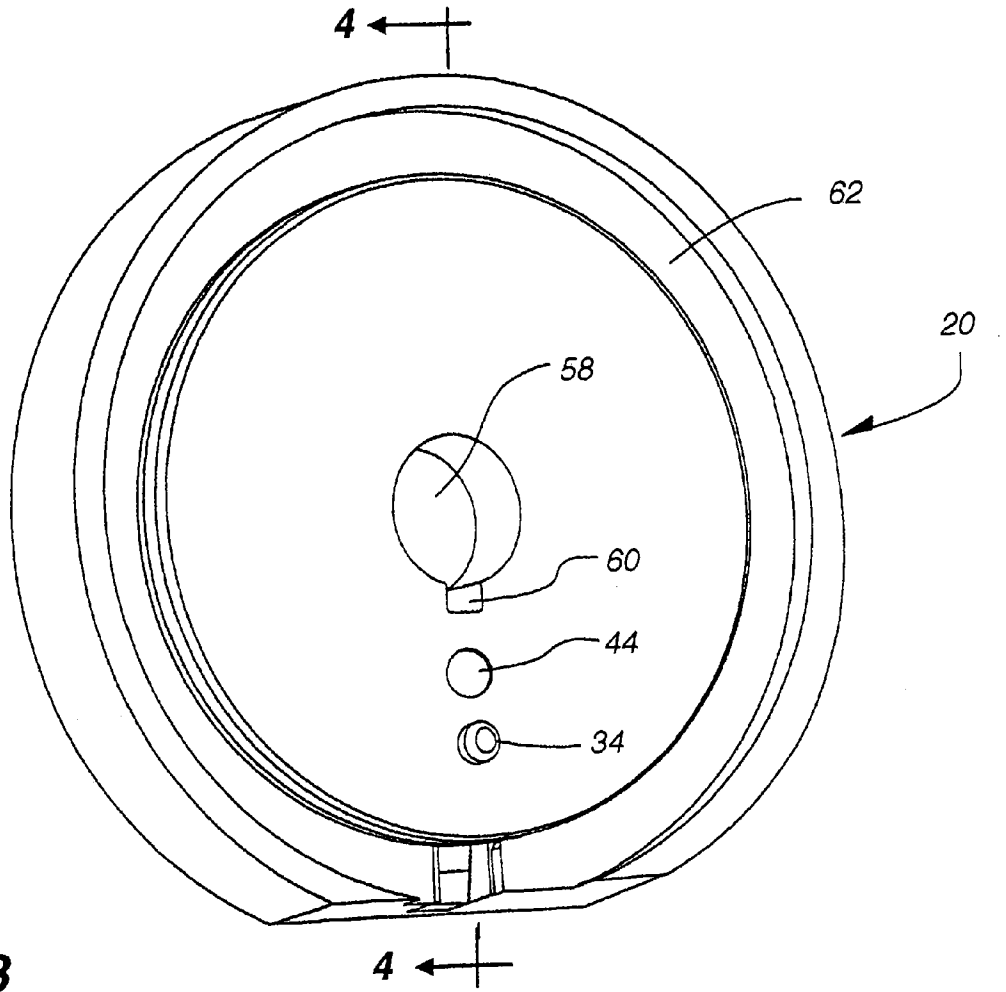
FIG. 3 is an isometric view of an inner support, in accordance with one embodiment of the present invention.
Figure 4:
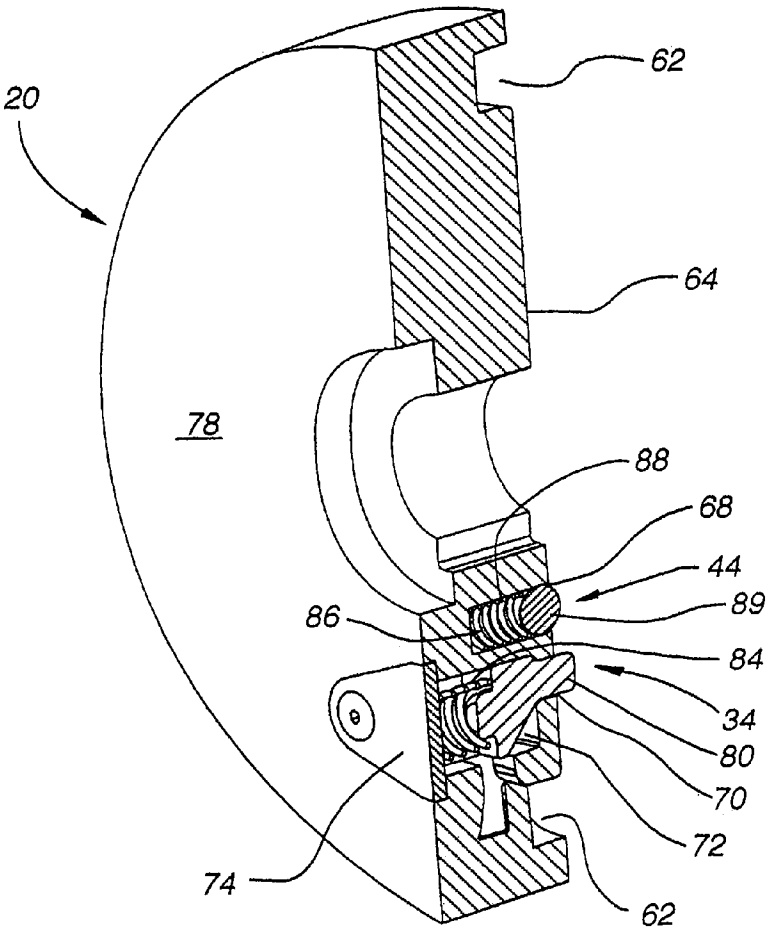
FIG. 4 is a section view of the inner support of FIG. 3 taken along line 4-4.

Referring to FIGS. 3 and 4, the dumbbell inner support 20 includes a spring-loaded pin 34 locking mechanism that prevents the inner disc 22, the collars 24, and the outer selector knobs 14 from rotating with respect to the handle. When the dumbbell 10 is placed in the support base 12, the plunger 32 retracts the spring-loaded pin locking mechanism so that the outer selector knob can be turned, which in turn rotates the collars and the inner disc, to adjust the weight of the adjustable dumbbell. Thus, the weight of the adjustable dumbbell can be adjusted by turning the pair of outer selector knobs 14 to selectively engage or disengage the plurality of weights 16 (on the same respective end of the handle as the knob) with the plurality of collars 24 when the dumbbell 10 is seated in the support base 12.

Figure 23:
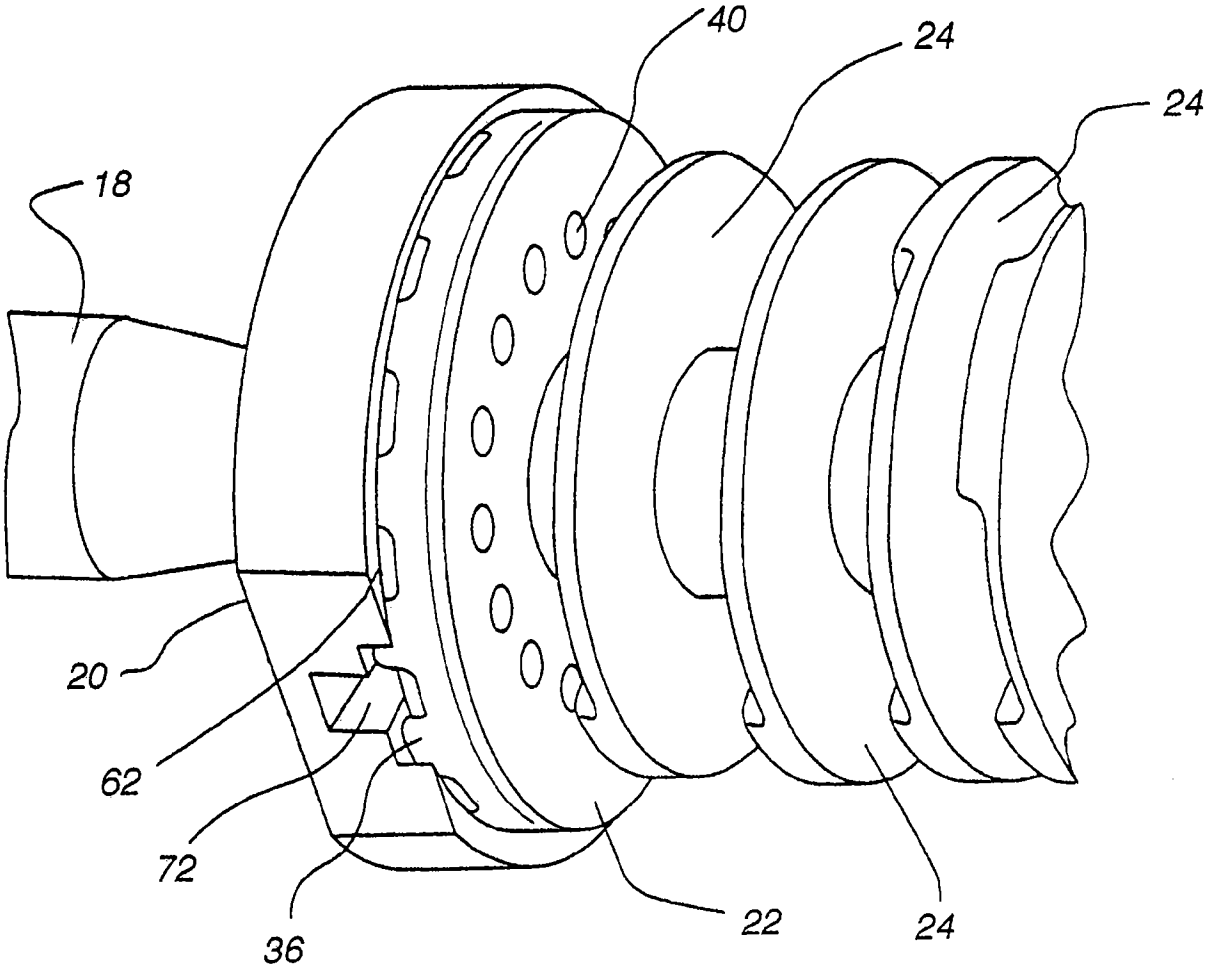
FIG. 23 is a partial isometric view of one implementation of an adjustable dumbbell, in accordance with one embodiment of the present invention.
Figure 24:
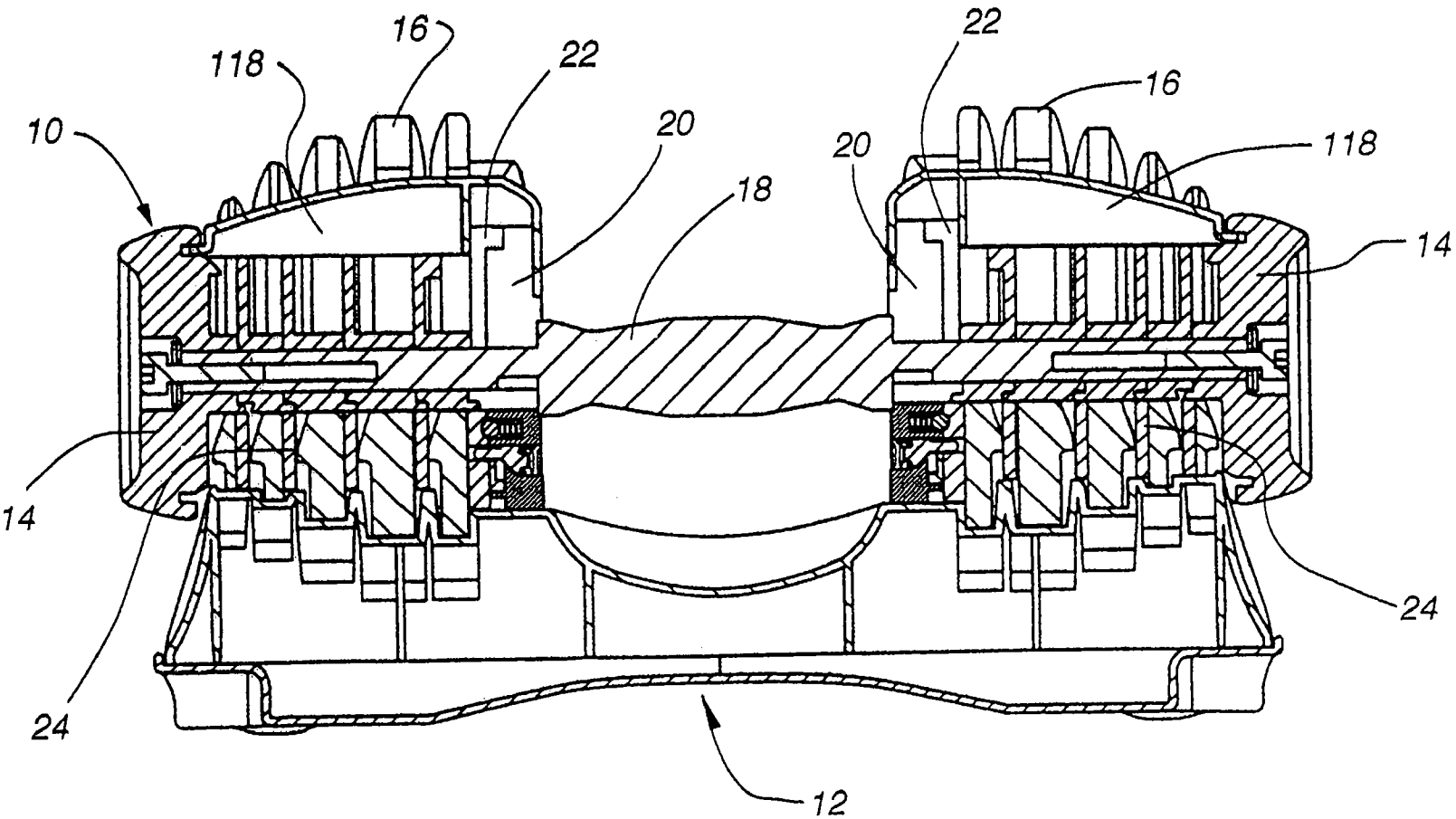
FIG. 24 is a section view of one implementation of an adjustable dumbbell in engagement with one implementation of a support base.

Further, the adjustable dumbbell cannot, in most instances, be removed from the support base unless the weights 16 are fully engaged or disengaged by the collars. As described in more detail below and referring to FIGS. 5 and 23, the dumbbell includes a plurality of teeth 36 on the inner surface of inner disc 22 that can engage a protrusion 38 of the plunger 32 when the weights are not fully engaged or disengaged by the collars. The teeth extend generally parallel to the axis of rotation of the disc, from the outer rim thereof. The teeth are spaced apart sufficiently to allow the protrusion to pass through when the collars are fully engaged, and to interfere with the movement of the protrusion when the collars are not fully engaged. Note that the holes 40, 42 for receiving the spring-loaded pin 34 and a ball detent 44 are positioned in line with the space between adjacent teeth. However, the holes 40, 42 could be anywhere on the disc 22 as long as they cooperate with the spring-loaded pin as described. When the weights 16 are not fully engaged by the collars, the teeth 36 engage the protrusion 38 of the plunger 32 and prevent the plunger from exiting the cavity of the inner support 20, thus preventing the dumbbell 10 from being removed from the support base 11. When the collars, inner disc and knob are properly aligned in rotation on the dumbbell, the dumbbell can be removed from the support base, and the spring-loaded pin locking mechanism re-engages the inner disc and prevents the inner disc, the collars 24, and the outer selector knob 14 from rotating with respect to the handle 18 and the inner support. Thus, when out of the base, the weights 16 are locked into place and the outer selector knob cannot be turned to select a different combination of weights.

Thus, when the dumbbell 10 is set into the base 12, the plunger 32 engages the spring-loaded pin 34 to disengage it from the inner disc 22. The selector knob 14 can then be rotated to rotate the collars 24 to select the desired weight. The ball detents 44 help the user tell when he or she is at a secure rotation location and not between locations for selecting weight plates 16. The knob also has markers to indicate that the desired weight has been selected. This is described in greater detail below. In between weight selection locations, the teeth 36 on the inner disc 22 are engaged with the protrusion 38 of the plunger, thus keeping the inner disc, and the dumbbell, in the base. When the knob is properly indexed, the protrusion passes between the teeth and allows the dumbbell to be removed from the base. As the dumbbell is removed from the base, the plunger disengages the spring-loaded pin 34 and allows the pin to be biased into the matching hole on the inner disc 22 to keep the inner disc from rotating relative to the support plate 20 and the dumbbell 10. This also keeps the collars 24 and selector knob 14 from turning since they are both keyed to the rotation of the inner disc 22. Thus, when the dumbbell is removed from the base 12, the selector knob cannot be rotated to change the weight selection and cause the weight plates 16 on the dumbbell to become dislodged.

Figure 6:
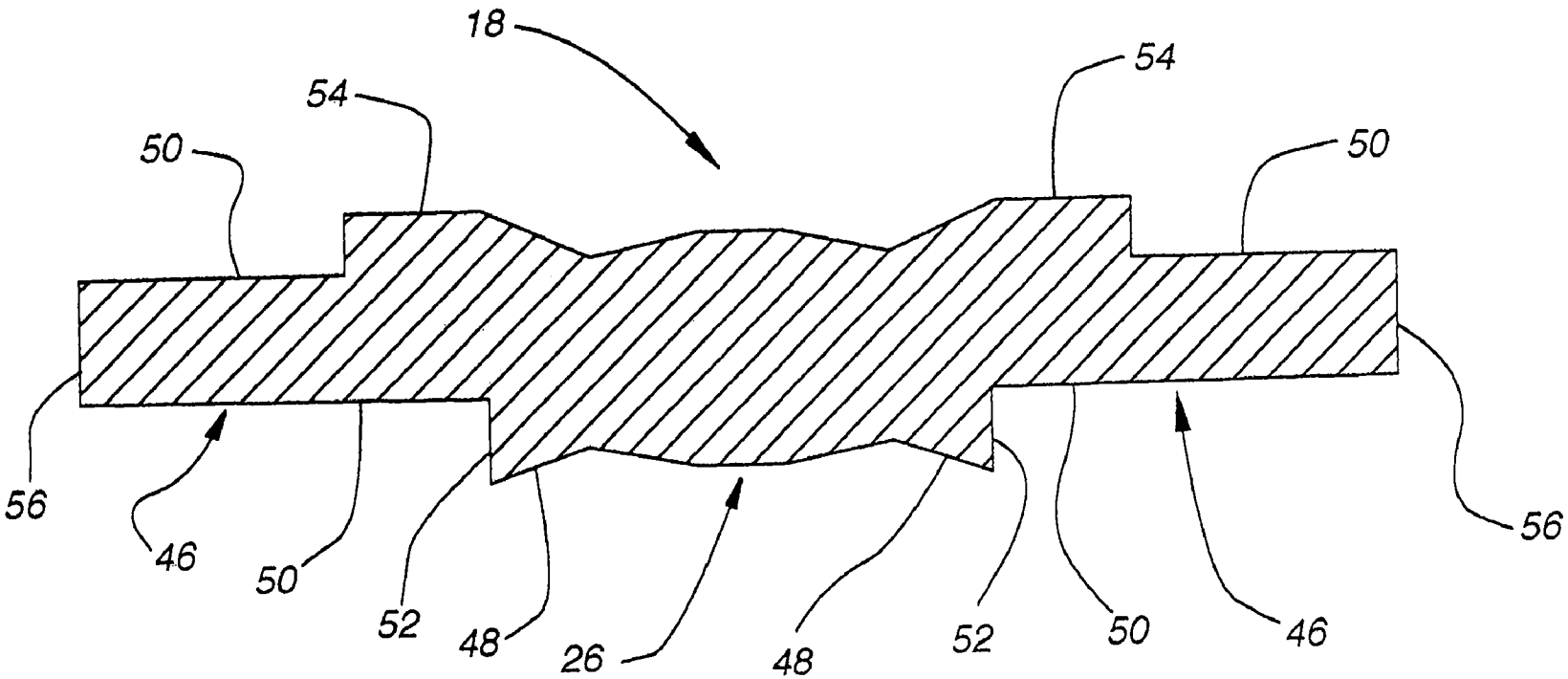
FIG. 6 is a front view of a handle, in accordance with one embodiment of the present invention.

As shown in FIG. 6, the handle 18 of adjustable dumbbell 10 includes a central grip portion 26 and a pair of end portions 46, one on either end of the grip portion. The grip portion of the handle is preferably machined and provides a comfortable, ergonomic, and non-slip surface allowing a user to securely grip the adjustable dumbbell. The grip portion further includes a pair of flanges 48 adjacent to the end portions. The flanges extend beyond the outer periphery 50 of the end portions and provide a support surface 52 for the inner support 20. The end portions 46 also include keys 54 that extend beyond the outer periphery of the end portions. The keys extend radially from the handle's longitudinal center line, and extend a ways along the length to fit into a key way in the support plate 20 in order to keep the support plate from rotating on the handle 18. As used herein, the terms inner and proximal refer to a direction toward the central grip portion 26 of the handle, and the terms outer and distal refer to a direction toward the terminal ends 56 of the end portions 46 of the handle.

The handle is generally symmetrical about the midpoint of the central grip portion. The central grip portion is slightly bulged to provide a comfortable and ergonomic surface to grasp. As such, extending distally from the center of the grip portion 26, the handle 18 has a generally decreasing radius. The radius of the handle begins increasing at the flange 48 until the support surface 52 where the handle has a step decrease in the radius. This step decrease in radius extends around the handle except for one section, which forms the key 54. Distal of the key, the handle has a generally constant radius until the terminal end 56 of the handle. The area distal the key is adapted to engage cooperating apertures in the inner disc 22 the collars 24, and the outer selector knob 14 allowing those elements to slide onto the end portions.

Figure 19:
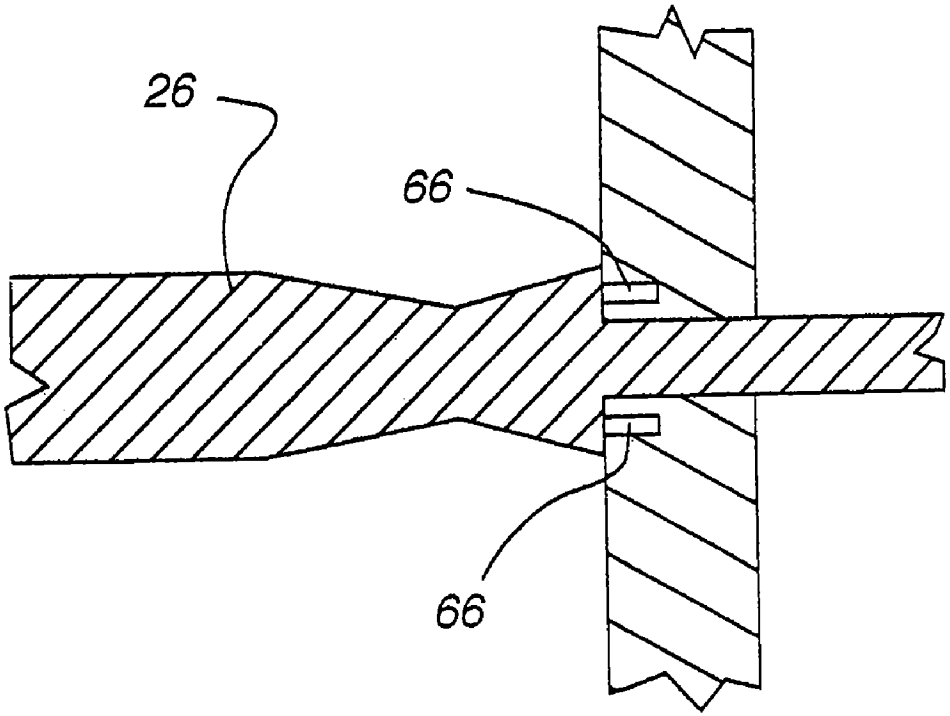
FIG. 19 is a representative front section view of a portion of the handle and the inner support.
Figure 20A:
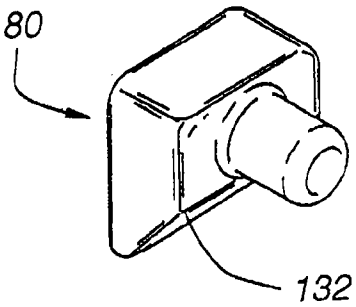
FIG. 20*a* is an isometric view of a locking pin, in accordance with one embodiment of the present invention.
Figure 20B:
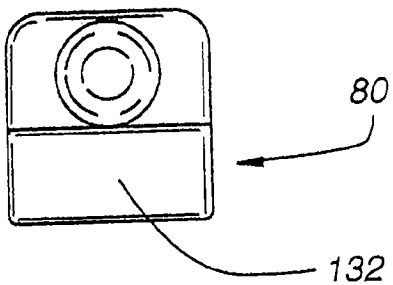
FIG. 20*b* is a front view of the locking pin of FIG. 20*a;*
Figure 20E:
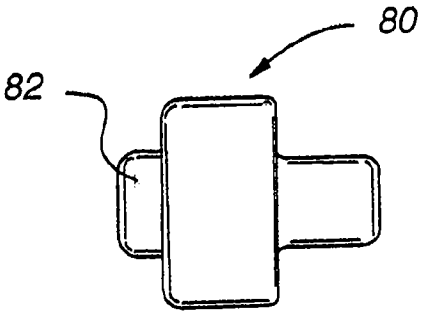
FIG. 20*e* is a top view of the locking pin of FIG. 20*a;*
Figure 20C:
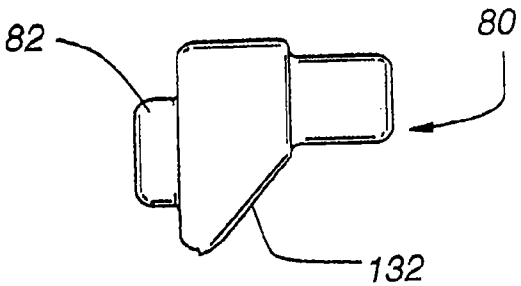
FIG. 20*c* is a side view of the locking pin of FIG. 20*a;*
Figure 20D:
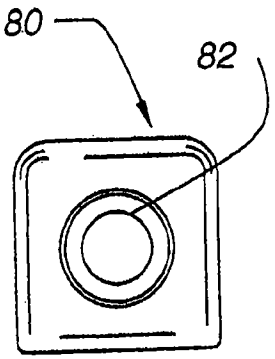
FIG. 20*d* is a rear view of the locking pin of FIG. 20*a;*
Figure 21A:
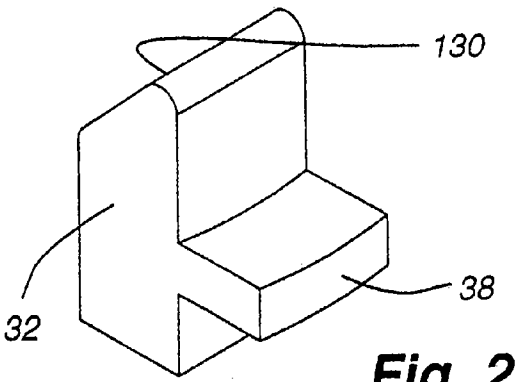
FIG. 21*a* is an isometric view of a plunger, in accordance with one embodiment of the present invention.
Figure 21D:
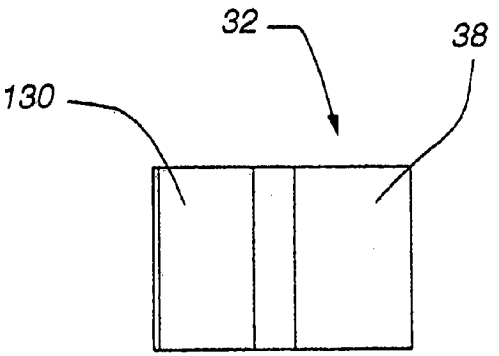
FIG. 21*d* is a top view of the plunger of FIG. 21*a;*
Figure 21C:
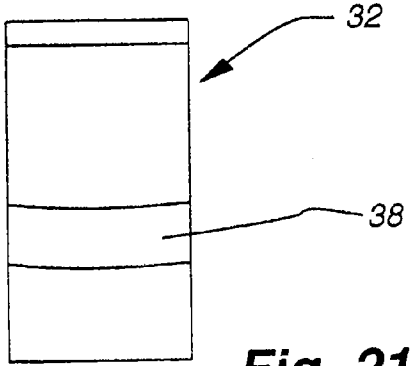
FIG. 21*c* is a front view of the plunger of FIG. 21*a;*
Figure 21B:
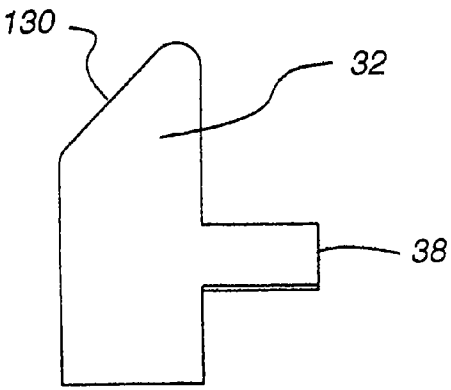
FIG. 21*b* is a side view of the plunger of FIG. 21*a;*

As shown in FIG. 3, the inner support 20 defines a generally centrally-formed aperture, such as an inner opening 58, for receiving an end portion of the handle 18. Each support plate is seated on one end portion 46 of the handle adjacent to the flange 48 of the central grip portion 26. The aperture of the inner support further includes a keyway 60 that receives the key 54 from the end portion of the handle and prevents the inner support from rotating with respect to the handle. Alternatively, the handle may include a keyway for receiving a key mounted on the inner support place. The inner support 20 also includes a peripheral channel 62 in the outer surface 64 of the inner support. Any other means of anchoring the inner support to the handle known in the art may be used. The inner support, for example, may be anchored to the handle through the use of pins 66 as shown in FIG. 19. The housing of the inner support plate 20 is preferably constructed of a nylon-glass reinforced material, although it may be constructed of any other suitable material, such as metal or the like.

As discussed above, the inner support includes the spring-loaded ball or ball detent 44 and the spring-loaded pin 34 that are biased to extend from within the inner support beyond the outer surface 64 of the inner support. FIG. 4 shows a cross-sectional view of the inner support 20 showing the spring-loaded ball 44 and the spring-loaded pin 34 generally biased to an outer position and extending partially through holes 68 and 70, respectively, in the outer surface 64 of the inner support. The inner support further includes a cavity 72 and a cover plate 74. The spring-loaded pin is housed within the cavity of the inner support and is generally biased to extend from the cavity through the hole 70. The cover plate is removably attached with the inner surface 78 of the inner support, and provides access to the spring-loaded pin 34 in the cavity, and further provides a surface for the spring to engage and bias the spring-loaded pin outwardly from the outer surface.

Referring still to FIG. 4, the spring-loaded pin 34 is housed within the cavity 72 between the cover plate 74 and the outer surface 64 of the inner support 20. The spring of the spring-loaded pin is seated against the cover plate. The pin 80 (shown separately in FIGS. 20A-20E) includes knob 82 that extends into the spring coil 84. The spring generally biases the pin 80 toward the hole 70 in the outer surface such that, absent any counteracting forces, the pin extends through the hole 70 for engagement of one of the apertures 40 of the inner disc 22.

Referring still to FIG. 4, the spring-loaded ball 44 is housed within a separate cavity 86 of the inner support 20 directly above the cavity 72. The spring 88 of the spring-loaded ball is seated against the inner surface of the cavity 86. The ball 89 is in engagement with the other end of the spring and is thus generally biased toward the hole. As such, the ball 44 is adapted to engage one of the detent recesses 42 of the inner disc 22. The ball is retained by the inner disc. During assembly, i.e., before the inner disc may hold the ball in place, the ball is held by grease used to lubricate the ball detent.

Figure 5:
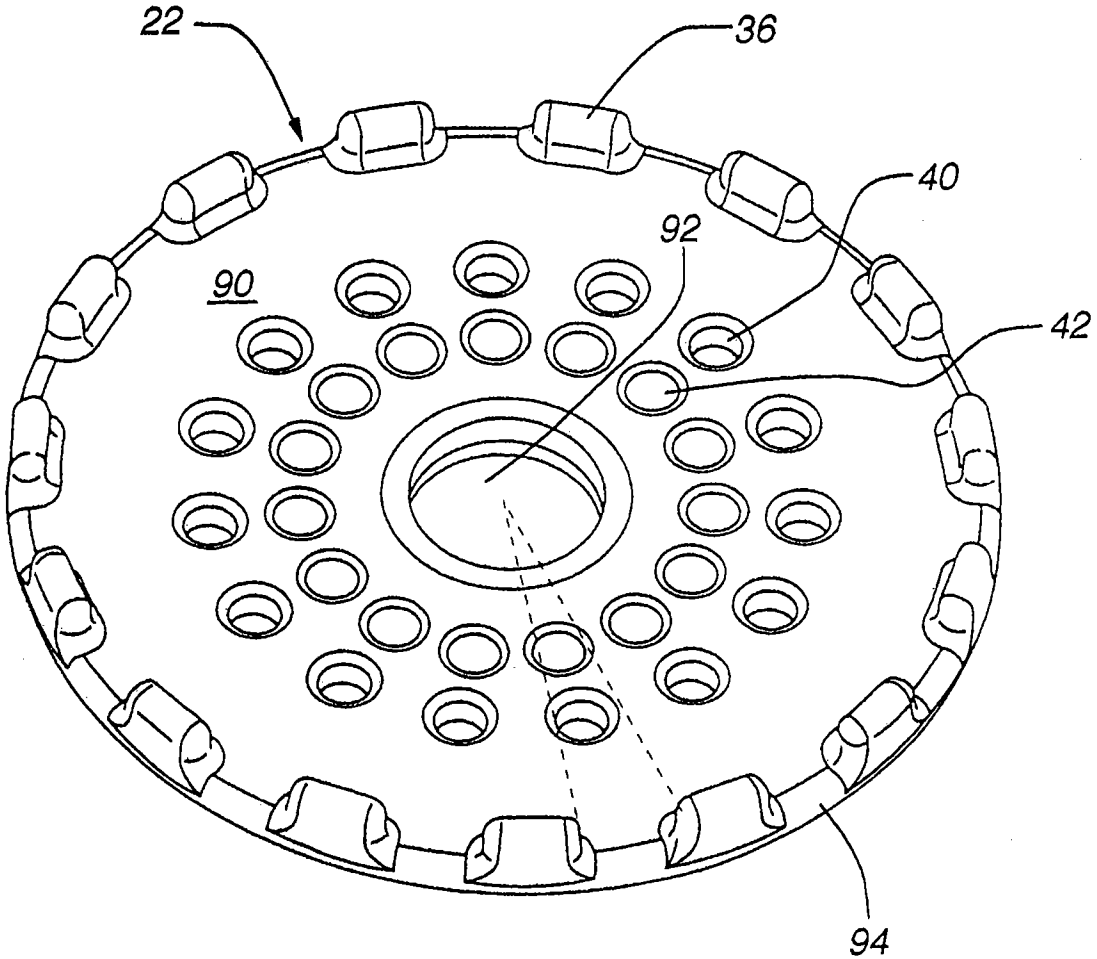
FIG. 5 is an isometric view an inner disc, in accordance with one embodiment of the present invention.

As introduced above, FIG. 5 shows a isometric view of the inner surface 90 of the inner disc 22. The inner disc includes teeth 36, apertures 40, detent recesses 42, and a generally centrally located inner opening 92 for receiving the handle 18. The teeth, apertures, and detent recesses are arranged concentrically on the inner disc. The teeth are arranged around the perimeter 94 of the inner disc 30 and extend generally 90 degrees inwardly from the perimeter edge of the inner disc. The detent recesses are spaced radially inwardly from the apertures. The apertures and the detent recesses are angularly aligned with each other and are angularly offset from the teeth when the selector knob 14 is properly oriented to select the desired weight. This allows the protrusion 38 to pass between the teeth 32 and let the dumbbell 10 be removed from the base 12. When assembled, the teeth of the inner disc 22 extend into the peripheral channel 62 of the inner support 20 (see FIG. 23). As described above, the inner disc is interlocked to the collars 24 and the outer selector knob 14. When the dumbbell is received in the base, as the weight of the dumbbell is being selected by rotating the outer selector knob, the inner disc is rotated about the handle 18 with respect to the inner support 20, which is fixed with respect to the handle. The spring-loaded ball 44 engages the detent recesses 42 to indicate the rotational position of the inner disc 22 to allow the user to clearly identify when the outer selector knob has been turned one full setting as described in more detail below. When removed from the base, the spring-loaded pin 34 of the inner support engages the corresponding aperture 40 to lock the inner support 20 to the inner disc 22 so that the outer selector knob 14, the collars 24, and the inner disc cannot rotate with respect to the inner support and the handle 18.

FIG. 7 shows a cross-sectional view of the adjustable dumbbell 10 taken along the longitudinal centerline of the handle 18 without any weights 16 attached to the handle. As shown in FIG. 7, the plurality of collars 24 and the outer selector knob 14 are mounted on both of the end portions 46 of the handle and are arranged distally from the inner support 20 and the inner disc 22. The inner disc, each of the collars, and the outer selector knob are interlocked and rotatably mounted on the end portion of the handle. Thus, by turning the outer selector knob 14, each of the collars 24 and the inner disc 22 are rotated together around the end portion 46 of the handle 18. As described above, however, the inner support remains stationary with respect to the handle, and the teeth 36 of the inner disc rotate within the peripheral channel 62 of the inner support.

Figure 8:
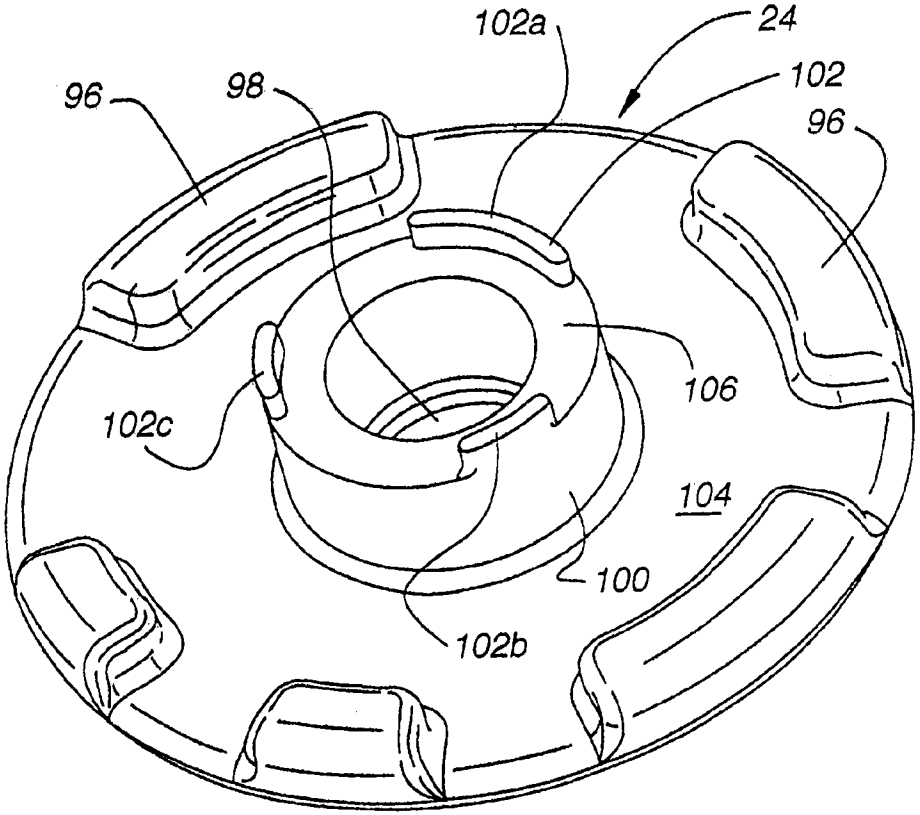
FIG. 8 is an isometric view of a collar, in accordance with one embodiment of the present invention, the isometric view illustrating the outer face of the collar.

FIG. 8 shows an isometric view of the inner surface of one of the collars 24. The collar includes one or more peripheral flanges 96, inner opening 98, extension sleeve 100, and a plurality of insert tabs 102. As described in more detail below, the one or more peripheral flanges either engage and lift a weight 16 from the support base 12, or do not engage a weight plate and allow it to remain in the support base depending upon the orientation of the collar. The inner opening and extension sleeve receive the end portion 46 of the handle 18 and allow for the collar 24 to rotate with respect to the handle. The extension sleeve extends from the inner surface 104 of the collar and allows for separation between the individual collars to form a space between adjacent collars to receive the weights 16. The extension sleeve 100 defines a terminal face 106. The insert tabs 102 extend axially inward from the terminal face of the extension sleeve, preferably from the outer periphery of the terminal face, for engagement with the outer surface of an adjacent collar or the inner disc 22 as described in more detail below.

Figure 9:
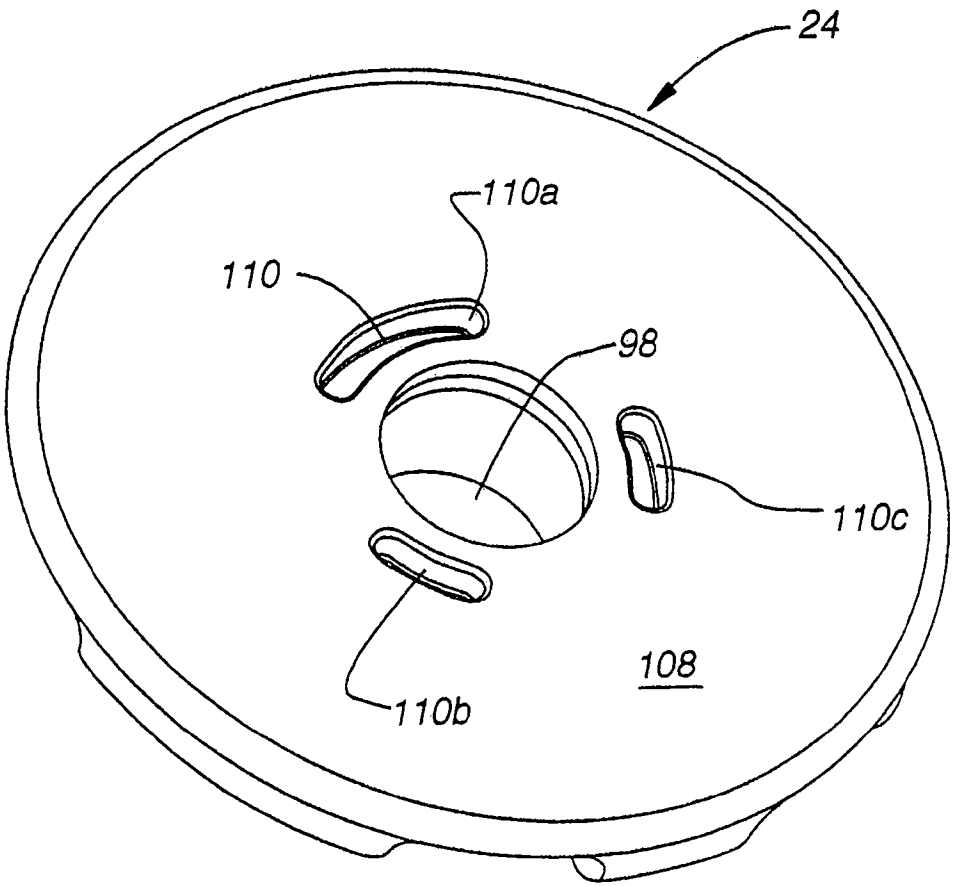
FIG. 9 is an isometric view of the collar of FIG. 8, the isometric view illustrating the inner face of the collar.

FIG. 9 shows a isometric view of the outer surface of one collars 24. As shown in FIG. 9, the outer surface 108 of the collar includes a plurality of indentations to receive the inserts 102 of an adjacent collar. The inserts and the indentations 110 are keyed so that the collars can only be interconnected in one orientation. In the embodiment shown in FIGS. 8 and 9, for example, the insert 102*a* and corresponding indentation 110*a* are wider than the inserts 102*b* and 102*c* and indentations 110*b* and 110*c* so that the collars can only be connected in a particular orientation. In one particular embodiment, for example, the individual collars may be keyed such that the collars may only be assembled in one particular order along the dumbbell handle 18 in addition to being assembled in only one particular orientation with respect to one another.

Figure 10:
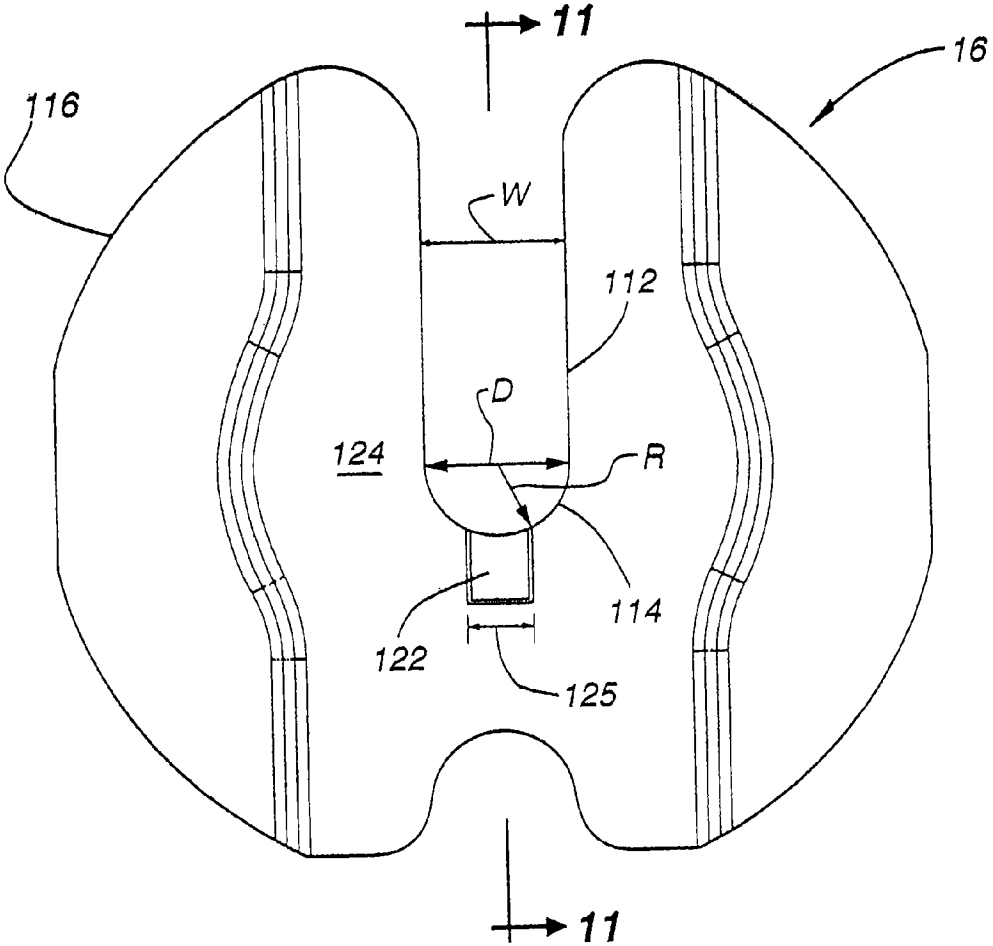
FIG. 10 is a front view of a weight, in accordance with one embodiment of the present invention.

FIG. 10 shows a front view of a weight 16 for the adjustable dumbbell 10. Overall, the weight has a generally round shape. The weight further forms a channel 112 for receiving the extension sleeve 100 of the collars 24. The channel terminates at its inner end at semi-circular arc 114 having a constant radius R. The channel also has a constant width W equal to the diameter D of the semi-circular arc. The channel allows the extension sleeve of the collar to turn within the channel and to only move the weight incidentally through friction. At its outer end, the channel 112 necks out towards the periphery 116 of the weight 16 for receiving a stabilizing bar 118 (also referred to as bridge) (shown in FIGS. 7 and 22). The stabilizing bar extends across the upper portion of the channels of the weights to secure the weights and prevent the weights from rotating with the collars 24 during weight selection. As shown in FIGS. 1 and 7, the weights 16 extend above the height of the collars so that the bar does not interfere with the rotation of the collars. The bar can be attached at one end to the inner support 20 and/or to the handle 18 so that the bar does not rotate with the inner disc 22 or the collars. On the opposite end, the bar 118 extends into a peripheral groove 120 of the outer selector knob 14 (shown in FIG. 7). As the outer selector knob 14 rotates, the bar 118 is positioned within the peripheral groove 120 without rotating.

Figure 11:
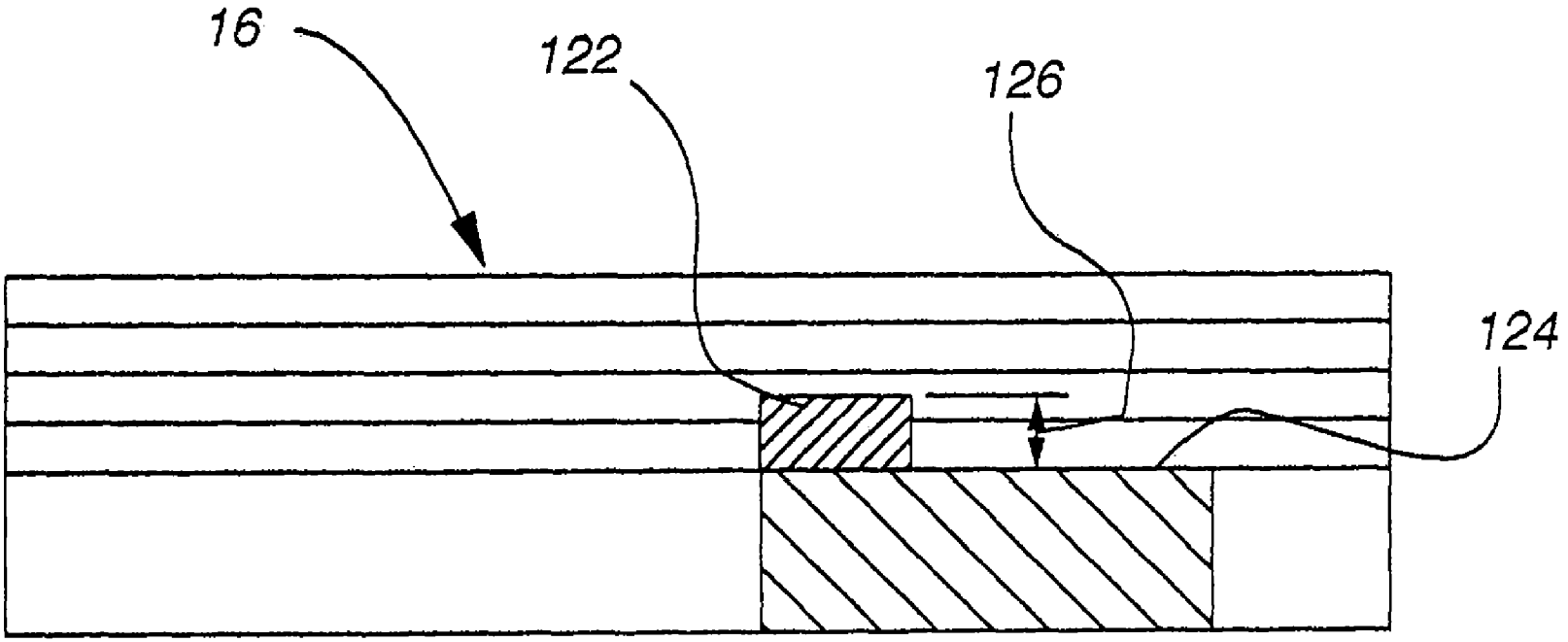
FIG. 11 is a section view of the weight plate of FIG. 10 taken along line 11-11.

Still referring to FIG. 10, an engagement tab 122 extends from the outer surface of the weight 16 to engage a particular peripheral flange 96 of one of the collars 24. The particular peripheral flange is determined by the desired weight to be lifted by the dumbbell 10. FIG. 11 further shows a cross-sectional view of the weight shown in FIG. 10 taken along section line A-A. As shown in FIG. 11, the tab extends from the front surface 124 of the weight for engagement with the peripheral flanges of the collars.

The peripheral flanges 96 of the collars 24 are clocked to the tabs 122 of the weights 16, i.e., there is a known defined rotational relationship between the peripheral flanges and tabs. A certain orientation of the outer selector knob 14 will engage none, one, or more particular peripheral flanges to the tabs of the weights to allow the user to select a predefined amount of weight.

The number of incremental weight selections available on the dumbbell 10 can be varied by varying the minimum width of the peripheral flanges 96 or by varying the circumference available for the peripheral flanges. For example, if the minimum width of the peripheral flanges is decreased, the number of peripheral flanges that may be placed around a constant circumference may be increased, thus increasing the number of incremental weight selections that may be made. Alternatively, by increasing the radius of the peripheral flange 96 from the center of the collar 24, the circumference available for positioning flanges is increased and the number of constant width peripheral flanges that may be placed around the circumference of the collar is increased, thus increasing the potential number of incremental weight selections that may be made. Although the peripheral flanges are preferably located along the periphery of the collar 24 so that the circumference available to position the peripheral flanges 96 is maximized, the flanges may be located either at the periphery of the collar or may be located any distance away from the periphery of the collar towards the center of the collar. In this embodiment, for example, the collar can have an outer diameter of 84 mm and a radius from the center of the collar to the peripheral flange of 32.5 mm.

Referring again to the weight plate 16 shown in FIGS. 10 and 11, in one embodiment, for example, the tab 122 has a width 125 of about 13 mm and height 126 of about 9.5 mm. With this weight plate, the minimum spacing between the peripheral flanges 96 of the collars 24 is at least 14 mm to allow the tab 38 to slide through the spacing when the weight is not selected.

Figure 12:
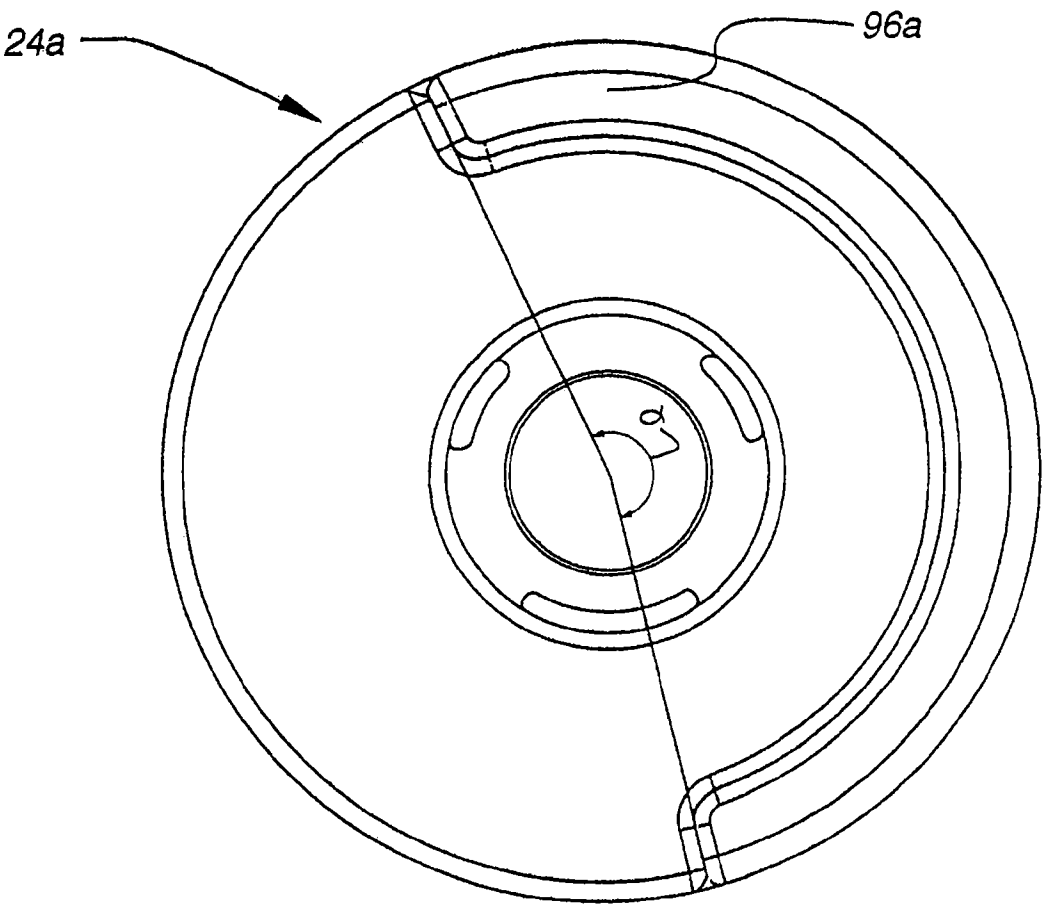
FIG. 12 is a front view of one implementation of a collar, in accordance with one embodiment of the present invention.

FIG. 12 shows a front view of a first selection collar 24*a* located adjacent the inner disc 22 on the end portion 46 of the handle 18. As shown in FIG. 12, the first selection collar includes one flange 96*a* extending around a portion of the periphery of the first selection collar. In the particular embodiment described above wherein the collars 24 have an outer diameter of 84 mm and a radius from the center to the peripheral flange 96 of 32.5 mm, for example, the peripheral flange may extend around the periphery of the first selection collar 24*a* for an angle $\alpha$ of approximately 192 degrees. The extension sleeve 100 of the first selection collar is seated within the channel 112 of the first weight 16*a* of the adjustable dumbbell 10 (see FIG. 1). As the outer selector knob 14 is rotated, the peripheral flange 96*a* rotates around the end portion 46 of the handle 18. If the first weight 16*a* is selected by the user, the peripheral flange is positioned under the tab 122 of the first weight. Thus, when the adjustable dumbbell is lifted out of the support base 12, the peripheral flange 96*a* of the first selection collar 24*a* engages the tab 122 of the first weight 16*a* and lifts the first weight out of the support base. If the first weight 16*a* is not selected, however, the peripheral flange 96*a* of the first selection collar 24*a* is not under the tab 122 of the first weight. As the adjustable dumbbell 10 is lifted out of the support base 12, the first weight remains in the support base, supported by the positioning walls 30 of the support base.

Figure 13:
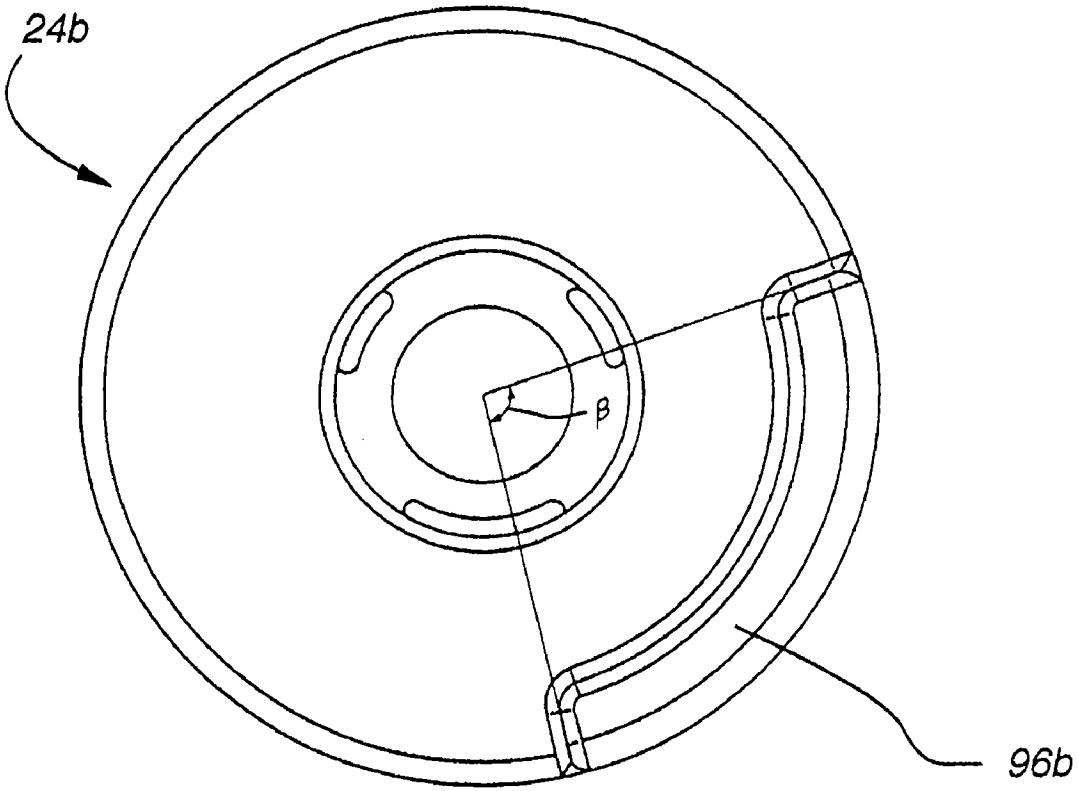
FIG. 13 is a front view of a second implementation of a collar, in accordance with one embodiment of the present invention.

FIG. 13 shows a front view of a second selection collar 24*b* located on the end portion 46 of the handle 18 immediately distal of the first selection collar 24*a*. As shown in FIG. 13, the second selection collar includes one flange 96*b* extending around a portion of the periphery of the second selection collar. In the particular embodiment described above wherein the collars 24 have an outer diameter of 84 mm and a radius from the center to the peripheral flange 96 of 32.5 mm, for example, the flange may extend around a periphery of the second selection collar 24*b* for an angle $\beta$ of approximately 96 degrees. The extension sleeve 100 of the second selection collar is seated within the channel 112 of the second weight 16*b* and is interlocked with the first selection collar 24*a* so that the collars turn together. As the outer selector knob 14 is rotated, the peripheral flange 96*b* rotates around the end portion 46 of the handle 18. If the second weight 16*b* is selected by the user, the peripheral flange 96*b* is positioned under the tab 122 of the second weight 16*b*. Thus, when the adjustable dumbbell 10 is lifted out of the support base 12, the peripheral flange 96*b* of the second selection collar 24*b* engages the tab 122 of the second weight 16*b* and lifts the second weight out of the support base. If the second weight is not selected, however, the peripheral flange of the second selection collar is not under the tab of the second weight and the outer end portion of the handle passes out of the channel 112 without lifting the second weight out of the support base. As the adjustable dumbbell is lifted out of the support base 12, the second weight 16*b* remains in the support base, supported by the positioning walls 30 of the support base.

Figure 14:
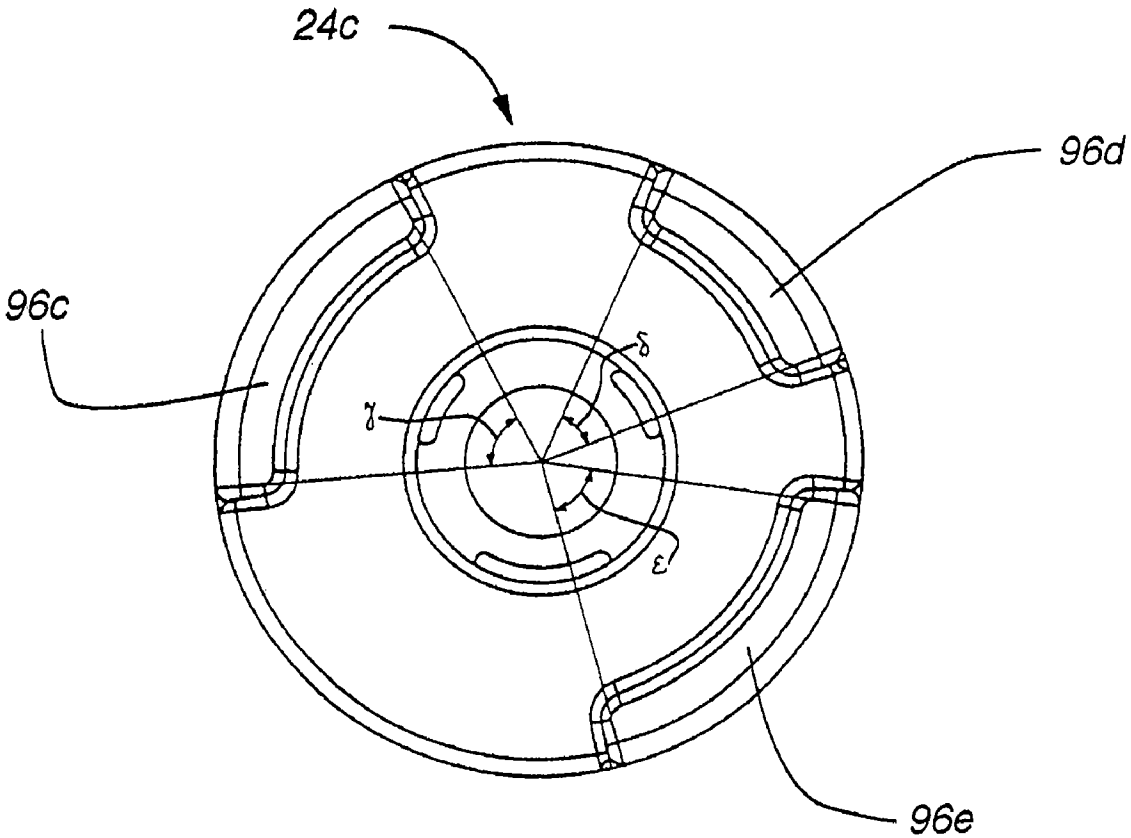
FIG. 14 is a front view of a third implementation of a collar, in accordance with one embodiment of the present invention.

FIG. 14 shows a front view of a third selection collar 24*c* located on the end portion 46 of the handle 18 immediately distal of the second selection collar 24*b*. As shown in FIG. 14, the third selection collar includes three flanges 96*c*, 96*d*, and 96*e* extending around a portion of the periphery of the third selection collar 24*c*. In the particular embodiment described above wherein the collars 24 have an outer diameter of 84 mm and a radius from the center to the peripheral flange 96 of 32.5 mm, for example, the flanges 96*c*, 96*d*, and 96*e* may extend around a periphery of the third selection collar 24*c* for angles $\gamma$, $\delta$, and $\epsilon$ of approximately 72, 48, and 72 degrees, respectively. The extension sleeve 100 of the third selection collar 24*c* is seated within the channel 112 of the third weight 16*c* of the adjustable dumbbell 10 and is interlocked to the second selection collar 24*b*. As the outer selector knob 14 is rotated, the three peripheral flanges 96*c*, 96*d*, and 96*e* rotate around the end portion of the handle. If the third weight 16*c* is selected by the user, one of the peripheral flanges 96*c*, 96*d*, and 96*e* is positioned under the tab 122 of the third weight 16*c*. Thus, when the adjustable dumbbell is lifted out of the support base 12, one of the peripheral flanges 96*c*, 96*d*, and 96*e* of the third selection collar 24*c* engages the tab 122 of the third weight 16*c* and lifts the third weight out of the support base. If the third weight is not selected, however, none of the peripheral flanges 96*c*, 96*d*, and 96*e* of the third selection collar 24*c* is under the tab 122 of the third weight 16*c* and the outer end portion 46 of the handle 18 passes out of the channel 112 without lifting the third weight out of the support base 12. As the adjustable dumbbell 10 is lifted out of the support base, the third weight 16*c* remains in the support base, supported by the positioning walls 30 of the support base.

Figure 15:
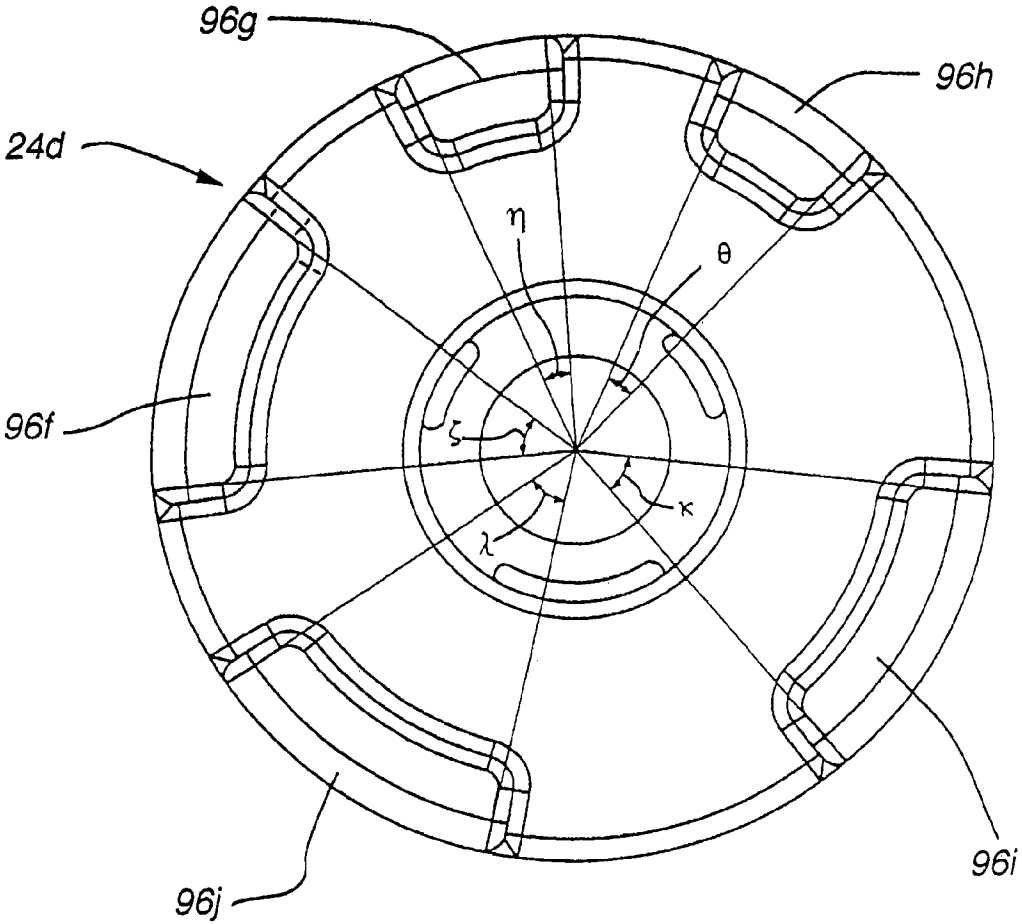
FIG. 15 is a front view of a fourth implementation of a collar, in accordance with one embodiment of the present invention.

FIG. 15 shows a front view of a fourth selection collar 24*d* located on the end portion 46 of the handle 18 immediately distal of the third selection collar 24*c*. As shown in FIG. 15, the fourth selection collar includes five flanges 96*f*, 96*g*, 96*h*, 96*i*, and 96*j* extending around a portion of the periphery of the fourth selection collar 24*d*. In the particular embodiment described above wherein the collars 24 have an outer diameter of 84 mm and a radius from the center to the peripheral flange 96 of 32.5 mm, for example, the flanges 96*f*, 96*g*, 96*h*, 96*i*, and 96*j* may extend around a periphery of the fourth selection collar 24*d* for angles $\zeta$, $\eta$, $\theta$, $\kappa$, and $\lambda$ of approximately 48, 24, 24, 48, and 48 degrees, respectively. The extension sleeve 100 of the fourth selection collar 24*d* is seated within the channel 112 of the fourth weight 16*d* of the adjustable dumbbell 10 and is interlocked with the third selection collar 24*c*. As the outer selector knob 14 is rotated, the five peripheral flanges 96*f*, 96*g*, 96*h*, 96*i*, and 96*j* rotate around the end portion 46 of the handle 18 If the fourth weight 16*d* is selected by the user, one of the peripheral flanges 96*f*, 96*g*, 96*h*, 96*i*, and 96*j* is positioned under the tab 122 of the fourth weight 16*d*. Thus, when the adjustable dumbbell 10 is lifted out of the support base 12, one of the peripheral flanges 96*f*, 96*g*, 96*h*, 96*i*, and 96*j* of the fourth selection collar 24*d* engages the tab 122 of the fourth weight 16*d* and lifts the fourth weight out of the support base. If the fourth weight is not selected, however, none of the peripheral flanges 96*f*, 96*g*, 96*h*, 96*i*, and 96*j* of the fourth selection collar is under the tab 122 of the fourth weight and the outer end portion 46 of the handle passes out of the channel 112 without lifting the fourth weight out of the support base 12. As the adjustable dumbbell is lifted out of the support base, the fourth weight 16*d* remains in the support base, supported by the positioning walls 30 of the support base.

Figure 16:
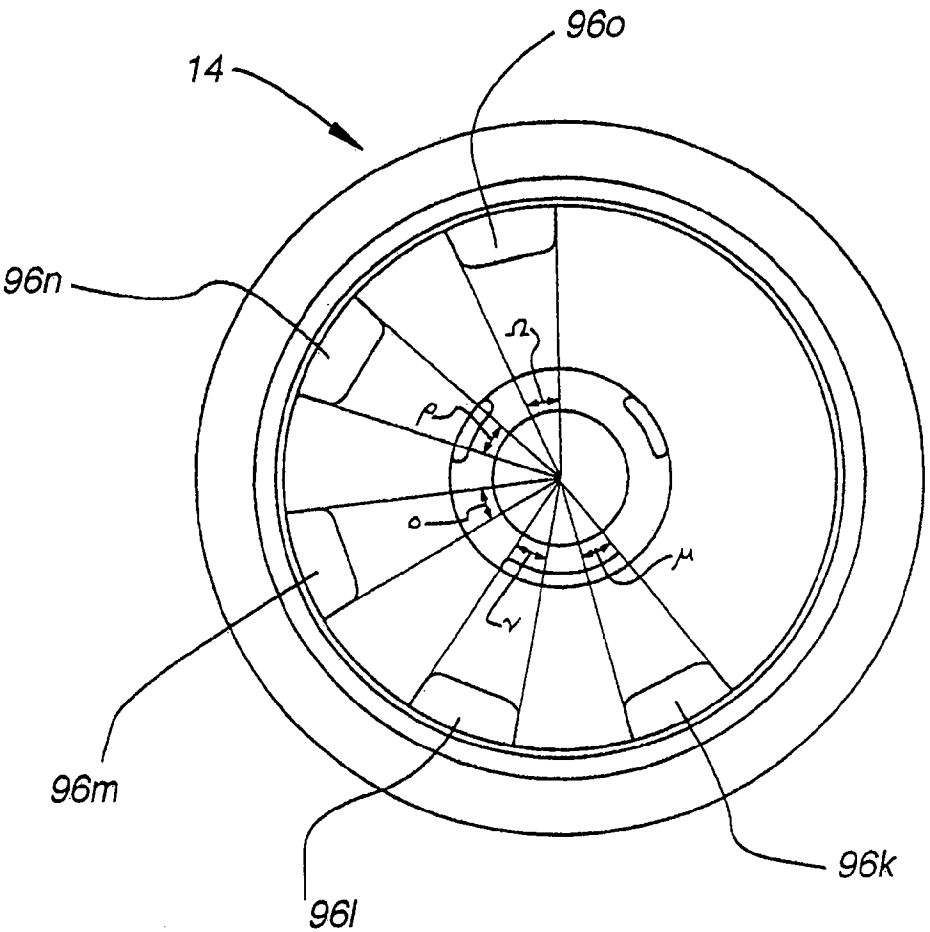
FIG. 16 is a front view of one implementation of a selector knob, in accordance with one embodiment of the present invention.

FIG. 16 shows a front view of the outer selector knob 14 located at the distal end of the end portion 46 of the handle 18 immediately distal of the fourth selection collar 24*d*. As shown in FIG. 16, the outer selector knob includes five flanges 96*k*, 96*l*, 96*m*, 96*n*, and 96*o* extending around a portion of the periphery of the outer selector knob. In the particular embodiment described above wherein the collars 24 have an outer diameter of 84 mm and a radius from the center to the peripheral flange 96 of 32.5 mm, for example, the flanges 96*k*, 96*l*, 96*m*, 96*n*, and 96*o* may extend around a periphery of the outer selector knob 14 for angles μ, νo, ρ, and Ω of approximately 24, 24, 24, 24, and 24 degrees, respectively. The extension sleeve 100 of the outer selector knob is seated within the channel 112 of the fifth weight 16*e* of the adjustable dumbbell 10 and is interlocked with the fourth selection collar 24*d*. As the outer selector knob 14 is rotated, the five peripheral flanges 96*k*, 96*l*, 96*m*, 96*n*, and 96*o* rotate around the end portion 46 of the handle 18. If the fifth weight 16*e* is selected by the user, one of the peripheral flanges 96*k*, 96*l*, 96*m*, 96*n*, and 96*o* is positioned under the tab 122 of the fifth weight. Thus, when the adjustable dumbbell is lifted out of the support base 12, one of the peripheral flanges 96*k*, 96*l*, 96*m*, 96*n*, and 96*o* of the outer selector knob engages the tab 122 of the fifth weight and lifts the fifth weight out of the support base. If the fifth weight 16*e* is not selected, however, none of the peripheral flanges 96*k*, 96*l*, 96*m*, 96*n*, and 96*o* of the outer selector knob is under the tab 122 of the fifth weight 16*e* and the outer end portion 46 of the handle 18 passes out of the channel 112 without lifting the fifth weight out of the support base 12. As the adjustable dumbbell 10 is lifted out of the support base, the fifth weight remains in the support base, supported by the positioning walls 30 of the support base.

If the selection collars 24 shown in FIGS. 12-16 are used on each side of the dumbbell 10, the outer selector knob 14 has to be turned in the same direction, e.g., clockwise, to select the same weight setting on both sides. This requires turning one outer selector knob toward the user and the other outer selector knob away from the user. If desired, however, one skilled in the art would readily appreciate that mirror image collars could be used on opposite ends of the adjustable dumbbell so that the outer selector knobs are both turned toward the user or are both turned away from the user in order to select the same weight setting on both ends.

Figure 17:
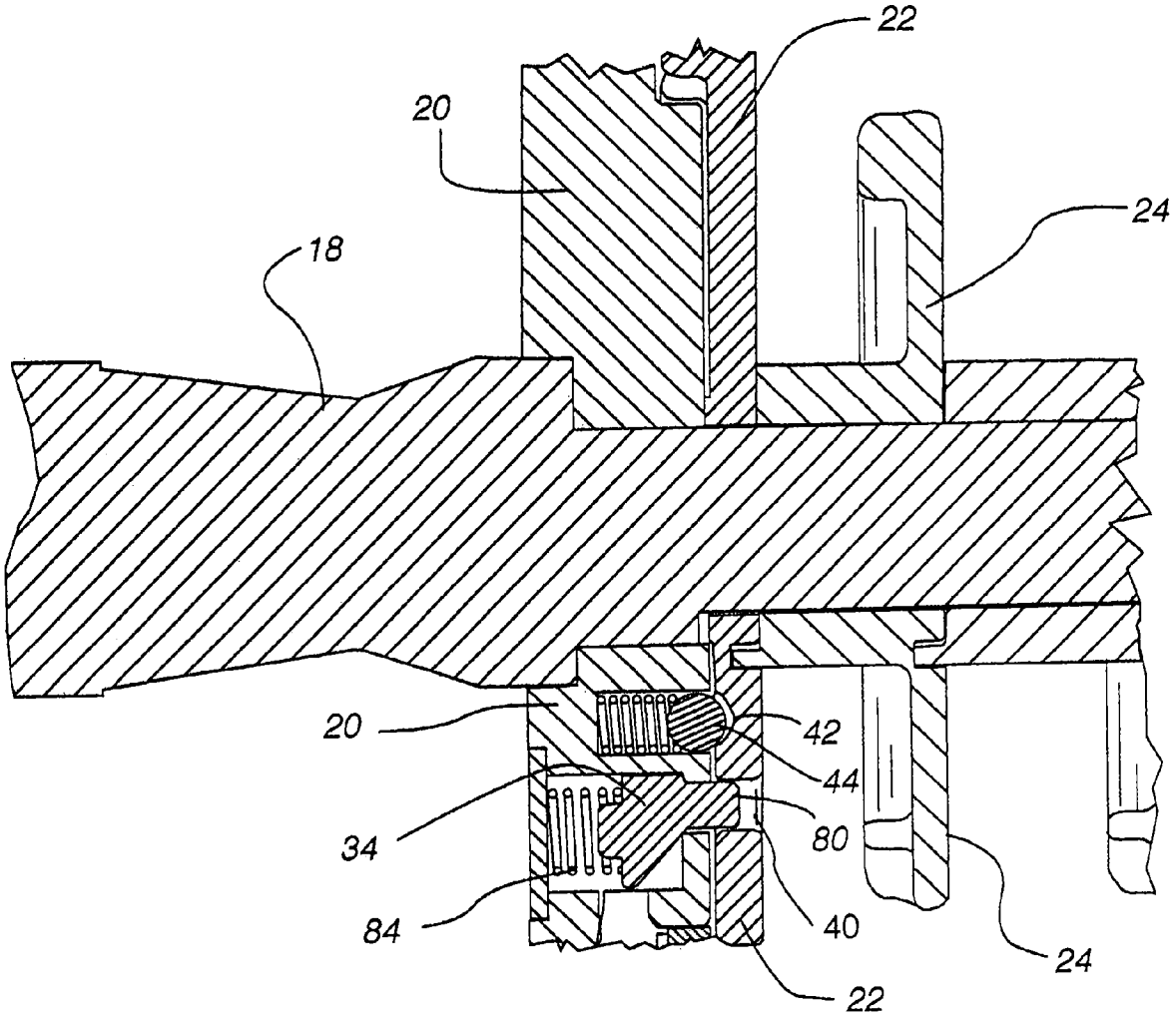
FIG. 17 is a partial front section view of the handle, the inner support and the inner disc with the locking mechanism in the engaged position.

As described above, the adjustable dumbbell 10 includes the spring-loaded pin 34 locking mechanism to secure the weights 16 in place when the pin is engaged with the inner disc 22, and to allow the weight of the dumbbell to be adjusted when the pin is disengaged from the inner disc. FIG. 17 shows a partial cross-section view of the adjustable dumbbell with the spring-loaded pin locking mechanism engaged in one of the apertures 40 of the inner disc and wherein the spring-loaded ball 44 is seated within one of the detent recesses 42 of the inner disc. When the spring-loaded pin is engaged as shown in FIG. 17, the spring-loaded pin locks the inner disc by engaging one of the plurality of apertures of the inner disc and prevents the inner disc from rotating. Since the inner disc 22 is interlocked with the collars 24 and the outer selector knob 14, the spring-loaded pin 34 secures each weight 16 by preventing the peripheral flanges 96 of the collars 24 from rotating with respect to the tabs 122 of the weights. In some implementations, the spring-loaded pin in combination with the stabilizing bar 118 (see FIG. 7) ensures that the weights are secured to the adjustable dumbbell 10 and stabilized during use and selection. The receiving hole 40 is positioned on the inner disc 22 so that the pin is oriented with the particular hole only when the collars 24 are fully engaged with the desired weight plates 16. The pin will only lock with the inner plate when the collars and weight plates are properly oriented.

Figure 18:
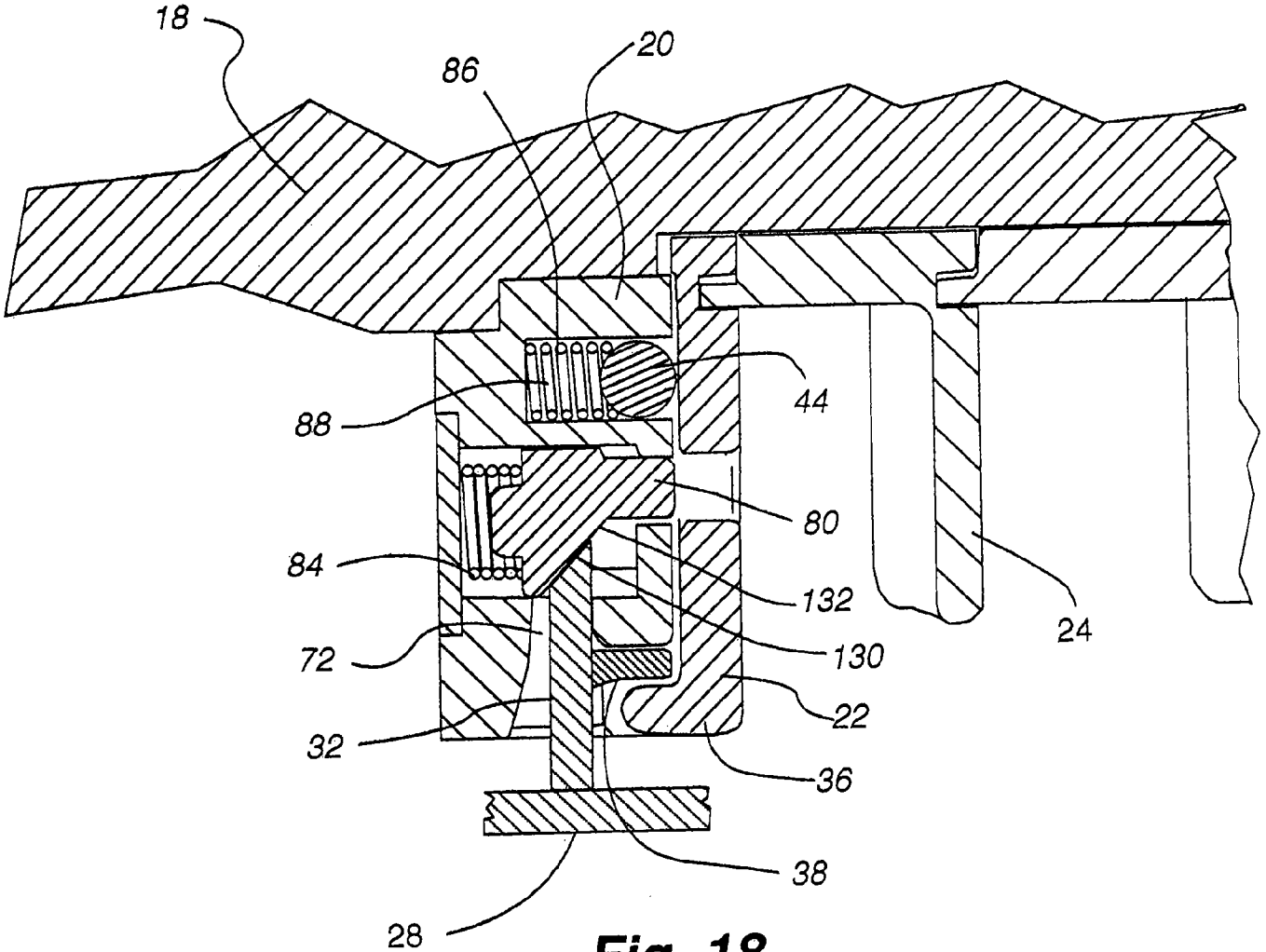
FIG. 18 is a partial front section view illustrating the locking mechanism in the unengaged position.

FIG. 18 shows a cross-sectional view of the adjustable dumbbell 10 with the spring-loaded pin 34 locking mechanism disengaged from the inner disc 22 and wherein the outer selector knob 14 is between settings, i.e., the spring-loaded ball 44 is not seated in a detent recess 42 of the inner disc. Since the spring-loaded pin is disengaged from the inner disc, the inner disc is free to rotate with respect to the inner support 20 and, thus, the outer selector knob may be rotated to adjust the weight of the dumbbell. As shown in FIGS. 2 and 18, the plunger 32 extends upwardly from the bottom wall to engage the bottom of the pin structure. The plunger includes an upper sloped cam surface 130 and the protrusion 38 that extends from the plunger 32 outwardly towards the end of the support base 12. The plunger is positioned on the support base such that the protrusion extends into the cavity 72 of the inner support 20 when the adjustable dumbbell 10 is placed onto the support base. As shown in FIG. 18, the upper sloped cam surface of the plunger contacts the downwardly angled surface 132 of the spring-loaded pin 34 inside the cavity of the inner support. As the adjustable dumbbell is lowered onto the support base, the upper sloped cam surface 130 of the plunger 32 engages the downwardly angled surface of the spring-loaded pin and retracts the spring-loaded pin from its engaged position in an aperture 40 of the inner disc 22 and pulls the pin 80 out of the aperture of the inner disc. When the spring-loaded pin is retracted from the aperture of the inner disc, the inner disc is unlocked and can rotate with respect to the inner support 20, thus allowing the weight selection to be made.

Thus, as the adjustable dumbbell 10 is lowered onto the support base 12, the plunger 32 extends into the cavity 72 of the inner support 20. The upper sloped cam surface 130 of the plunger engages the downwardly angled surface 132 of the spring-loaded pin 34 and retracts the spring-loaded pin from the aperture 40 of the inner disc 22 allowing the inner disc to rotate with respect to the inner support. In this position, the weight of the dumbbell can be adjusted by rotating the outer selector knob 14. When the dumbbell is removed from the support base, however, the upper sloped cam surface of the plunger is disengaged from the downwardly angled surface of the spring-loaded pin of the inner support. The spring 84 pushes the pin 80 outwardly to its extended, biased position where it engages one of the plurality of apertures of the inner disc preventing the inner disc from rotating with respect to the inner support 20 (assuming the hole 40 is properly aligned with the pin 34). Thus, when the dumbbell 10 is removed from the support base 12, the spring-loaded pin engages one of the apertures 40 of the inner disc 22 and prevents the inner disc, the collars 24, and the outer selector knob 14 from rotating with respect to the inner support 20 and the handle 18.

The respective angles of the upper sloped cam surface 130 of the plunger 32 and the downwardly angled surface 132 of the spring-loaded pin 34 determine how far the spring-loaded pin is retracted from its outward, biased position. In one embodiment, for example, the upper sloped cam surface of the plunger and the downwardly angled surface of the spring-loaded pin is sloped at an angle of about 40 degrees. Further, the length of the protrusion 38 of the plunger extends from the body of the plunger is about 5 mm. The protrusion may be slightly curved to match the curvature of the teeth 36 that extend from the perimeter of the inner disc 22. FIGS. 20A-20E show one implementation of a pin of FIG. 18. FIGS. 21A-21E show one implementation of a plunger.

The spring-loaded ball 44 engages a detent recess 42 to indicate when the inner disc 22 has been turned to a position such that one or more weights are fully engaged, i.e., one or more of the peripheral flanges 96 of the collars 24 are fully engaged with the tabs 122 of the weights 16. Note, in some implementations, the adjustable dumbbell 10 may be arranged such that no weights are engaged. Also, in some implementations, the spring-loaded ball and detent recess make an audible and/or other sensory feedback to the user when the weights have been properly secured by the peripheral flanges of the collars. This feature may be helpful for a user to determine the proper position of the weight selector knob 14.

As described above with reference to FIG. 5, the detent recesses 42 of the inner disc 22 are angularly offset from the teeth 36 of the inner disc. Thus, when the spring-loaded ball 44 is seated within one of the detent recesses as shown in FIG. 17, none of the teeth of the inner disc extend into the cavity 72 of the inner support 20. In this orientation, the plunger 32 of the support base 12 is free to move into or out of the cavity 72 of the inner support 20 and thus the teeth 36 do not engage the protrusion 38, which would keep the dumbbell 10 from disengaging from the base. Since the detent recesses 42 are aligned with the apertures 40 of the inner disc 22, the spring-loaded pin 34 is also aligned to engage one of the apertures of the inner disc when the spring-loaded ball 44 is seated within one of the detent recesses. Thus, as the plunger exits the cavity of the inner support, i.e., the dumbbell is removed from the support base, the spring-loaded pin is aligned with one of the apertures of the inner disc and the bias of the spring pushes the pin into the aperture of the inner disc.

As shown in FIG. 18, however, if the spring-loaded ball 44 is not seated within one of the detent recesses 42, i.e., the collars 24 of the adjustable dumbbell are between settings and the peripheral flanges 96 of the collars are not fully engaged with the tabs 122 of the selected weights 16, one of the offset teeth 36 of the inner disc 22 protrudes into the cavity 72 of the inner support 20. In this case, the plunger 32 cannot be removed from the cavity of the inner support, i.e., the dumbbell 10 cannot be removed from the support base 12, because the tooth locks the protrusion 38 of the plunger within the cavity. Thus, the dumbbell can only be removed from the support base if the spring-loaded ball detent 44 is seated within one of the detent recesses 42 and the flanges 96 of the collars 24 are fully engaged with the tabs 122 of the weights 16. Or, the full engagement of the flanges of the collars and the weight plates can be indicated in other ways than the spring detents, such as by a precise marking of the selection knob 14 orientation or other means. A position strip for use in indicating the selected orientation of the selector knob is described in greater detail below.

In the embodiment shown in FIG. 1, the adjustable dumbbell 10 allows for adjustments in weight from 5 pounds to 52.5 pounds. In this embodiment, the combined weight of the adjustable dumbbell 10 without any weights 16 attached is 5 pounds; the first weight 16*a* positioned between the inner disc 22 and the second selection collar 24*a* (first) or 24*b* (second) is a 7.5 pound weight; the second weight 16*b* positioned between the first and second selection collars 24*a* and 24*b*, respectively, is also 7.5 pounds; the third weight 16*c* positioned between the second and third selection collars 24*b* and 24*c*, respectively, is 5 pounds; the fourth weight 16*d* positioned between the third and fourth selection collars 24*c* and 24*d*, respectively, is 2.5 pounds; and the fifth and outer weight 16*e* positioned between the fourth selection collar 24*d* and the outer selector knob 14, respectively, is 1.25 pounds. This arrangement allows for fifteen incremental weights of 5, 7.5, 10, 12.5, 15, 17.5, 20, 22.5, 25, 30, 35, 40, 45, 50, and 52.5 pounds that may be selected for the adjustable dumbbell 10. The weights 16 are preferably arranged such that the weights range from the heaviest weights closest to the central grip portion 26 of the handle 18 and the lightest weights furthest from the central grip portion of the handle. The weights could also be arranged in any other order as desired, with the appropriate positioning of the collars 24 to provide for the proper weight selection.

Figure 26:
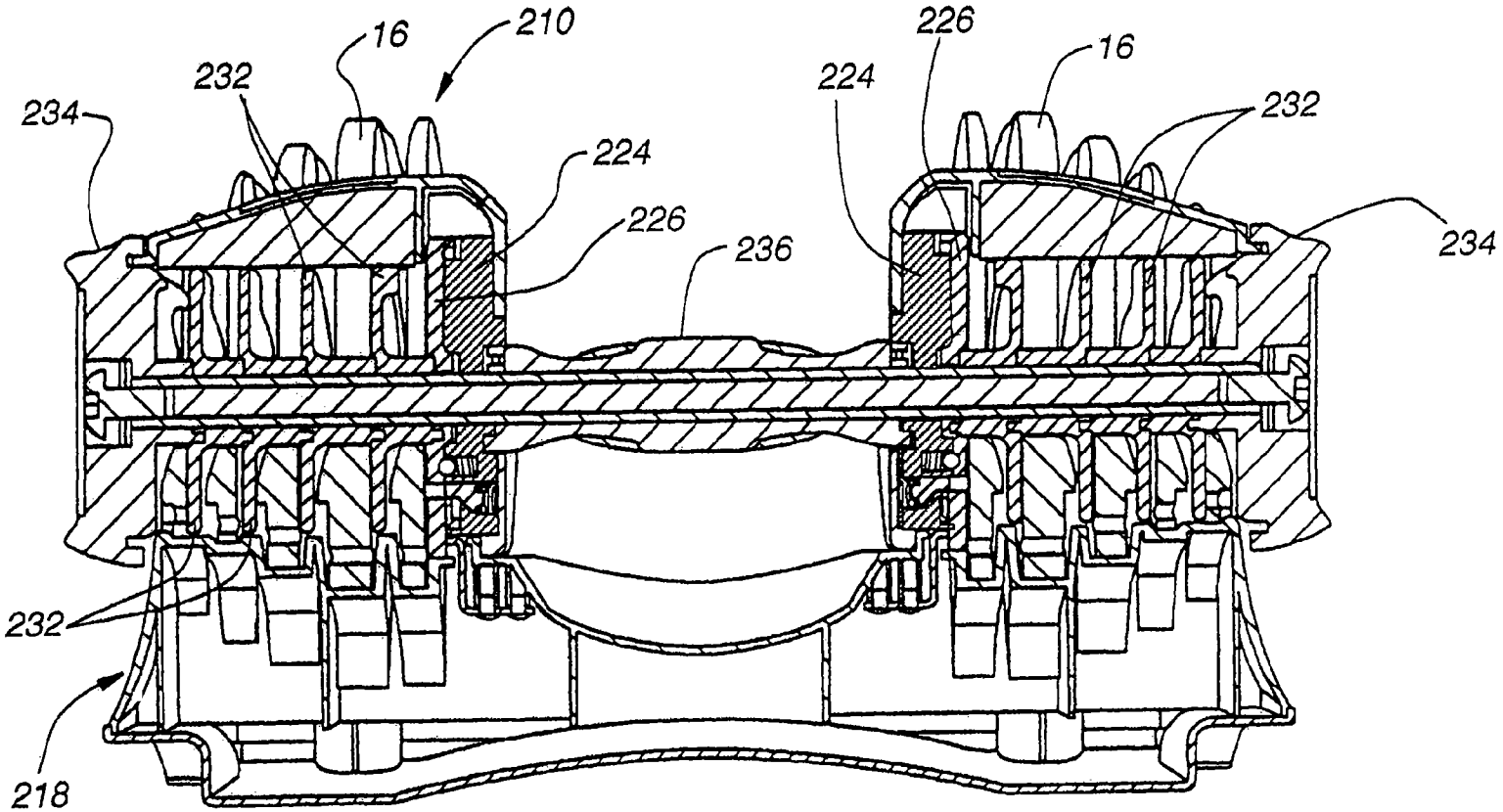
FIG. 26 is a section view of one implementation of an adjustable dumbbell in engagement with one implementation of a support base.
Figure 27:
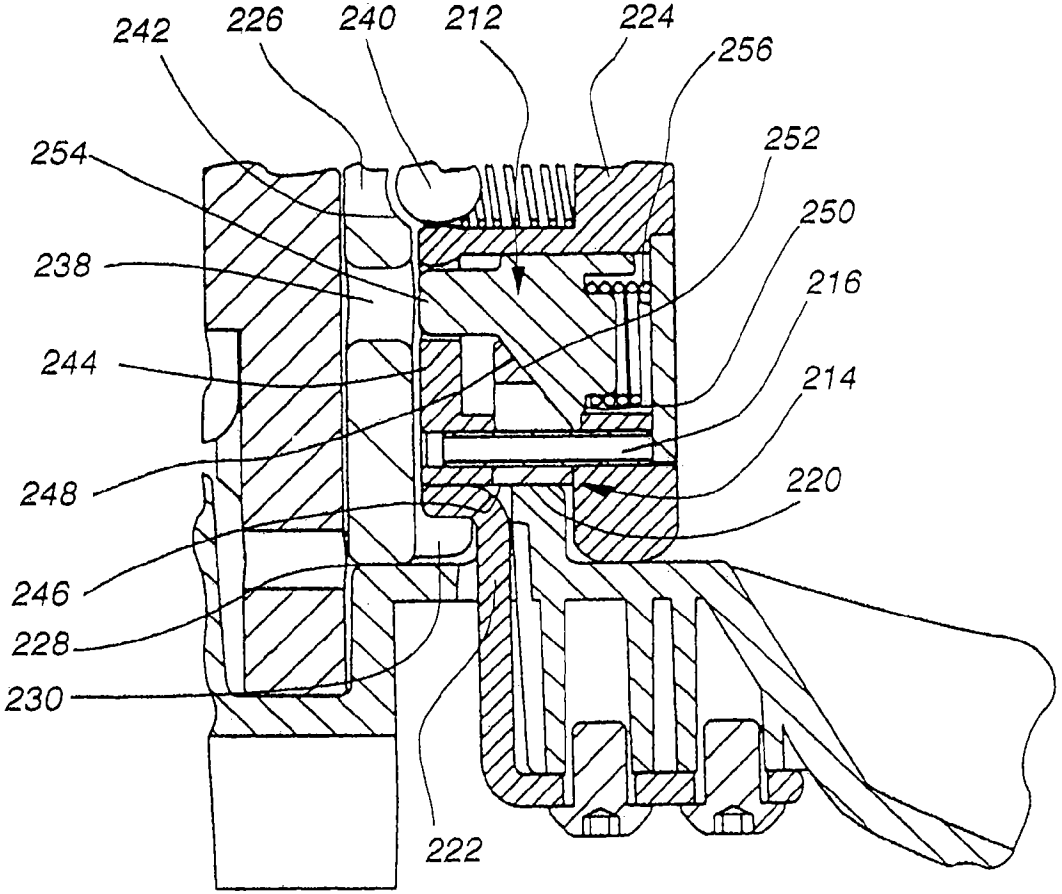
FIG. 27 is a partial section view primarily showing one implementation of an inner support and an inner disc, with the locking pin not engaged with the inner disc.
Figure 28:
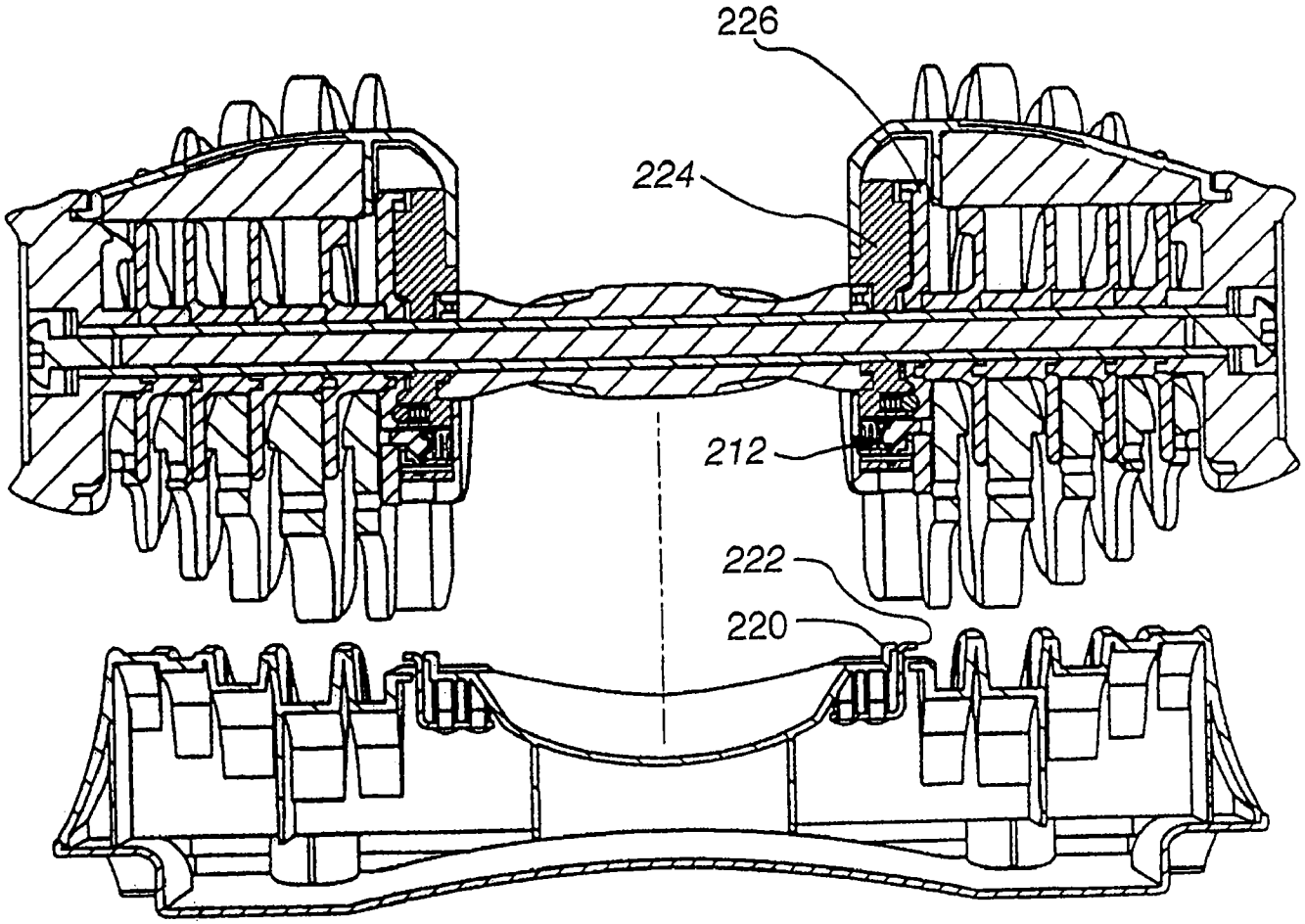
FIG. 28 is a section view of one implementation of an adjustable dumbbell removed from one implementation of a support base.
Figure 29:
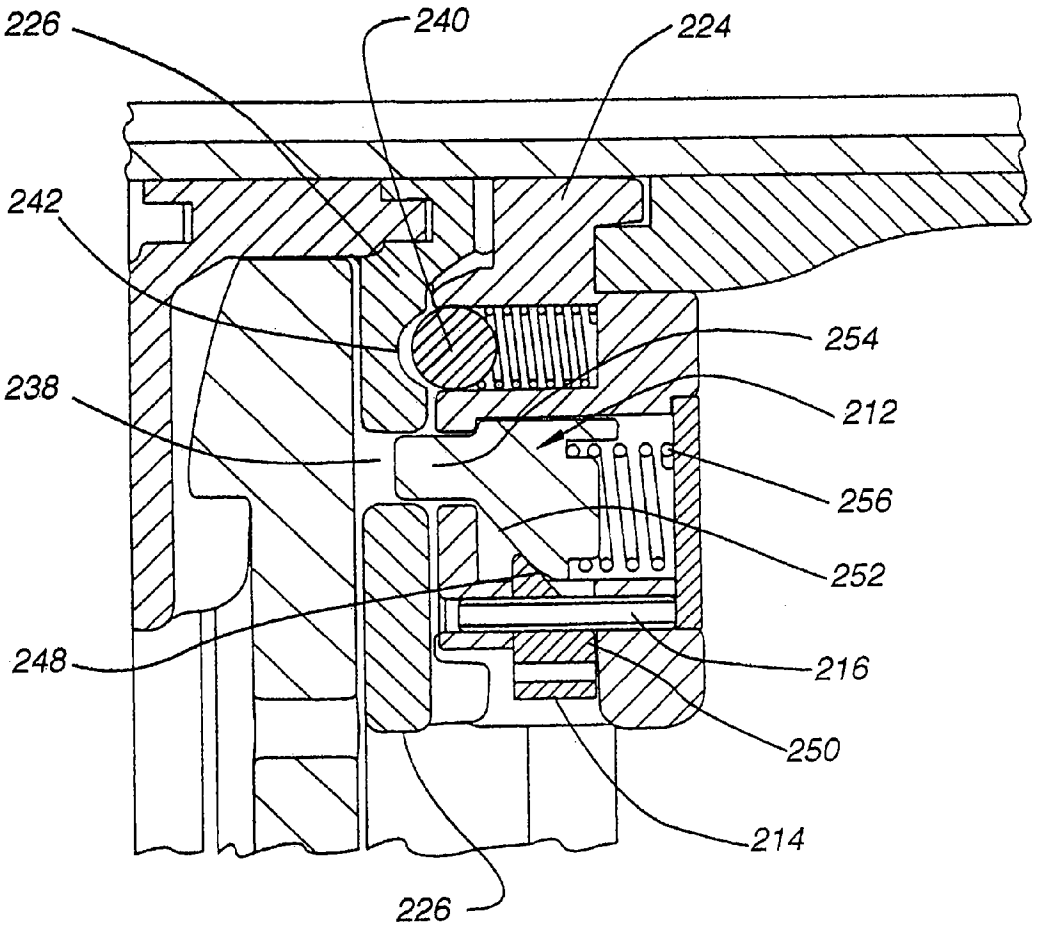
FIG. 29 is a partial section view primarily showing one implementation of the inner support and the inner disc with the locking pin in partial engagement with the inner disc.
Figure 30:
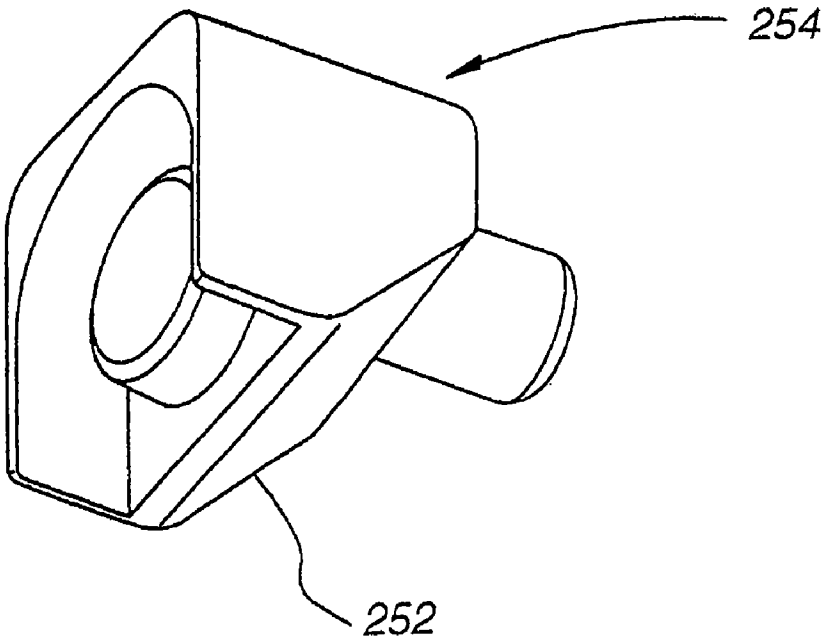
FIG. 30 is an isometric view of a locking pin, in accordance with one embodiment of the present invention.
Figure 31A:
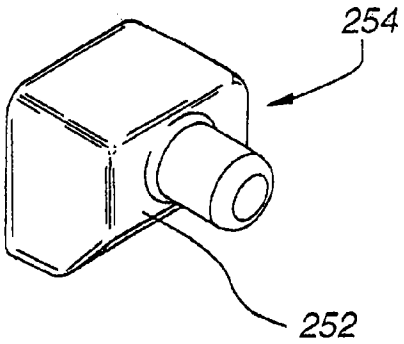
FIG. 31*a* is a second isometric view of the locking pin of FIG. 30.
Figure 31B:
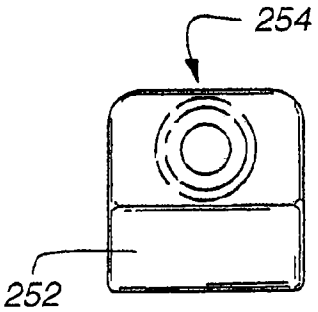
FIG. 31*b* is a front view of the locking pin of FIG. 31*a;*
Figure 31E:
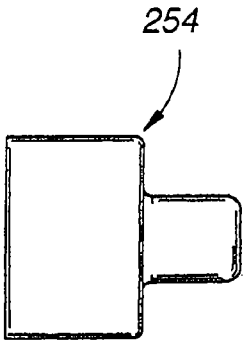
FIG. 31*e* is a top view of the locking pin of FIG. 31*a;*
Figure 31C:
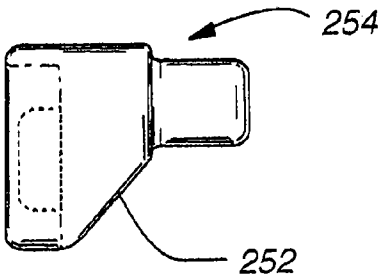
FIG. 31*c* is a side view of the locking pin of FIG. 31*a;*
Figure 31D:
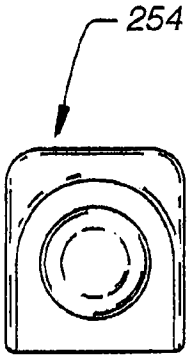
FIG. 31*d* is a rear view of the locking pin of FIG. 31*a;*
Figure 32:
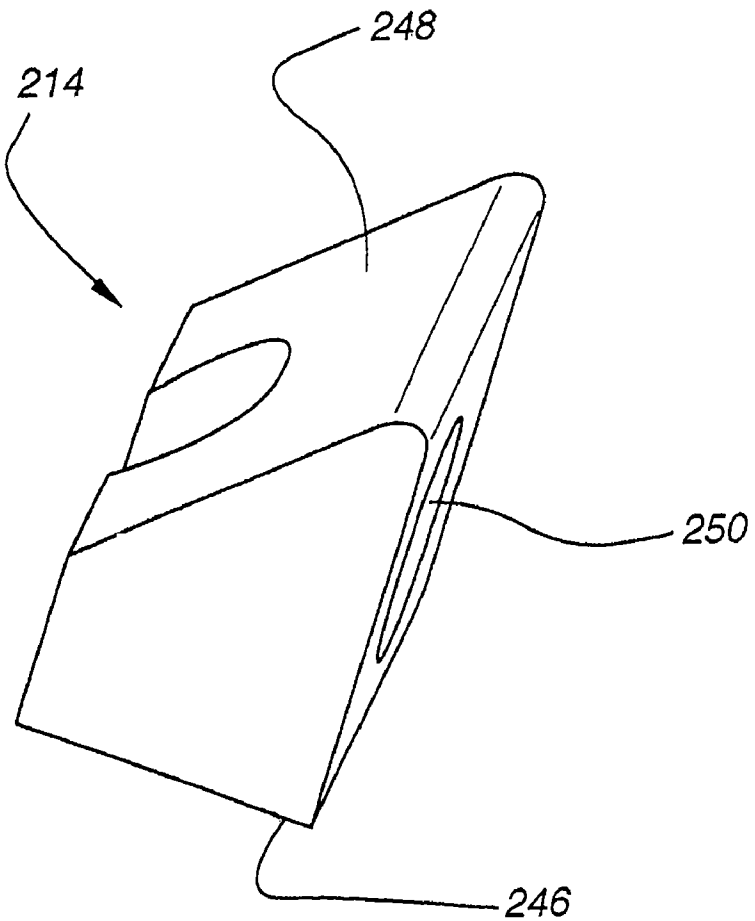
FIG. 32 is an isometric view of a plunger, in accordance with one embodiment of the present invention.
Figure 33A:
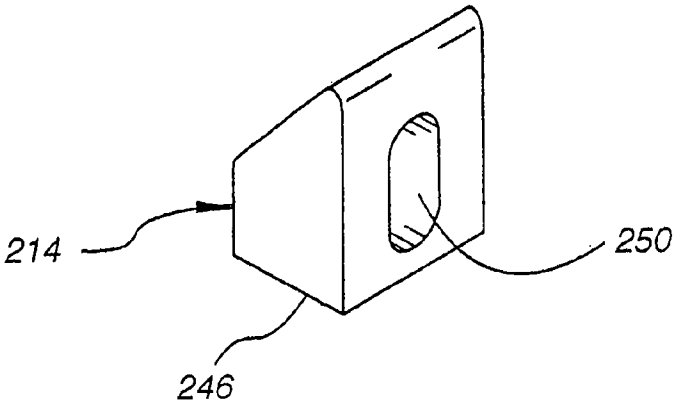
FIG. 33*a* is a second isometric view of the plunger illustrated in FIG. 32.
Figure 33B:
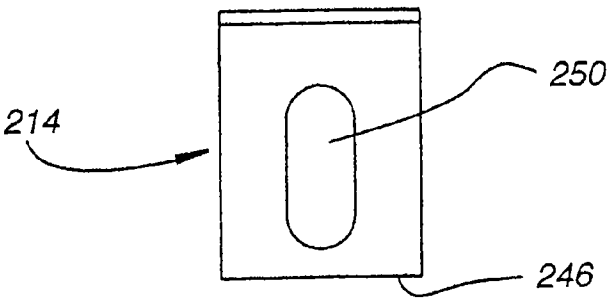
FIG. 33*b* is a front view of the plunger of FIG. 33*a;*
Figure 33D:
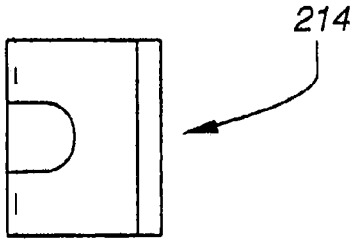
FIG. 33*d* is a top view of the plunger of FIG. 33*a;*
Figure 33C:
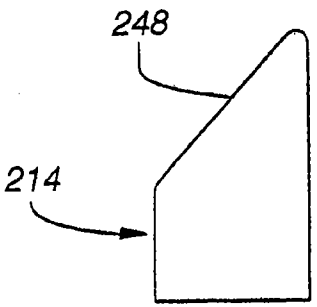
FIG. 33*c* is a side view of the plunger of FIG. 33*a;*

An alternative embodiment of an adjustable dumbbell 10 employing an alternative spring-loaded pin 34 locking mechanism is shown in FIGS. 25 through 33D. Referring first to FIGS. 27 and 29, in this embodiment, the dumbbell 210 includes a spring-loaded pin 212 locking mechanism, a plunger 214, and a retaining bar 216. Referring next to FIG. 25, the support base 218 includes an engagement surface 220 and a protrusion 222. The shoulder engagement surface engages the plunger housed in the inner support 224 of the dumbbell to disengage the spring-loaded pin locking mechanism from the inner disc 226 when the dumbbell is located on the support base. The shoulder engagement surface also protects the protrusion from being inadvertently broken off or otherwise damaged. The protrusion 222, similar to the protrusion 38 described above, extends into the peripheral channel 228 of the inner support for selective engagement with the teeth 230 of the inner disc 226 when the weights 16 are not fully engaged or disengaged by the collars 232.

Similarly to the protrusion and locking mechanism described above, when engaged, the spring-loaded pin 212 locking mechanism prevents the inner disc 226, the collars 232, and the outer selector knob 234 from rotating with respect to the handle 236.

When the dumbbell 210 is placed in the support base 218, the engagement surface 220 contacts the plunger 214 and retracts the spring-loaded pin locking mechanism so that the outer selector knob can be turned to adjust the weight of the adjustable dumbbell. Thus, the weight of the adjustable dumbbell can be adjusted by turning the pair of outer selector knobs to selectively engage or disengage the plurality of weights 16 with the plurality of collars when the dumbbell is seated in the support base.

FIGS. 28 and 29 show cross-sectional views of the adjustable dumbbell 210 with the spring-loaded pin 212 locking mechanism engaged in one of the apertures 238 of the inner disc 226 and wherein the spring-loaded ball 240 is seated within one of the detent recesses 242 of the inner disc. When the spring-loaded pin is engaged as shown in FIGS. 28 and 29, the spring-loaded pin locks the inner disc by engaging one of the plurality of apertures of the inner disc and prevents the inner disc from rotating. Since the inner disc 226 is interlocked with the collars 232 and the outer selector knob 234, the spring-loaded pin secures each weight by preventing the peripheral flanges of the collars from rotating with respect to the tabs 122 of the weights 16. In combination with the stabilizing bar 118, the spring-loaded pin 212 ensures that the weights are secured to the adjustable dumbbell until the dumbbell is replaced into the support base 218.

FIGS. 26 through 27 show cross-sectional views of the adjustable dumbbell 210 with the spring-loaded pin 212 locking mechanism disengaged from the inner disc 226. Since the spring-loaded pin 212 is disengaged from the inner disc 226, the inner disc is free to rotate with respect to the inner support 224 and, thus, the outer selector knob 234 may be rotated to adjust the weight of the dumbbell 210. As shown in FIGS. 25 and 27, the shoulder engagement surface 220 extends upwardly from the support base 218. The engagement surface extends into the cavity 244 of the inner support to engage the plunger 214 of the inner support. The plunger (or slider) (see, e.g., FIG. 32 and FIGS. 33A-33D) includes a lower engagement surface 246, an upper sloped cam surface 248, and a slot 250. Retaining bar 216 extends through the slot of the plunger and retains the plunger within the cavity of the inner support yet allows the plunger to slide along at least one axis, e.g., vertically, within the cavity of the inner support. As the adjustable dumbbell 210 is lowered onto the support base 218, the engagement surface 220 of the support base contacts the lower engagement surface 246 of the plunger 214 and urges the plunger vertically along the path defined by the slot 250 of the plunger. As the plunger is urged further into the cavity 244 of the inner support 224, the upper sloped cam surface 248 of the plunger is brought into contact with the downwardly angled surface 252 of the spring-loaded pin 212. The upper sloped cam surface of the plunger engages the downwardly angled surface of the spring-loaded pin and retracts the spring-loaded pin from its engaged position in an aperture 238 of the inner disc 226 and pulls the pin 254 out of the aperture of the inner disc (see, e.g., FIG. 27). When the spring-loaded pin 212 is retracted from the aperture of the inner disc, the inner disc is unlocked and can rotate with respect to the inner support.

The adjustable dumbbell may also be configured such that the support base is not required to release the weight plates. In such a configuration, the plunger may be arranged to extend beyond the bottom plane of the adjustable dumbbell so that the plunger will engage a surface, such as a floor or table, if the adjustable dumbbell is set thereon. Upon engagement with the floor or other surface, the plunger is moved into engagement with the locking device to disengage the support plate from the inner disc and thus allow the selector knob and collars to turn freely.

Thus, as the adjustable dumbbell 210 is lowered onto the support base 218, the engagement surface 220 of the support base contacts the lower engagement surface 246 of the plunger 214 and urges the plunger further within the cavity 244 of the inner support 224. As the upper sloped cam surface 248 of the plunger engages the downwardly angled surface 252 of the spring-loaded pin 212, the spring-loaded pin retracts from the aperture 238 of the inner disc 226 allowing the inner disc to rotate with respect to the inner support 224. In this position, the weight of the dumbbell 210 can be adjusted by rotating the outer selector knob 234.

When the desired weight has been selected, and the dumbbell is removed from the support base 218, the bias imparted by the spring 256 of the spring-loaded pin 212 urges the spring-loaded pin outwardly towards the inner disc 226. The downwardly angled surface 252 of the spring-loaded pin engages the upper sloped cam surface 248 of the plunger 214 and urges the plunger away from the spring-loaded pin and the upper sloped cam surface of the plunger is disengaged from the downwardly angled surface of the spring-loaded pin. Gravity can also assist in moving the plunger downwardly. The spring 256 pushes the pin 254 outwardly to its extended, biased position where it engages one of the plurality of apertures 238 of the inner disc 226 and prevents the inner disc from rotating with respect to the inner support 224. Thus, when the dumbbell 210 is removed from the support base 218, the spring-loaded pin 212 engages one of the apertures of the inner disc and prevents the inner disc, the collars 232, and the outer selector knob 234 from rotating with respect to the inner support and the handle 236.

As described above, the respective angles of the upper sloped cam surface 248 of the plunger 214 and the downwardly angled surface 252 of the spring-loaded pin 212 determine how far the spring-loaded pin is retracted from its outward, biased position. In one embodiment, for example, the upper sloped cam surface of the plunger and the downwardly angled surface of the spring-loaded pin are sloped at an angle of about 40 degrees from vertical. The protrusion 222 may also be slightly curved to match the curvature of the teeth 230 that extend from the perimeter of the inner disc 226 as described above.

Further, the adjustable dumbbell 210 cannot be removed from the support base 218 unless the weights 16 are fully engaged or disengaged by the collars 232. As also described above, the inner support 224 of the dumbbell includes a plurality of teeth 230 that engage the protrusion 222 when the weights are not fully engaged or disengaged by the collars. When the weights are not fully engaged by the collars, the teeth engage the protrusion and prevent the protrusion from exiting the cavity 244 of the inner support, thus preventing the dumbbell from being removed from the support base. When the collars 232 are properly aligned for the desired weight and the dumbbell 210 is removed from the support base 218, the spring-loaded pin 212 locking mechanism re-engages the inner disc 226 and prevents the inner disc, the collars 232, and the outer selector knob 234 from rotating with respect to the handle 236 and the inner support 224. Thus, the weights 16 are locked into place and the outer selector knob cannot be turned to select a different combination of weights.

Figure 22:
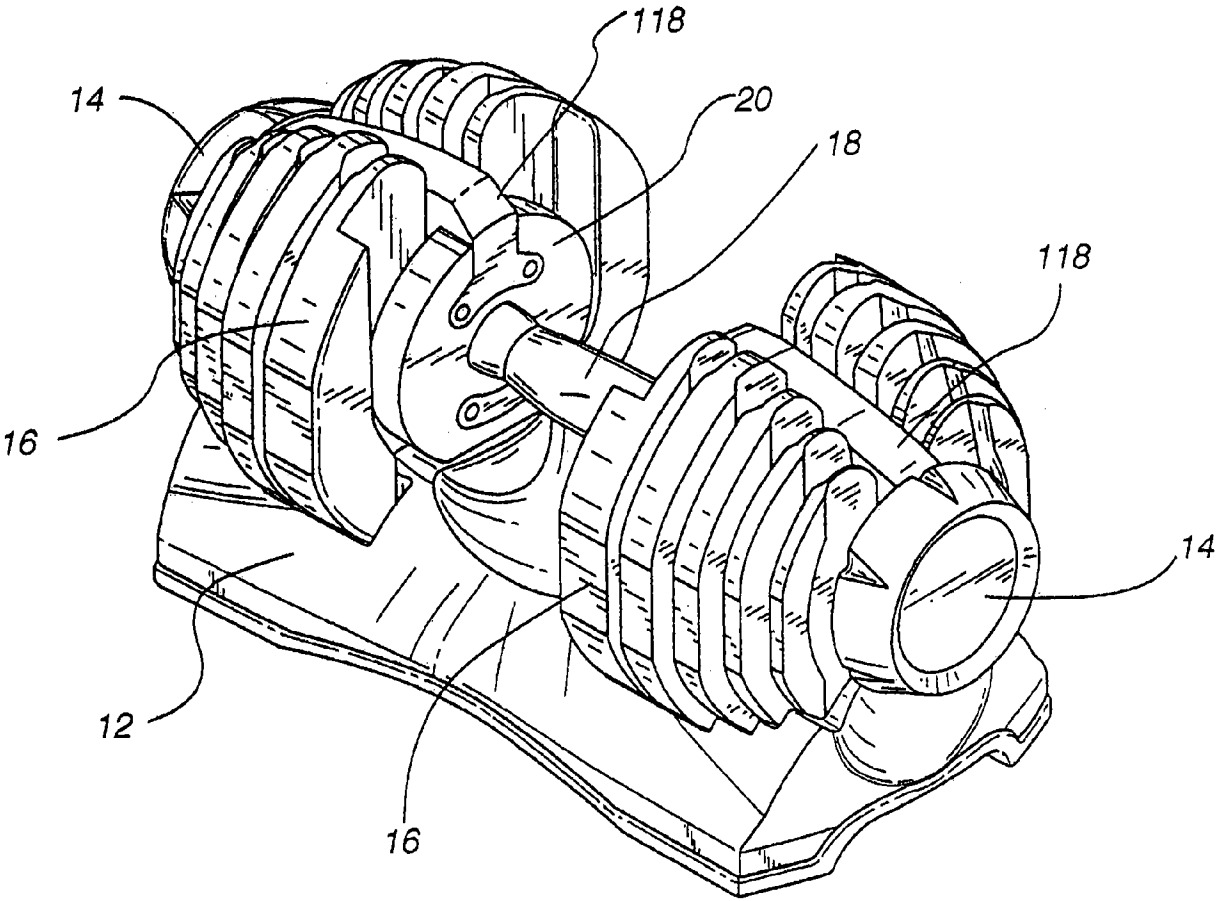
FIG. 22 is an isometric view of one implementation of an adjustable dumbbell in engagement with one implementation of a support base.

In this embodiment, the outer selector knob includes circular-shaped indentations around its perimeter to allow a user to securely grip and turn the outer selector knob while adjusting the weight of the dumbbell. Alternatively, the outer selector knob may include other shaped indentations or protrusions to provide a secure gripping surface for the user. As shown in FIG. 22, for example, the outer selector knob may include V-shaped indentations to provide the gripping surface. Further, the central grip portion of the handle includes an overlay to allow a user to more securely grip the dumbbell during use. In one embodiment, for example, the overlay may include a soft, compliant rubber or rubber-like non-slip material. Further, the overlay may include a textured grip surface to allow a user to securely grip the dumbbell. As shown in FIG. 1, for example, the grip overlay may include elongated oval shaped protrusions that extend beyond the outer surface of the overlay to aid a user in gripping the dumbbell. Alternatively, however, the overlay may include depressions or holes that provide a gripping surface.

The base 310 is made of a moldable plastic material sufficiently strong to support the dumbbell 10 when positioned therein. Since the dumbbell is handled while in the base, for instance to change the weight selection, it is helpful for the base to be stable on the support surface on which it sits. In addition, as the dumbbell is being removed from the base, or set back into the base, it is helpful for the base to not move easily during these steps. Since the dumbbell is set into the base with the weight plates 16 being received in their own respective sections, if the base moves easily on the support surface, the removal and return of the dumbbell from and to the base is more difficult.

Figure 34:
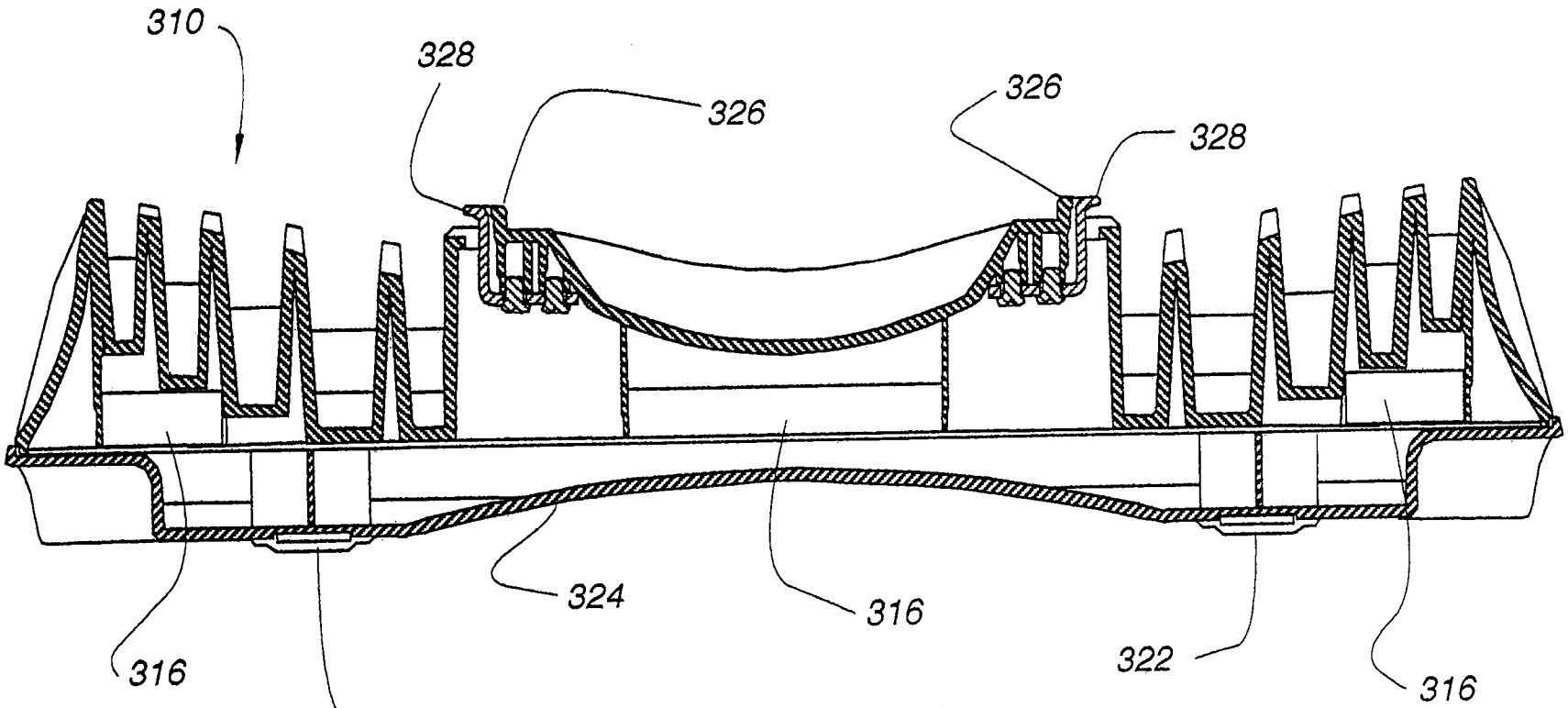
FIG. 34 is a section view of an alternative implementation of a base support, in accordance with one embodiment of the present invention.
Figure 35:
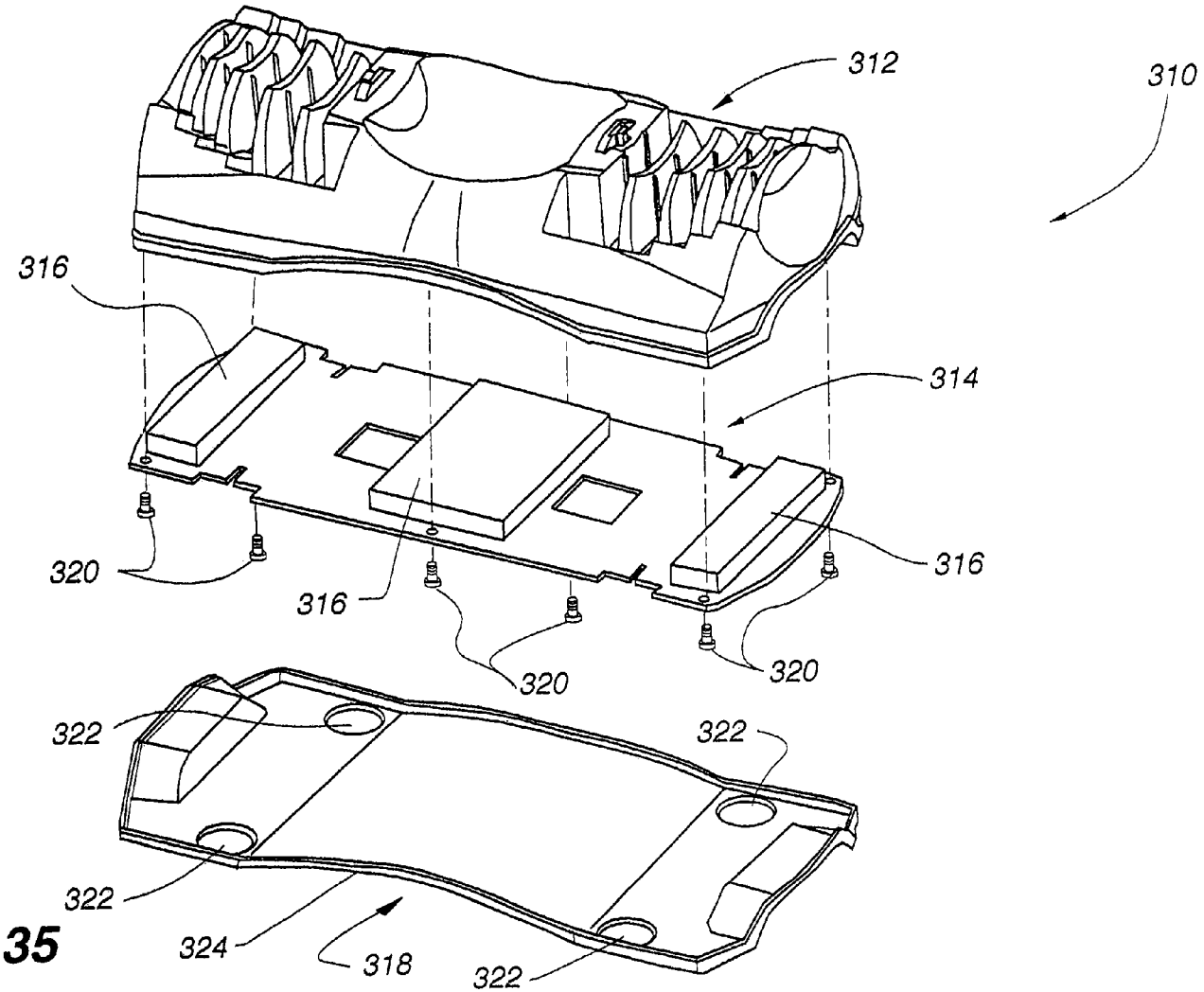
FIG. 35 is an exploded isometric view of the base support structure shown in FIG. 34.

FIG. 34 is a section view of one example of the base 310 without the dumbbell 10. FIG. 35 shows an exploded view of the base top portion 312, plate 314 with weight bars 316, and base bottom portion 318. Other types, amounts, or positions of weights could be used to anchor the base. The base has a top portion and a bottom portion, and a plate held between the two portions. Fasteners 320 (not shown) extend though the non-skid feet 322, the bottom portion, the plate, and into the top portion to hold the assembly together. The three steel weight bars 316 having a total weight of approximately 5 pounds are attached to and supported by the plate 314 to provide significant weight to the base 310 and keep it from moving around easily on the support surface. Non-skid feet 322, such as made of Kraton®, are positioned on the bottom portion to help keep the base stable on the support surface. The bottom portion 318 of the base has an arcuate curve 324 upward between the ends of the base, which provides some spacing between the base and the support surface. Since the plate supporting the weight bars is rigid and supports the weight blocks itself, the bottom portion of the base does not have to support the weight blocks. FIGS. 34 and 35 also show the shoulder engagement 326 for actuating the release mechanism in the dumbbell 10, as well as the protrusion 328 for locking the inner plate into the base when the weight selector is not in fully-selected position.

Figure 36:
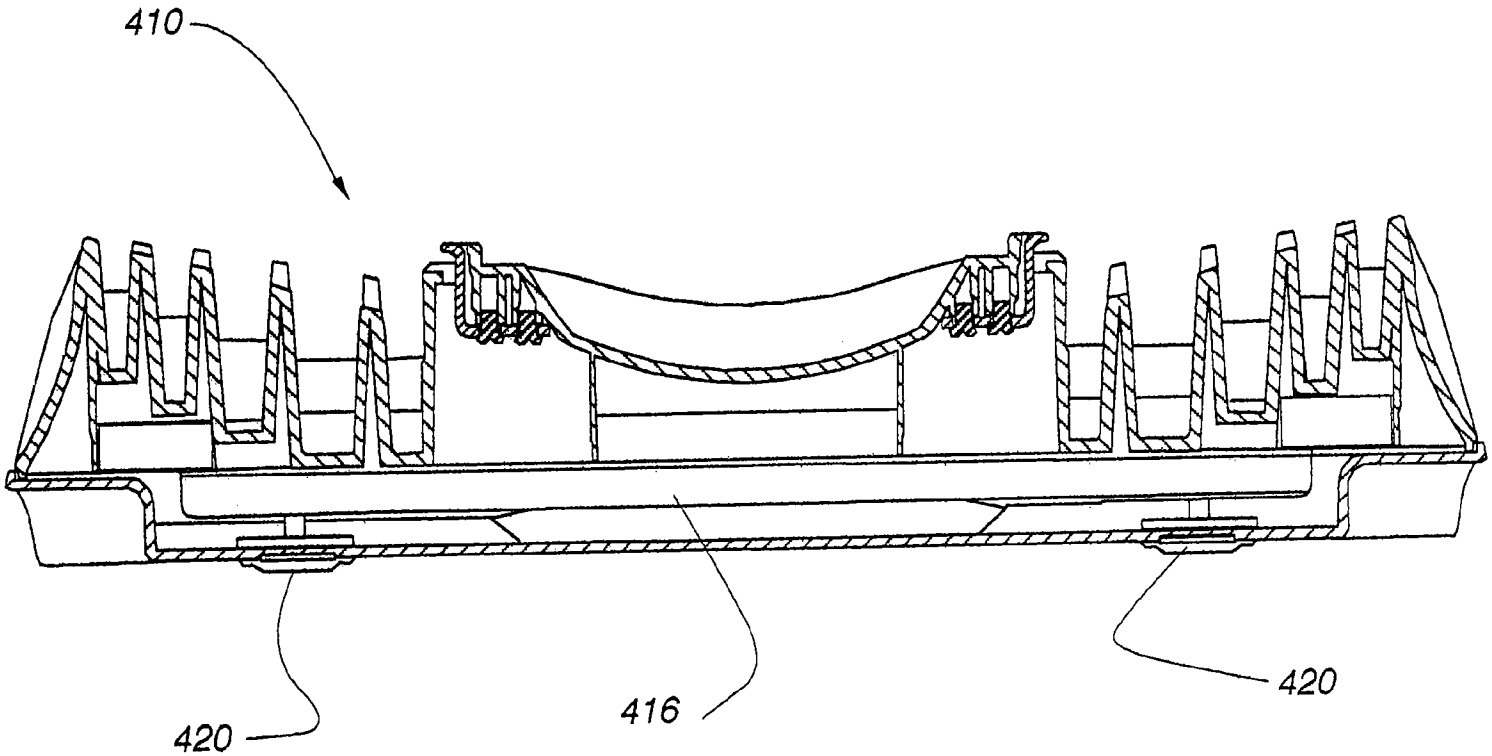
FIG. 36 is a section view of an alternative implementation of a base support, in accordance with one embodiment of the present invention
Figure 37:
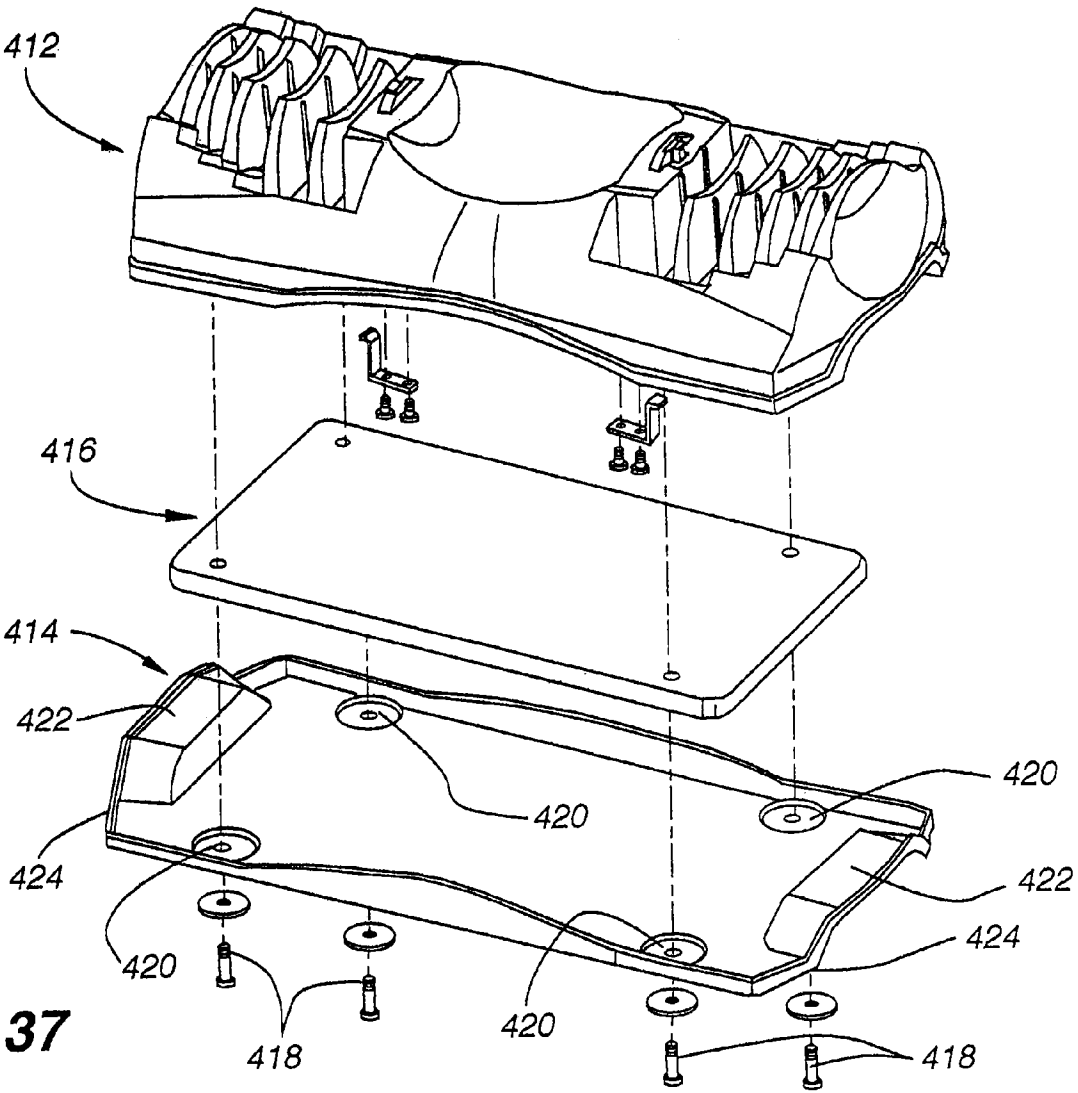
FIG. 37 is an exploded isometric view of the base support structure shown in FIG. 36.
Figure 38:
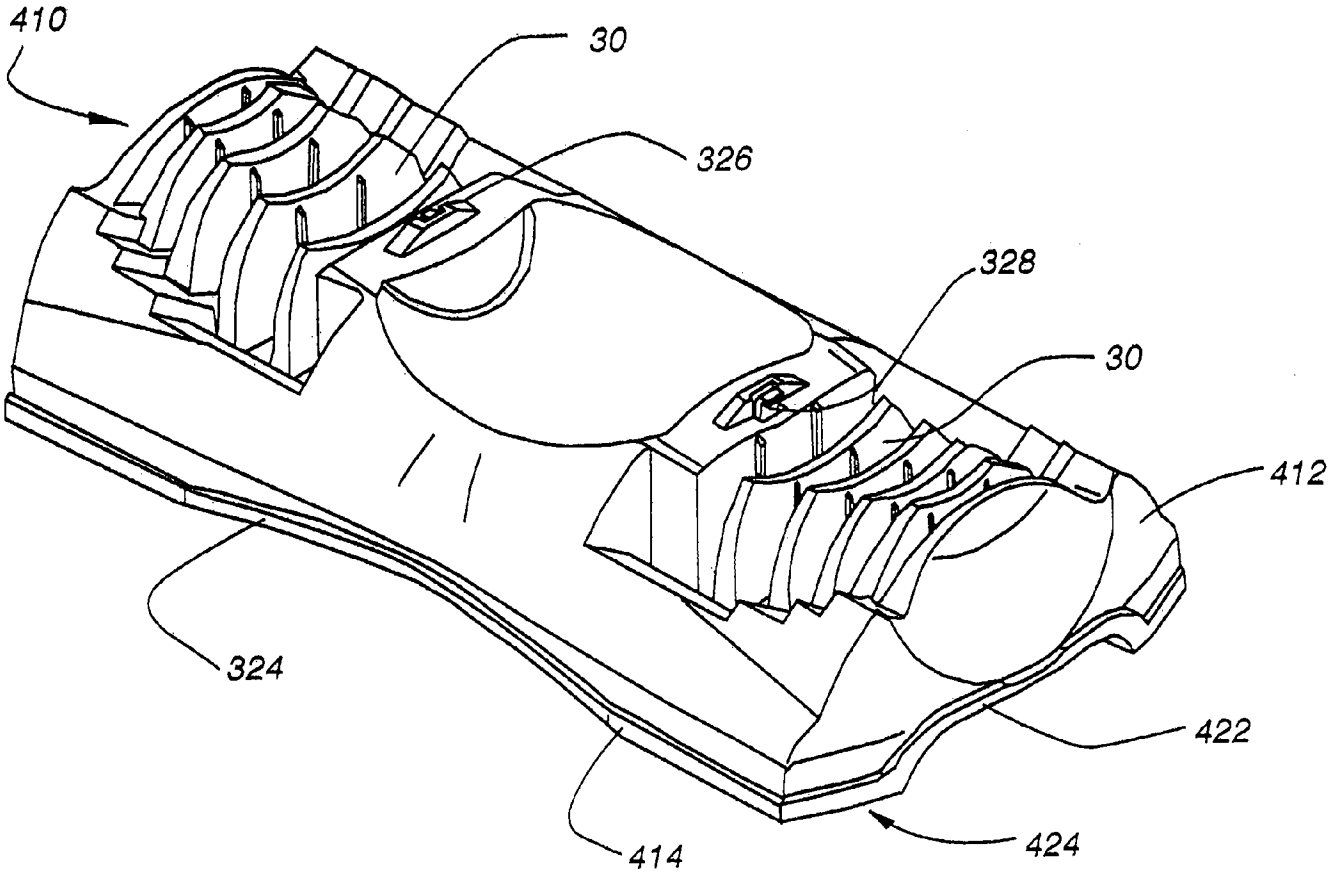
FIG. 38 is an isometric view of a base support structure of FIG. 36.
Figure 39:
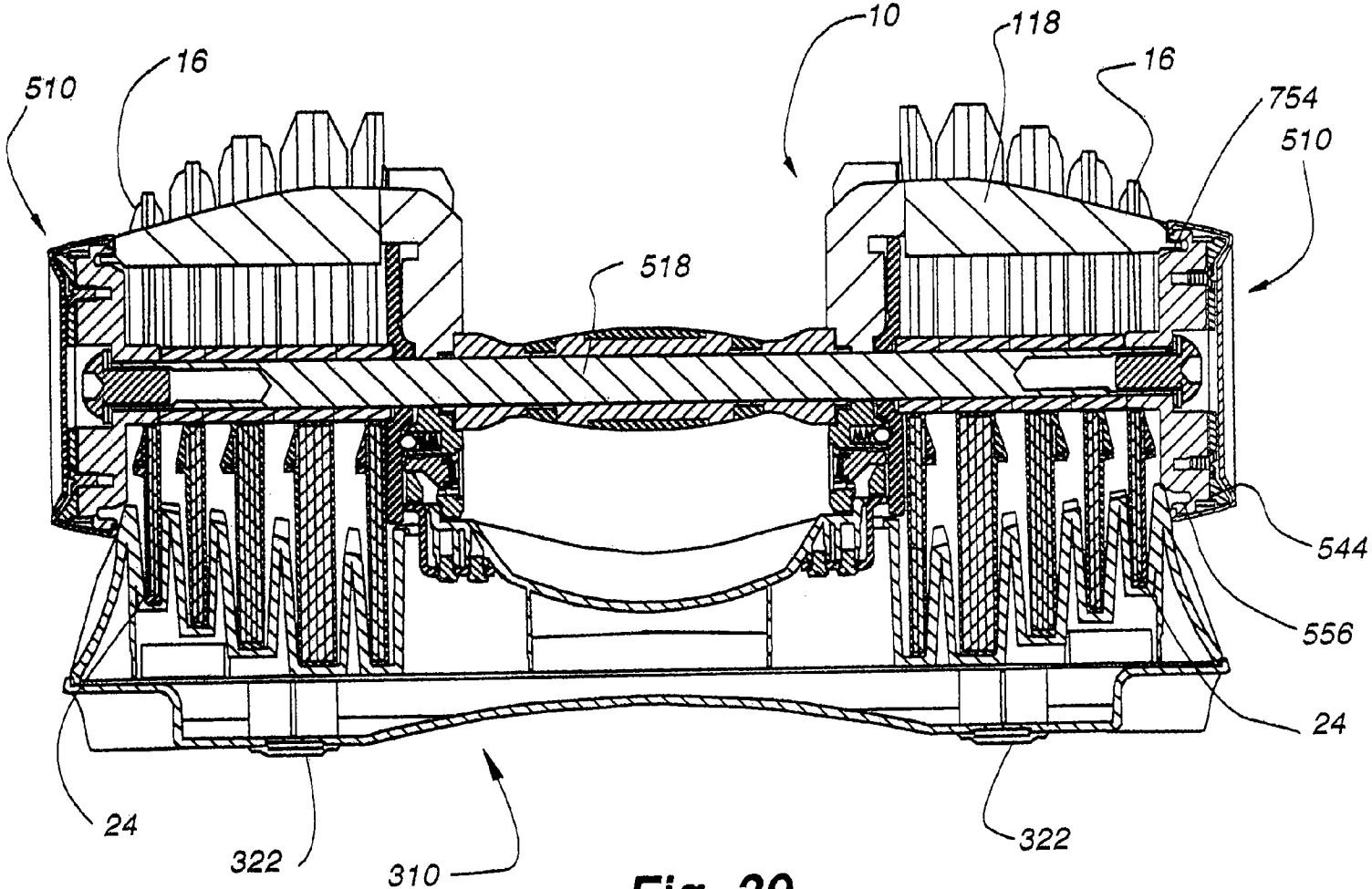
FIG. 39 is a section view of a base structure of and an adjustable dumbbell engaged therewith, in accordance with one embodiment of the present invention.
Figure 42:
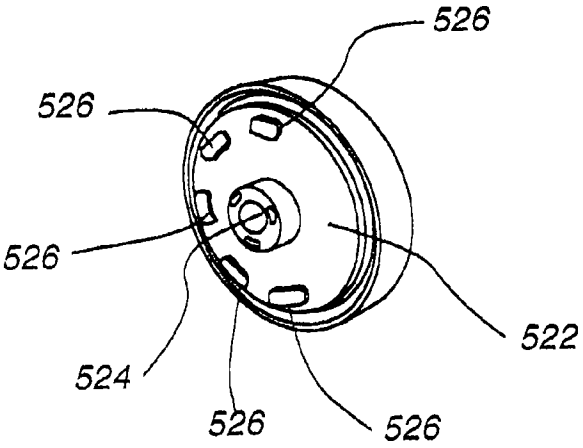
FIG. 42 is an isometric view of an assembled selector knob of FIG. 40, illustrating the inner face of the selector knob.
Figure 41:
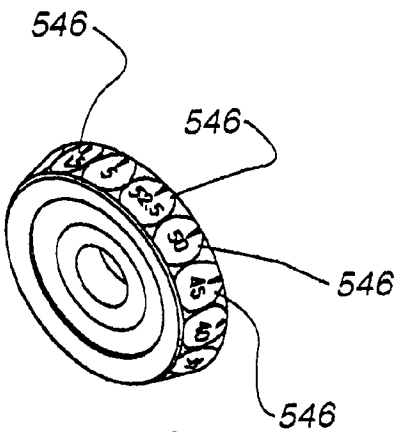
FIG. 41 is an isometric view of the assembled selector knob of FIG. 40, showing the outer face of the selector knob.
Figure 40:
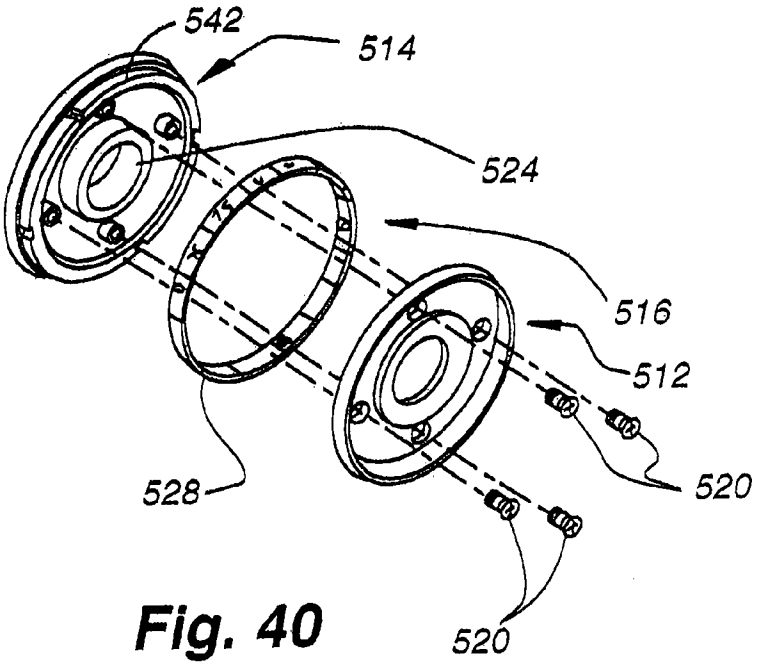
FIG. 40 is an exploded isometric view of a selector knob, in accordance with one embodiment of the present invention.

FIGS. 36 through 38 show an alternative embodiment of the base 410 for the dumbbell 10 with a different weight structure for anchoring the base on the support surface. FIG. 36 shows an upper base housing 412, a lower base housing 414, and a weight pack 416 positioned and held between the upper and lower base housings. Fasteners 418 extend though the non-skid feet 420, the bottom portion, the weight pack, and into the top portion to hold the assembly together. The weight pack is a blow-molded plastic container structure that contains steel sand and concrete (or any other weight substance, including liquid, ball bearings, sand, or the like). While the blow-molded container is structural, it could be flexible, such as a plastic bag-like container, as long as it sufficiently contains the weight material inside. The bottom portion 414 of the base is flat, and supports the weight of the weight pack 416. The flat bottom, if it flexes a minor amount under the load of the weight pack, will rest on the support surface that the base 410 is sitting on. FIG. 37 shows an exploded view of the alternative embodiment of the base, with the upper housing 412, weight pack 416, lower portion 414 of the housing, and non-skid feet 420. In both embodiments, handles recesses 422 are molded into the ends 424 of the bases to make transporting the dumbbell base, or the combination of the dumbbell and base more convenient. See FIGS. 34-38. Alternatively, handle protrusions could also be formed on the base.

The selector knob 510 for selecting the weight load on the dumbbell 10 is shown in several figures, including FIGS. 39 through 43. There is a knob on each end, and each knob is substantially identical to the other. The selector knob is generally circular, and made of an outer piece 512, an inner piece 514 and a weight selector indicator 516. The outer and inner pieces can be made of glass filled nylon. Most of the knob is covered with an over molded material, such as a polymer or similar material like Kraton® or Santoprene®, preferably having a shore hardness of 60 or so. A selector knob is positioned over each end of the handle bar 518, and secured with a screw fastener 520 or the like, and can be either permanently mounted or removable. Each knob 510 can be rotated with respect to the handle bar. The inner piece 514 of the knob has a collar 522 formed around a central aperture 524 and extending inwardly (towards the middle of the handle) from the inner side for engaging the outer surface of the adjacent collar. The knob collar has keyed protrusions to insert into the corresponding recesses in the adjacent collar to rotationally engage the knob collar with the adjacent collar, as described in more detail herein. See FIGS. 39 and 42. The inner surface of the inner piece 514 also has tabs 526 for engaging the adjacent weight plate 16 as determined by the selection of the load on the dumbbell 10. See FIG. 42.

Figure 44:
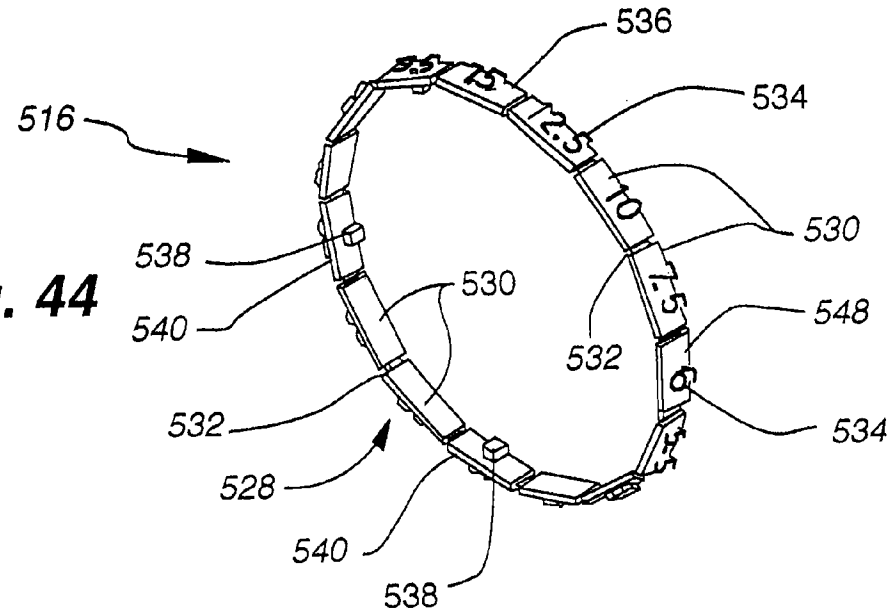
FIG. 44 is an isometric view of the number strip of FIG. 43, the selector strip being formed into a generally circular structure.
Figure 43:
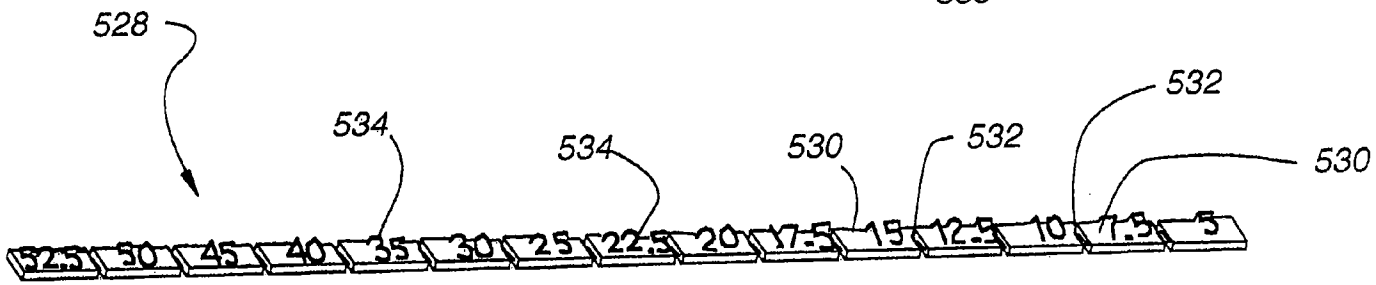
FIG. 43 is an isometric view of a number strip, in accordance with one embodiment of the present invention.

The selector knob 510 has indicator markings formed thereon. In one implementation, the weight selector indicator 516 portion of the knob is a strap 528 formed by molding a material, such as Nylon 6 or the like, into a long piece having several sections 530 connected by a living hinge 532. A raised number 534 is formed on the outer surface 536 of each section. A positioning tab 538 is formed on the inner surface 540 of a few of the sections 530. The positioning tabs are formed such that when the strap 528 is formed into a circle (see FIG. 44) for positioning on the knob 510, the tabs insert into corresponding slots in the knob to insure the proper orientation of the various raised numbers. The position of the strap on the knob is important because the various numbers are the indicators for the selected weight on the dumbbell 10, so the strap should be keyed, or coordinated, with orientation of the knob, which is coordinated with the collar 522 positions, so that the weight selector numbers 534 are accurate. The edges of each of the sections 530 of the strap 528 are beveled. Once the strap is molded, it is positioned on the recessed annular rim 542 formed on the outer side of the inner piece 514 of the knob. See FIG. 40. The tabs 538 are inserted into their respective recesses formed in the annular rim, and the outer piece 512 is mated up and attached to the inner piece 514. The outer piece has a beveled annular recess 544 for receiving the beveled edges of the sections of the strap, thus effectively clamping the strap onto the assembled knob. See FIGS. 39, 41, and 42. The recessed annular rim 542 on the inner piece 514 of the knob 510 can also have a beveled recess on its inner edge to receive the beveled edges of the sections annular and similarly clamp the strap onto the knob.

The over mold material is then applied to the outer surfaces of the knob. Some of the outer surfaces are not covered with the over mold material, such as the inner face of the inner piece 514, which has to connect to the adjacent collar. The gripping surface, however, is covered with the over molded material to enhance the gripping characteristics. The top surface of the numbers on the strap 528 are not covered with the over mold material so that the weight indicator numbers 534 can be seen in a contrasting color with ease. This is accomplished by insuring that the mold used in applying the over molded material contacts the top surface of the numbers in order to keep the over mold material from covering up the number indicators. The top surface of the numbers are then flush with the top surface of the over molded material, yet can be seen clearly due to the contrast of colors with the over molded material. Other features can also be similarly treated to insure their visibility, for instance the arrows 546 shown in FIG. 41 associated with each number 534 are formed on the inner piece 514 of the knob 510. The over mold is designed to contact the top of the arrows along with the top of the numbers on the strap 528 during the molding process in order to allow the top surface of both the numbers and the arrows to be flush with and visible to the user. The numbers and arrows could be slightly above flush with the material is compressed when contacted with the mold, so that when the mold is removed, the top surfaces of the numbers and arrows expand slightly above the top surface of the over molded material, for an additional tactile feel.

Figure 45:
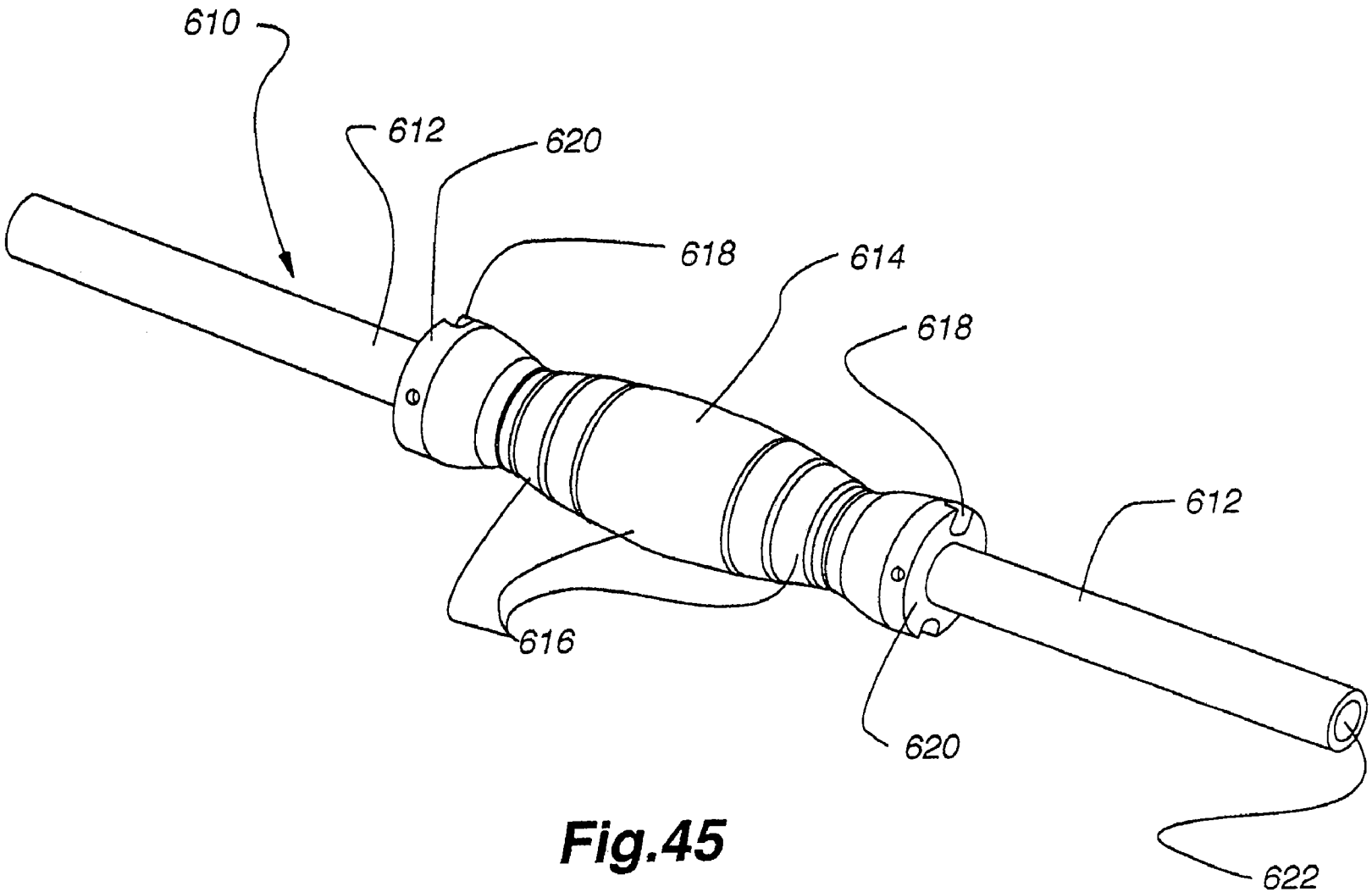
FIG. 45 is an isometric view of one implementation of a handle, in accordance with one embodiment of the present invention.
Figure 46:
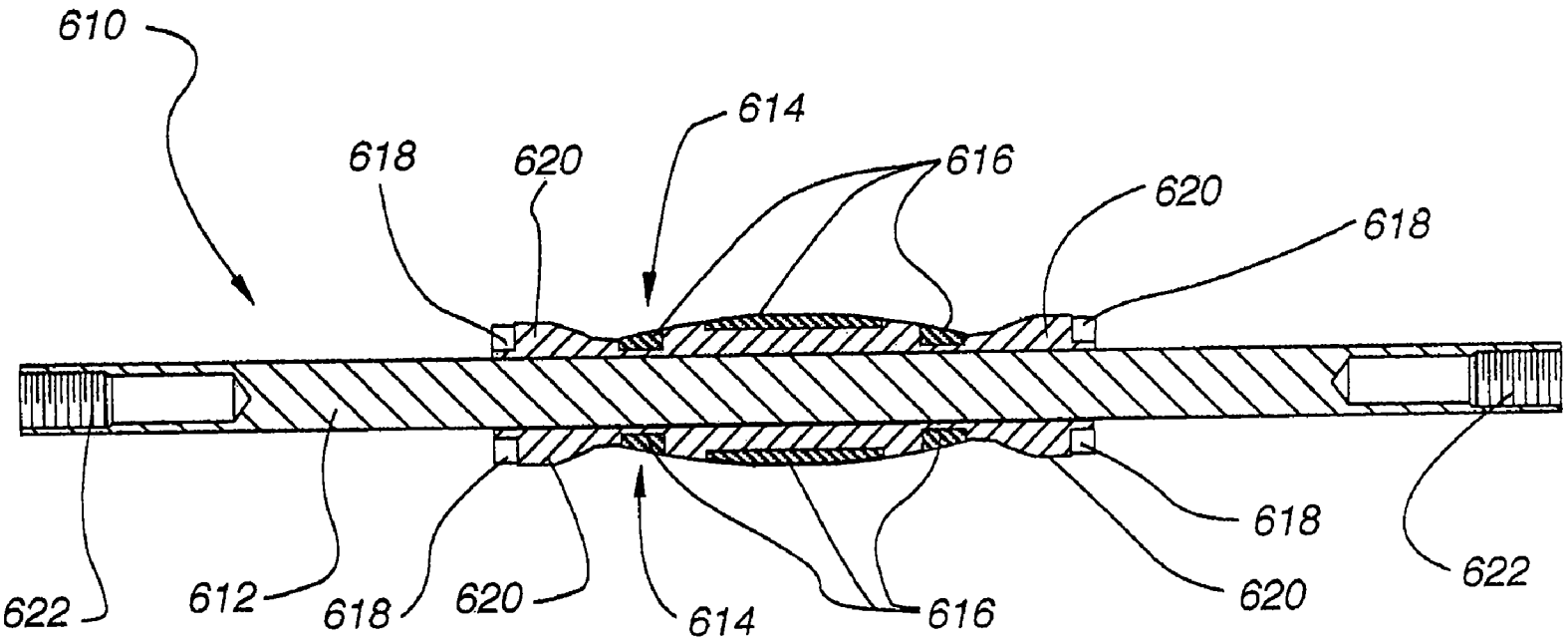
FIG. 46 is a front section view of the handle of FIG. 45.

An alternative embodiment of the bar 610 is shown in FIGS. 45 and 46. In FIG. 45, the bar is shown as a cylindrical rod 612 (hollow or solid) extending through a separate grip portion 614. The grip portion is contoured for comfortably handling a load, and can have a few regions of friction enhancing material 616 formed thereon. The grip portion is held to the bar with a pair of set screw fasteners or the like. In one implementation, the grip portion of the bar is formed from steel; however, other suitable materials, such as aluminum, rubber, polymers, and the like may be employed. Two opposing slots 618 are formed on both ends 620 of the grip portion. These slots receive tabs 720 formed on the inner support 710, as described further below, to rotationally engage the inner support with the end of the grip portion of the handle. This keeps the inner disc from rotating independently of the grip portion and bar. Both ends of the rod have threaded holes 622 for receiving the fastener for attaching the end knob 510 to the bar.

Figure 47:
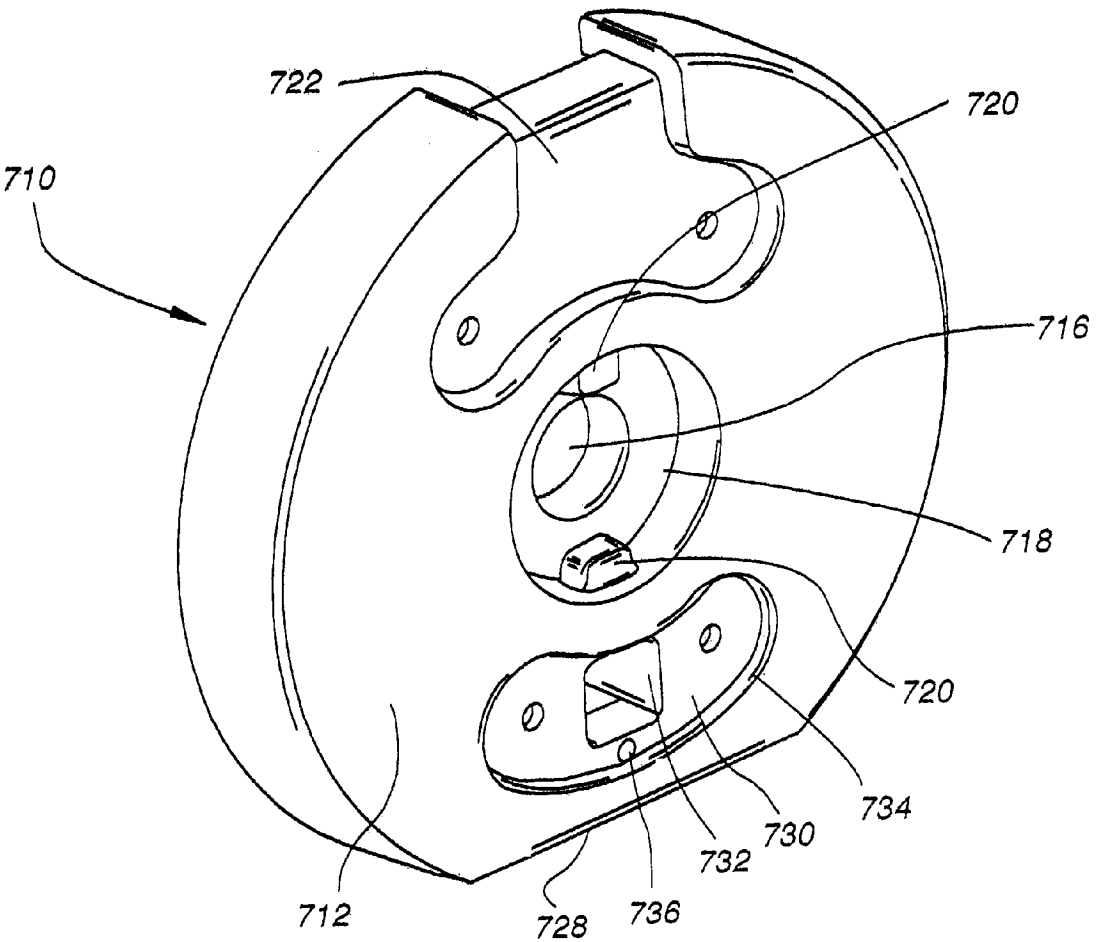
FIG. 47 is an isometric view of an inner support, in accordance with one embodiment of the present invention, the view illustrating the inner surface of the inner support.
Figure 48:
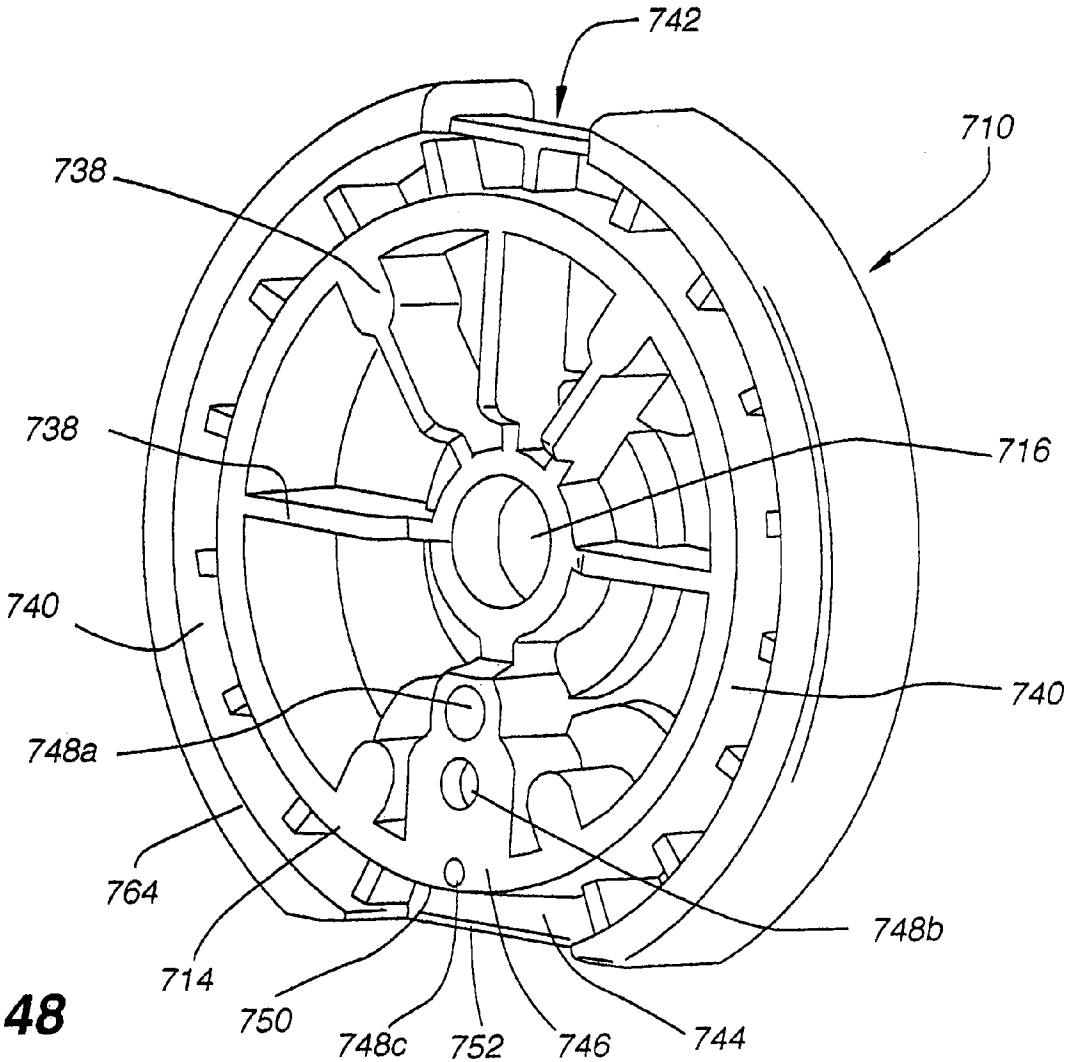
FIG. 48 is an isometric view of the inner support of FIG. 47, the view illustrating the outer surface of the inner support.

An alternative structure for the inner support 710 is shown in FIGS. 47 and 48. The inner support mounts on either end of the grip portion 614 of the bar 610. The inner support shown in FIGS. 47 and 48 includes an inner surface 712 (see FIG. 47) and an outer surface 714 (see FIG. 48). A central aperture 716 is formed through the support, with an enlarged recess 718 formed around the central aperture on the inner surface. Two opposing tabs 720 extend radially into the recess for engaging the corresponding slots 620 on the grip portion 614 of the handle 18, as discussed with respect to the bar 610 structure herein. A cutout area 722 at the top of the support receives and anchors (i.e. by two threaded fasteners) the inner end 724 of the bridge 118 that extends along the tops of the weights 16 to keep the weights from rotating when the dumbbell 10 is removed from the base 410 for use. A bottom edge 728 of the support is flat for engaging the base, and a recess 730 is formed in the support at the flat edge for receiving the shoulder engagement 326 structure and the protrusion 328, as described above. An opening 732 in the recess extends to the inner surface to allow access to the recess for positioning the spring-loaded pin 34 portion of the locking device into the support, as well as for positioning the ball-detent 44 structure in the support. A cutout 734 is formed over the opening to the recess to receive a cover plate 74. The aperture 736 at the bottom of the recess is for the pin 216 that slidably retains the slide engager/plunger 214 (See FIG. 32).

FIG. 48 shows the outer surface 714 of the inner support. The outer surface shows several bracing features 738 to provide sufficient structural strength to the support. A groove 740 extends around the edge of the support for receiving the teeth on the inner disc, which alternately engage with and disengage from the protrusion 328 during the weight plate selection, as described elsewhere herein. The central aperture 716 for receiving the rod 612 is shown, and a notch 742 is formed at the top of the support for receiving the bridge 118. The recess 744 at the bottom extends into a housing 746 that has three apertures 748 formed therein. The aperture 748*a* closest to the central aperture is for the ball detent 44 position indicator. The ball 89 and spring 88 are positioned therein from the inner side of the support. The next aperture 748*b* is for the spring loaded pin 34 portion of the locking device. The pin 80 and the spring 84 are positioned therein from the inner side of the support. The third aperture 748*c* (referenced as 736 for inner face 712), as mentioned above, is for the pin 216 that retains the slide engager/plunger 214. The plunger is positioned in the lower end of the enclosed portion 750 of the recess 744 from the bottom, and then the retaining pin is press-fit into the receiving apertures to retain the plunger thereon. The plunger extends out of the enclosed part of the recess. The bottom part 752 of the recess is not enclosed, and receives the retaining shoulder 326. The shoulder, when the dumbbell 10 is placed on the base 410, pushes the plunger 214 upward into the enclosed portion of the recess to actuate the locking mechanism, as described elsewhere herein.

A bridge 118 attaches to each inner support 710 and extends outwardly through the slot 112 in each weight 16. The bridge has an outer end 754 that fits into a groove on the inside rim 556 of the knob 510. The outer end of the bridge slides along the groove as the knob is turned so that the knob can be turned during weight selection. The outer end of the bridge may incidentally contact the side of the groove in the knob. Without any contact, the bridge is effectively a cantilever structure. See FIG. 39. The bridge keeps the weights from rotating on the rod 612 during use.

Figure 49:
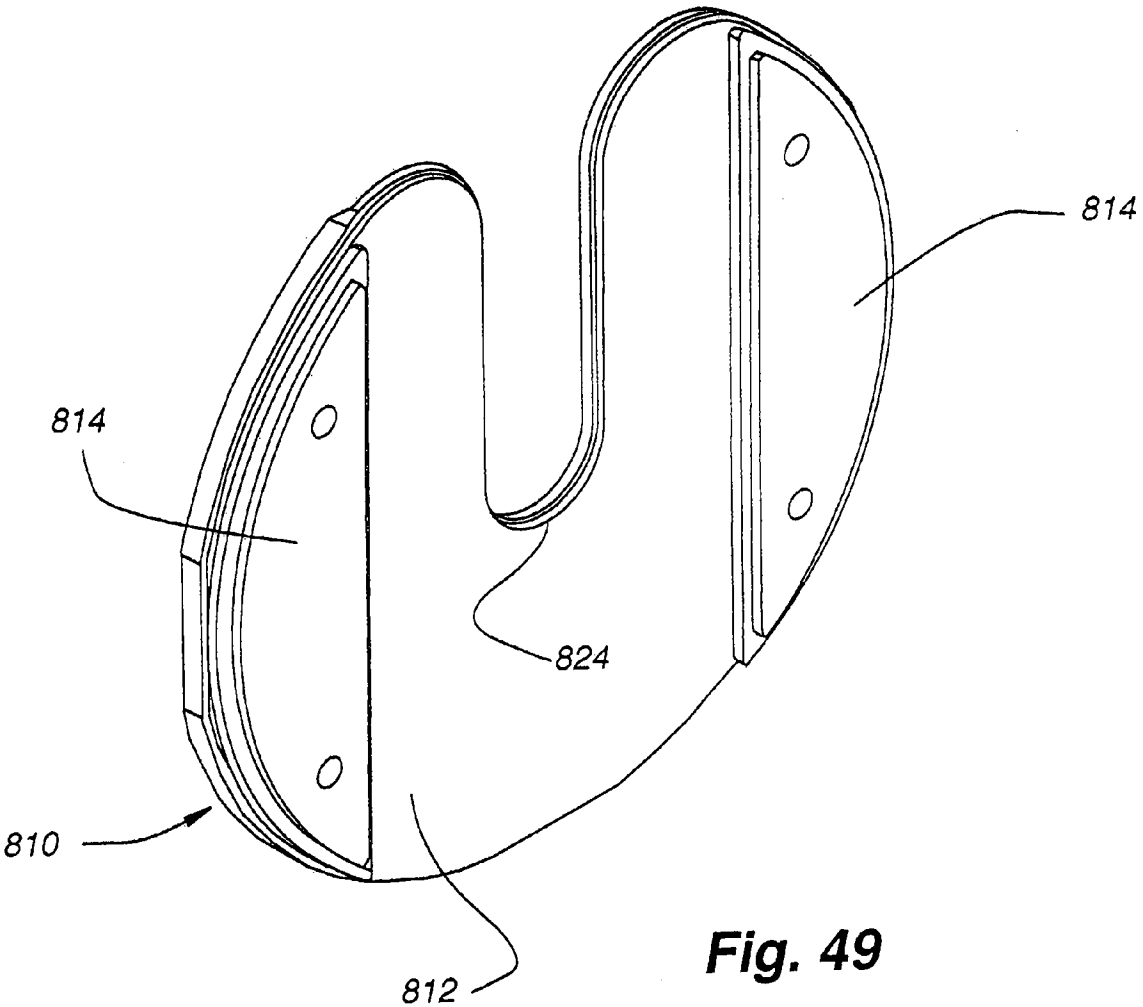
FIG. 49 is an isometric view of a weight plate, in accordance with one embodiment of the present invention.
Figure 50:
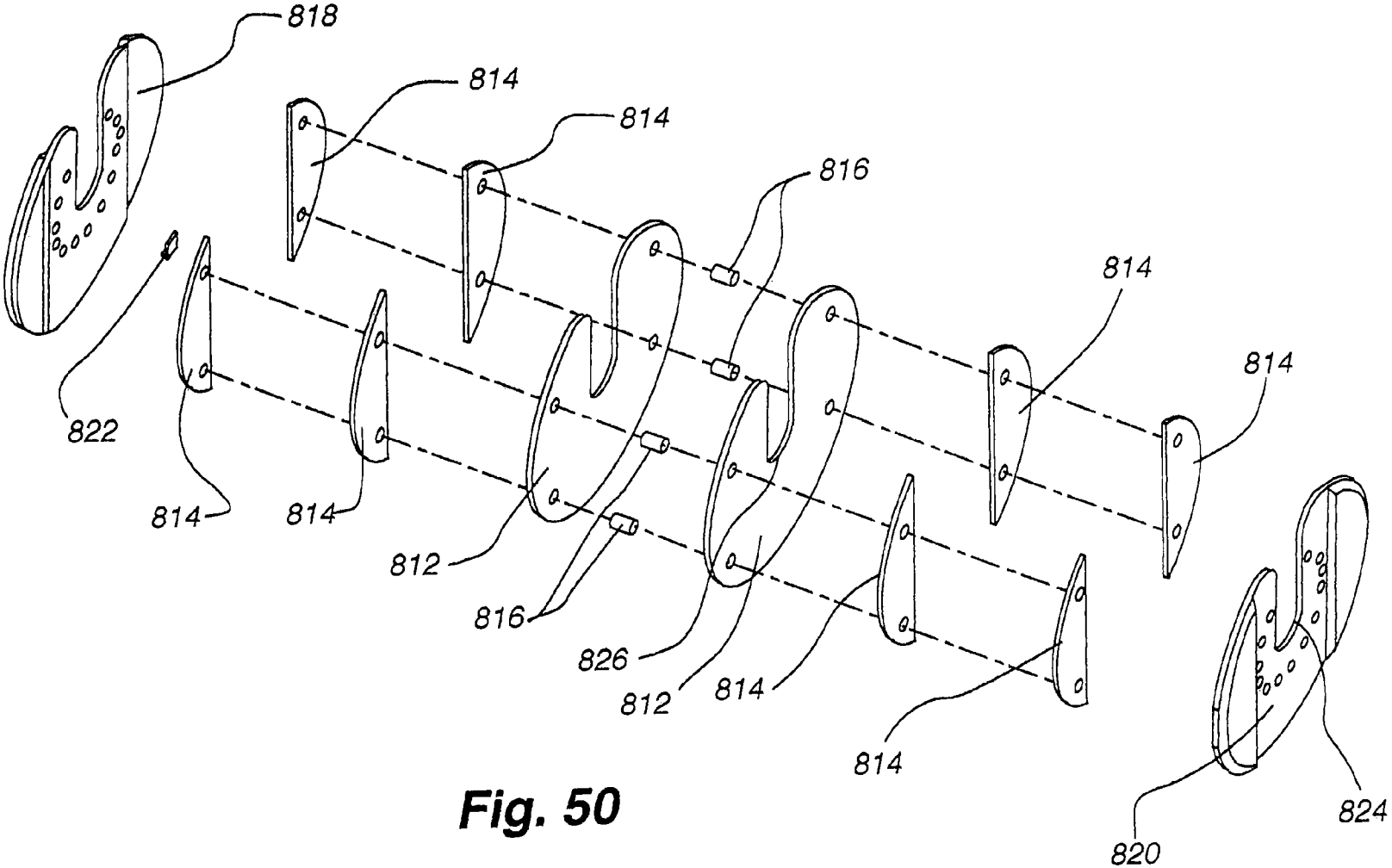
FIG. 50 is an exploded isometric view of the weight plate of FIG. 49.

Alternative weight plates 810 for use with the dumbbell 10 are shown in FIGS. 49-54. These weight plates are similar to the weight plate 16 shown and described above (See FIG. 10), which are made of one-piece cast or otherwise formed metal. Instead of being made of one piece, the alternative weight plates are constructed of several layers of metal plate. In one implementation, the weight plates are CR steel and are zinc plated. Some of the layers are primary, having the overall shape, and some of the layers are partial and are attached to the primary plates. For instance, in FIG. 49, the weight plate shown is made of two primary plates 812 and four partial plates 814 attached to the shown side of the primary plates. Partial plates can be attached to both sides of the primary plate(s). The partial plates and primary plates are attached together using rivets 816, with, in one example, four rivets being used as shown in FIG. 49. FIG. 50 shows a 2.5 pound weight plate in exploded view. There are two primary plates, two partial plates (four pieces) to be attached to the inside surface 818, and two partial plates (four pieces) to be attached to the outside surface 820. Four rivets are used to attach the plates together. A tab 822 is welded to the primary plate 812 on the outside surface, just below the central groove 824, for engagement with the corresponding collar tab 826 when a weight selection is made utilizing that particular weight plate 810. See FIGS. 50 and 51.

Figure 51:
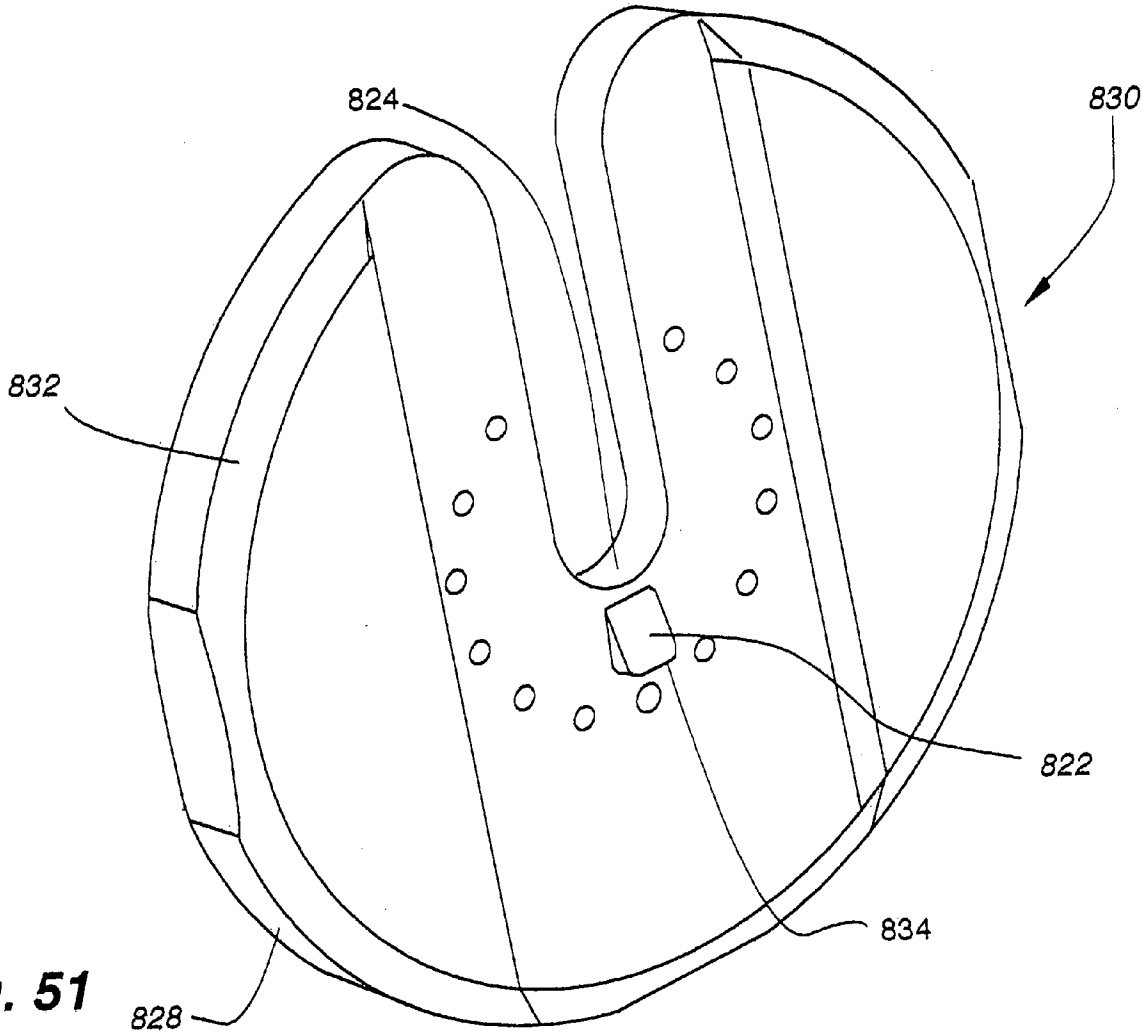
FIG. 51 is an isometric view of a weight plate with an over molded coating thereon, in accordance with one embodiment of the present invention.
Figure 52:
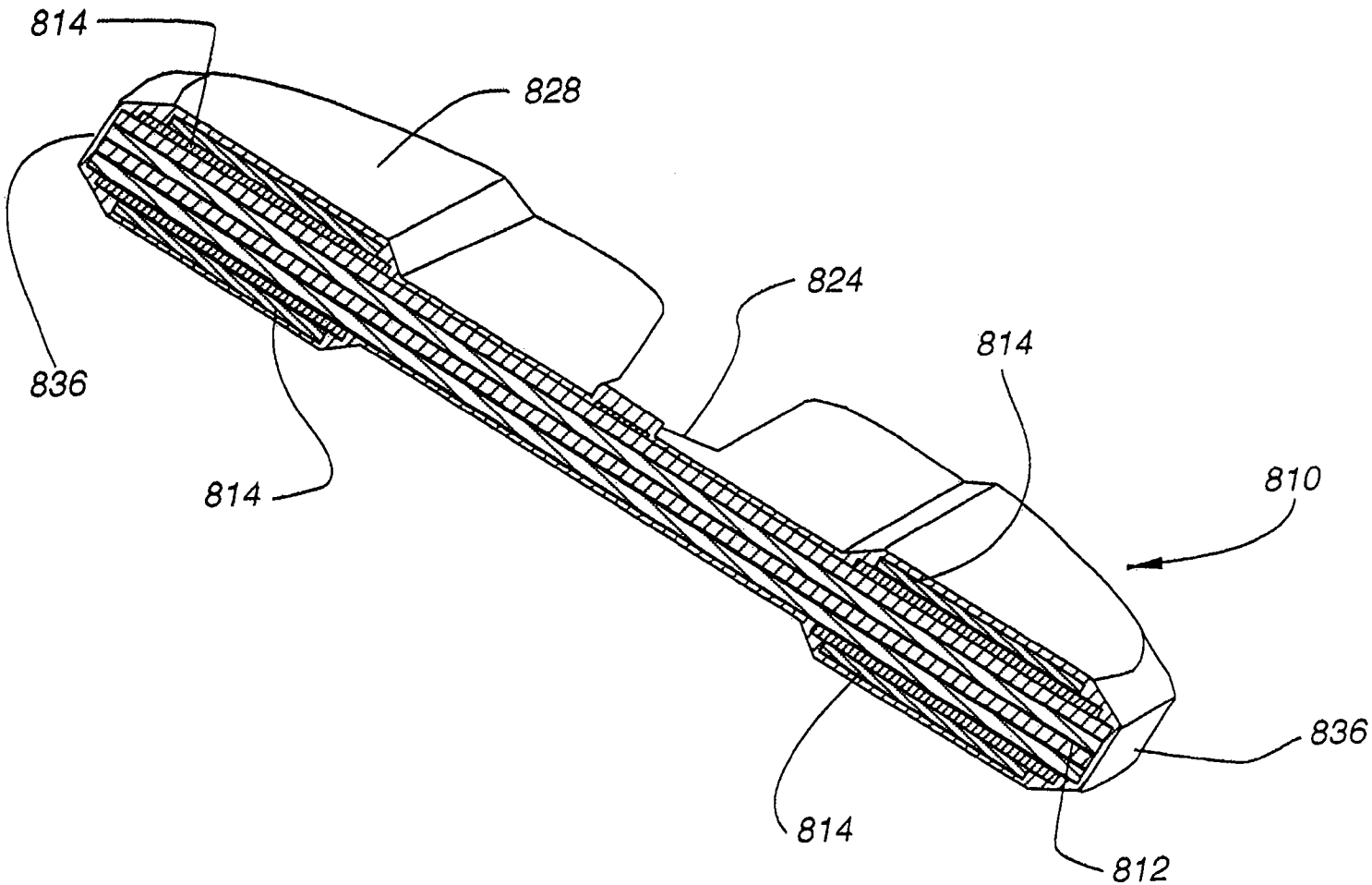
FIG. 52 is an isometric section view of one implementation of a weight plate, in accordance with one embodiment of the present invention.
Figure 53:
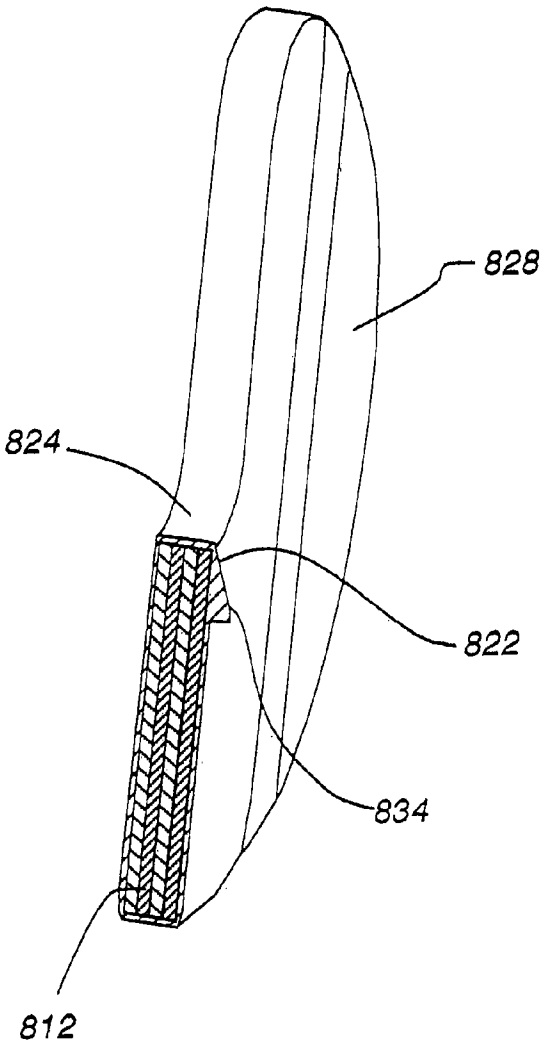
FIG. 53 is an isometric section view of an alternative weight plate, in accordance with one embodiment of the present invention.
Figure 54:
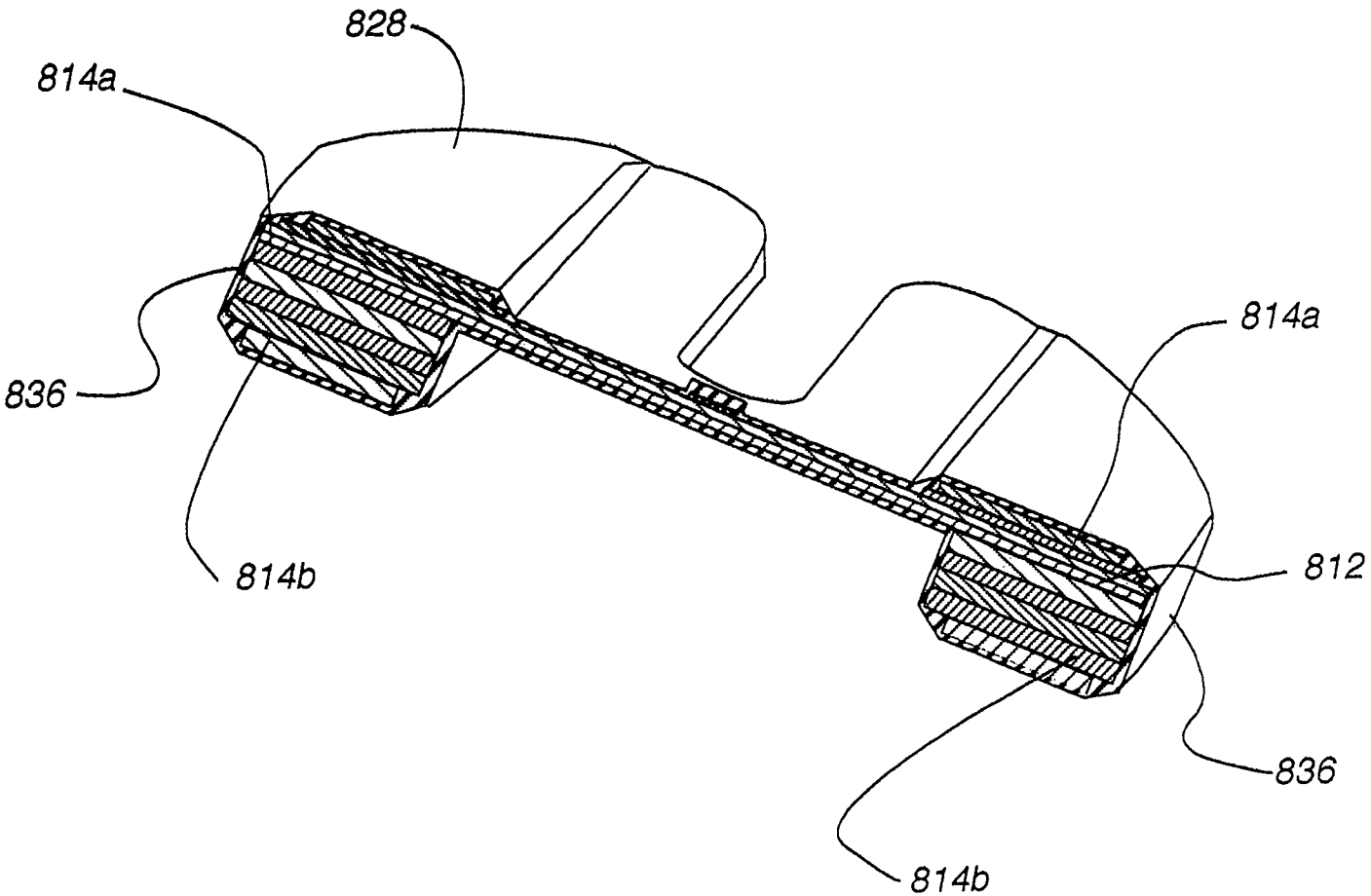
FIG. 54 is an isometric section view of an alternative embodiment of a weight plate, in accordance with one embodiment of the present invention.

The plates, once assembled into a single unit, are coated with an over mold material 828. The over mold material may be a plastic such as a thermoplastic material such as nylon, glass filled Nylon, Polypropylene, Kraton, or the like, to a thickness of approximately 1.2 mm. FIG. 51 shows the coated weight plate 830. The coated weight plate reduces the noise produced when the weights 810 contact each other, helps to avoid damage to some flooring surfaces, as well as providing a better gripping surface generally. The coating also helps to lower friction between interfacing parts. The over molding material 828 coating can be color coated for the different sized weight plates, or for any other reason. The circle of indentations 832 around the center of the weight plate, as shown in FIG. 51 masks the need for a few holes in the over mold material created during the coating process. The tab 822 turns into a wedge 834 when the over mold material is applied. FIG. 52 is a representative section of a weight plate 810 having four primary plates 812 and two partial plates 814 on either side of the primary plates. The over mold material smoothes out the edges 836 of the weight plate. FIG. 52 is a representative section of the same weight plate of FIG. 51, and shows the four primary plates with the L-shaped tab welded just below central groove 824. FIG. 54 is a representative section of a different weight plate having two primary plates with two partial plates 814*a* on one side and five partial plates 814*b* mounted on the other. The plates can be attached together without the use of rivets 816, if desired. They can be welded, glued, clipped around their edges 836, or any other means of connection can be used to hold the plates together. The assembled plate can be used without an over mold material 828 applied. The number of primary plates 812 and partial plates 814 are combined to obtain the desired weight.

Figure 55:
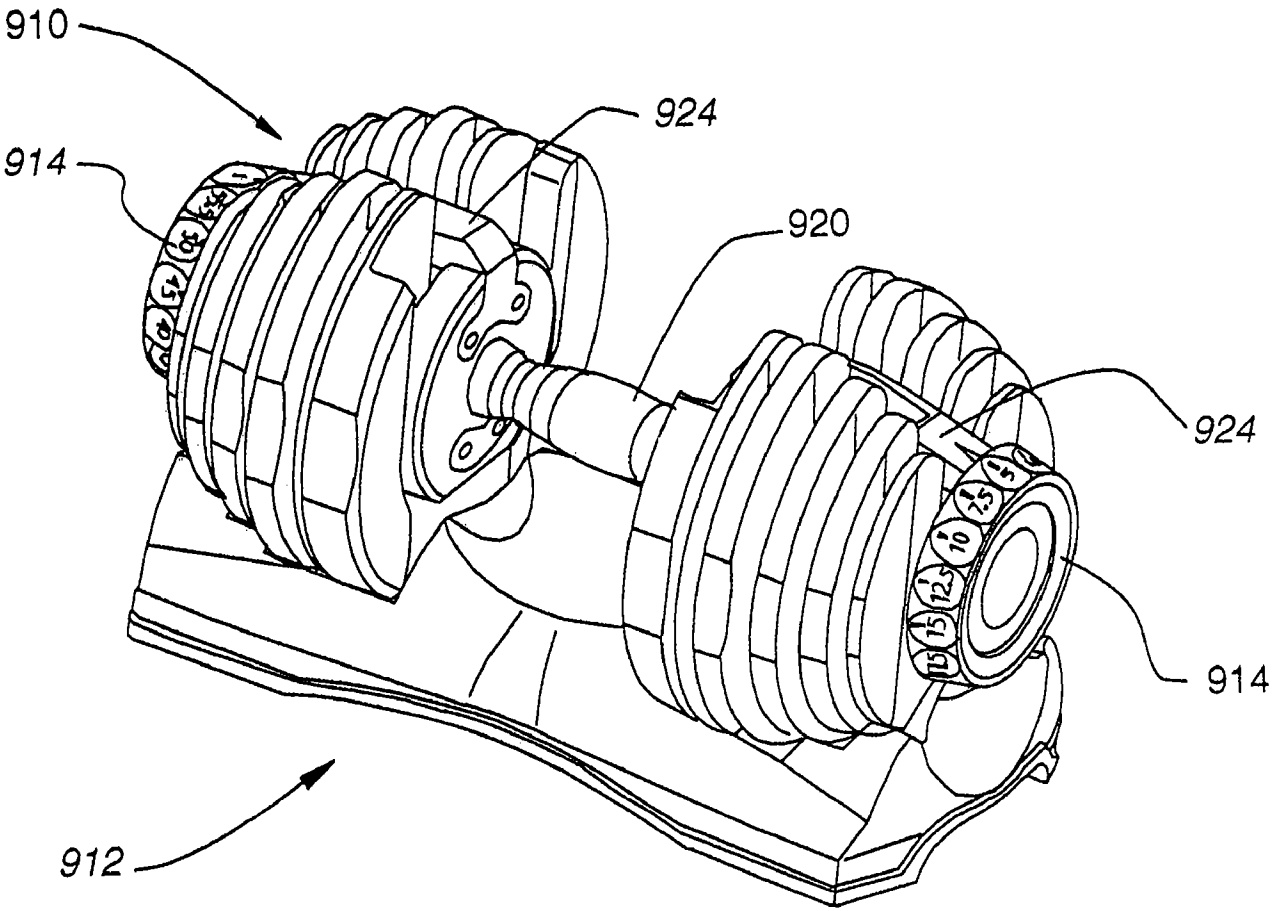
FIG. 55 is an isometric view of one implementation of an adjustable dumbbell in engagement with one implementation of a support base, in accordance with one embodiment of the present invention.
Figure 56:
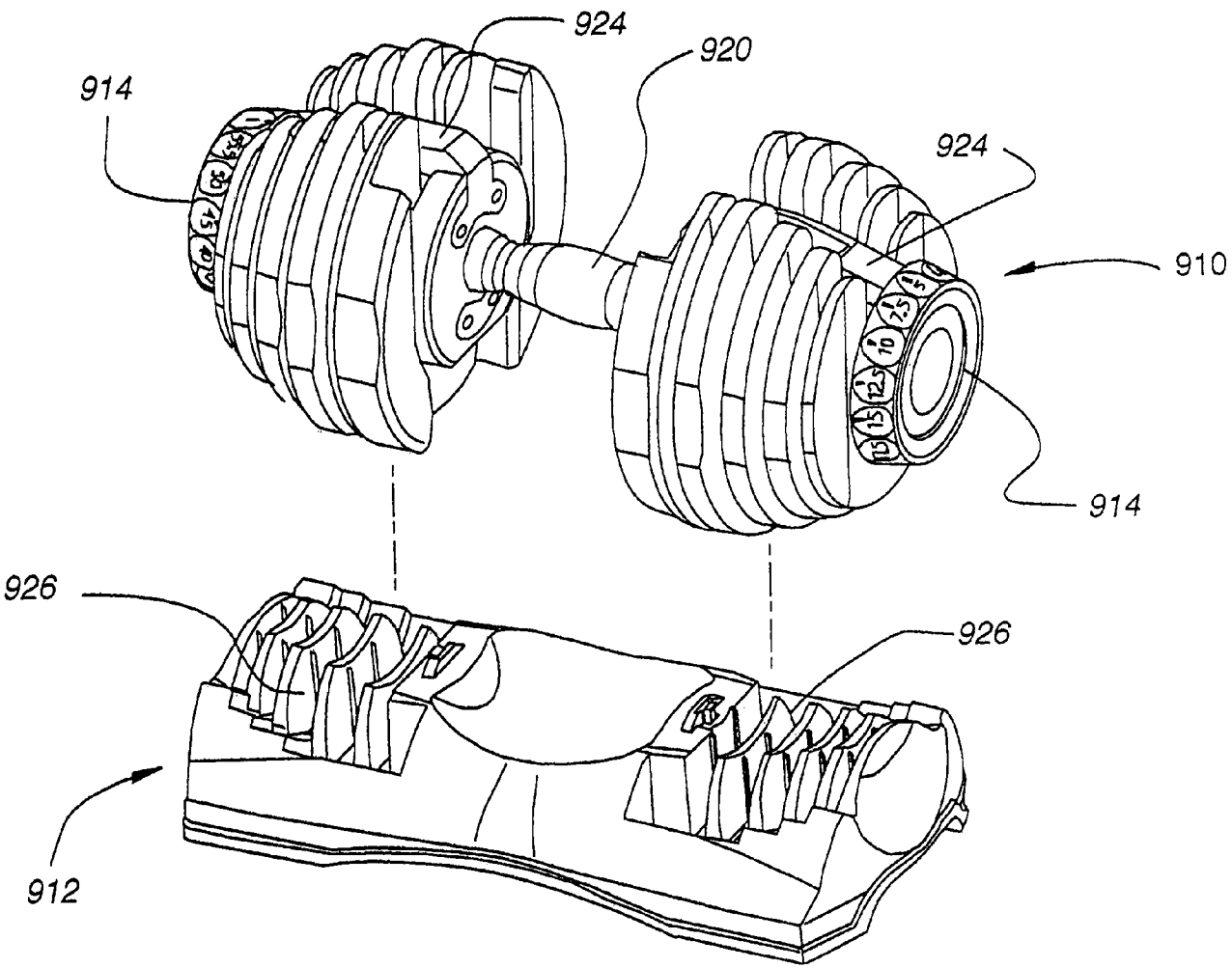
FIG. 56 is an isometric view of the adjustable dumbbell and support base of FIG. 55, with the dumbbell in engagement with all of the weight plates.
Figure 57:
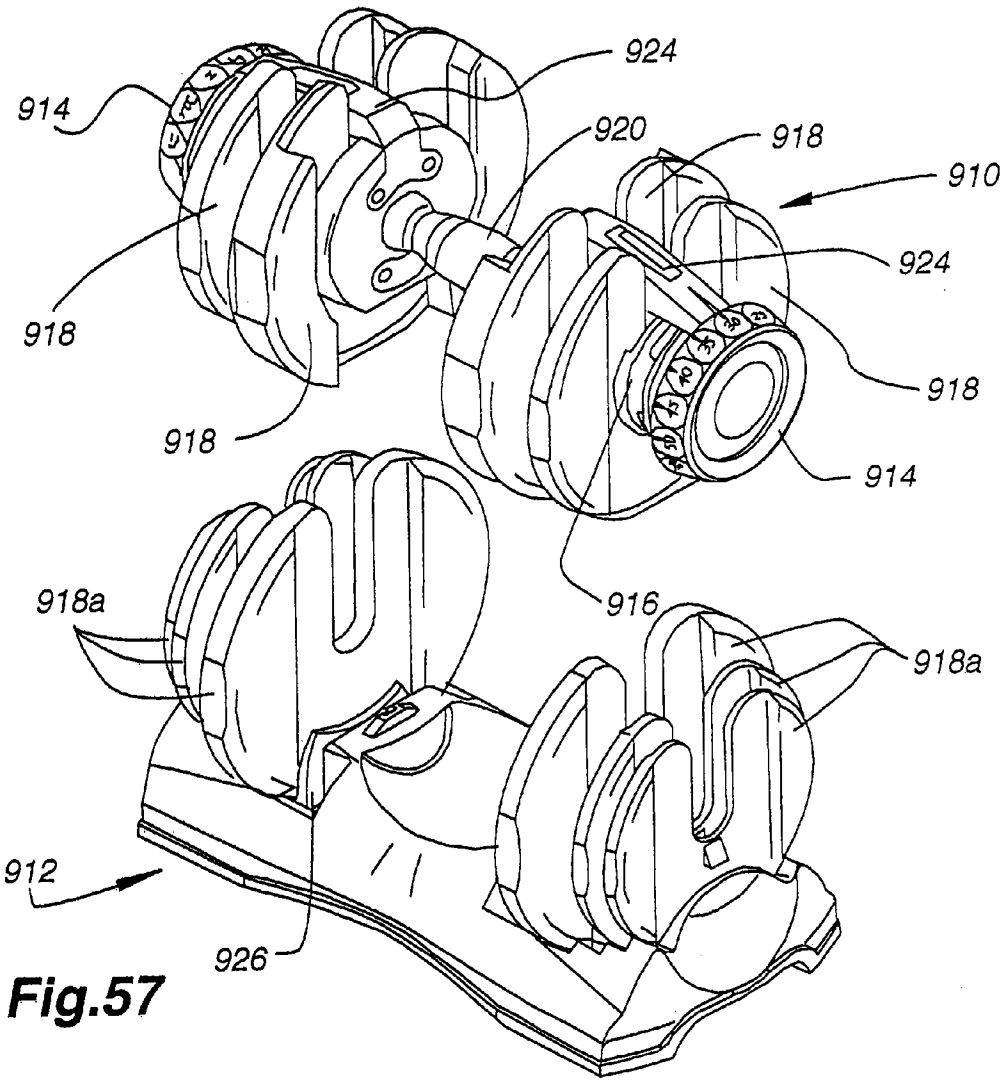
FIG. 57 is an isometric view of the dumbbell and support base of FIG. 55, with the dumbbell removed from the support base and in engagement with less than all of the weight plates.

FIGS. 55-57 show the alternative embodiment as described above. The dumbbell 910 is shown received in the base 912 in FIG. 55. In this position, since the locking mechanism is de-actuated, the weight selection can be made by rotating the selector knob 914 (which rotates the collars 916 to select the desired weights 918) on each end of the handle 920 to the desired weight load. The weight selection should be the same on both ends (i.e. select "5" on either end) in order to obtain the weight indicated on the dial. However, if desired the knobs can be turned to different weight levels, and a total weight between the two selected weight levels will be achieved. FIG. 56 shows the dumbbell 910, at its maximum weight, lifted out of the base 912. No weight plates 918 are left in the base. With the dumbbell out of the base, the locking mechanism is actuated, and the collars 916 cannot be turned. The bridge 924 keeps the weights from turning or re-orienting with respect to the collars. FIG. 57 shows the dumbbell with a 30 pound weight load lifted out of the base. Six weight plates 918*a* are left in the base 912, three on either side of the base. The dividers 926 keep the weight plates 918 upright and ready to receive the dumbbell.

Figure 58B:
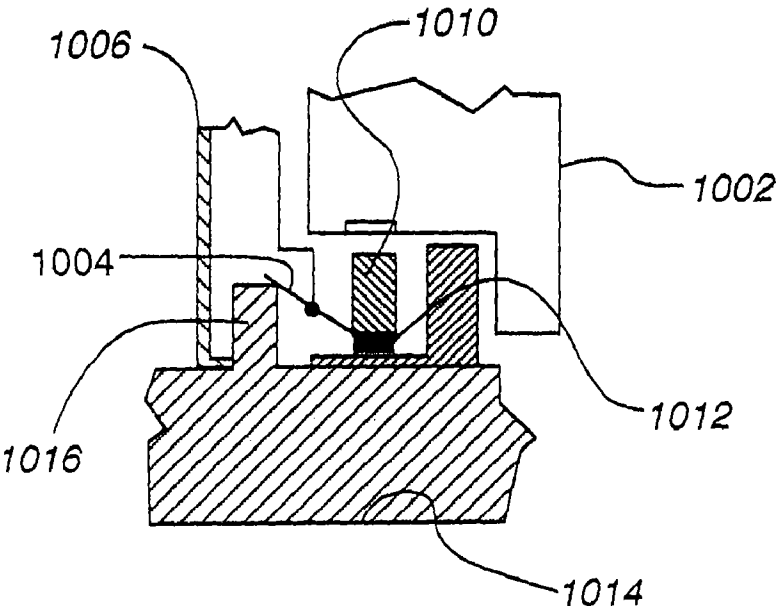
FIGS. 58*a* and 58*b* show an alternative embodiment of the rotational control structure between the support disc and the inner disc, to keep the inner disc from rotating with respect to the handle when the dumbbell is in use.
Figure 58A:
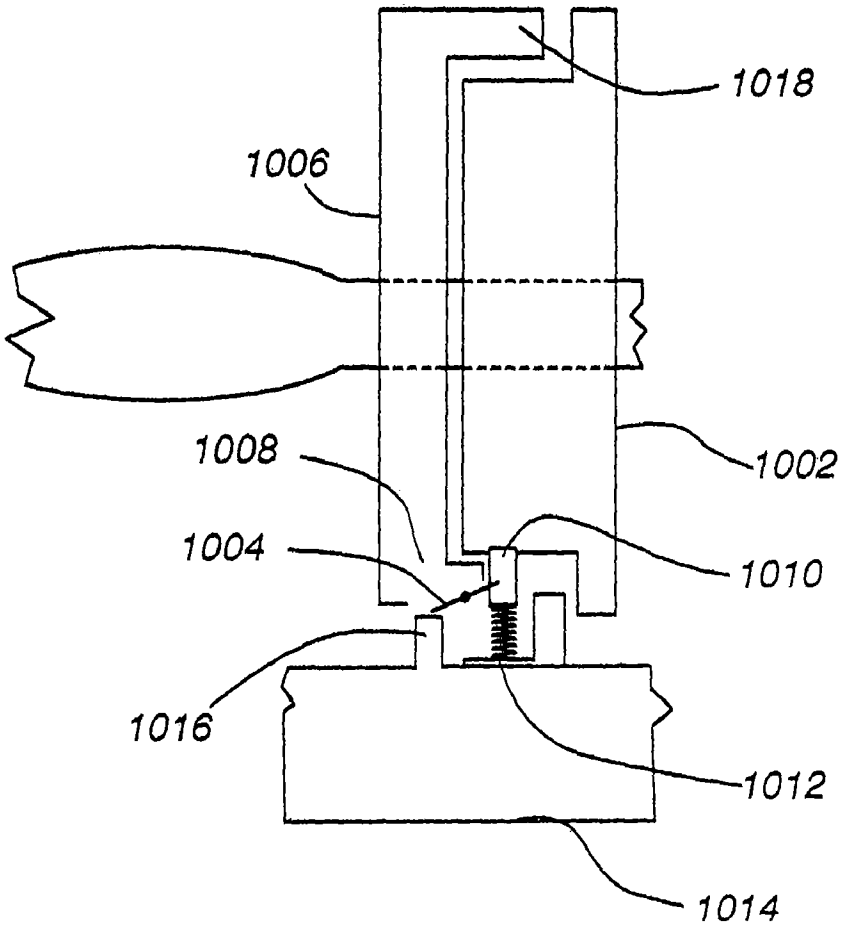

FIGS. 58A and FIG. 58B depicts two views of an alternative embodiment of a rotational interference device operably coupled with the inner disc for preventing the rotation of the inner disc. The rotational interference device or locking device includes a spring-biased member having a curved surface defining a plurality of serrations or teeth. The inner disc of this embodiment also includes matching serrations along its perimeter. The locking device is biased by the springs towards the perimeter of the inner disc so that, absent a counteracting force, the serrations of the locking device engage the matching serrations of the inner disc to prevent the inner disc from rotating. When the dumbbell is set on the base support or other surface, however, an actuator engages the spring-biased member and pushes the member away from the perimeter of the inner disc. In this manner, the serrations of the spring-biased member are disengaged from the serrations along the perimeter of the inner disc when the dumbbell is in the base or on another surface, thus freeing the inner disc to rotate with respect to the handle and the inner support. When lifted out of the base or off the surface, the member engages the inner disc and keeps it from turning while the dumbbell is in use.

Referring to FIG. 58A, an alternative embodiment of the rotational interference device or locking device (as referenced above) is shown in engagement with the inner disc 1002. A lever arm 1004 is pivotally coupled with the inner support 1006 such that one end of the lever 1004 extends into the recess 1008 and the other end of the lever is engaged with the locking device block 1010. The block 1010 has gear teeth or serrations on its upper surface to engage corresponding gear teeth or serrations on the outer rim of the inner disc 1002. The spring 1012 biases the locking device block 1010 into engagement with the inner disc 1002, and causes the end of the lever arm 1004 in recess 1008 to be oriented downwardly. As shown in FIG. 58B, when the adjustable dumbbell is placed in the support base 1014, the plunger 1016 (or another portion of the base or support surface on which the dumbbell is set) engages the lever arm 1004 to depress the locking device block 1010 against the spring and disengage the inner disc 1002. When the dumbbell is lifted off of the base or support surface, the spring biases the block 1010 into contact with the inner disc and restricts the rotation of the inner disc relative to the inners support 1006 and handle. Alternatively, the locking device may be mounted to the upper portion 1018 of the inner support such that the serrations of the block 1010 are oriented downwardly to engage serrations along the inner disc 1002. In such an implementation, the lever arm 1004 is not included. Instead an elongate slidably supported rod extends between the upper portion of the inner support and the lower portion of the inner support. The upper portion 1018 of the rod is operably coupled with the locking device. When the adjustable dumbbell is placed in the support base, an engagement surface contacts the rod and slides it upwardly. Being coupled with the locking device block, the upward movement of the rod causes the locking device to disengage from the inner disc and thus allow the inner disc to rotate to allow adjustment of the weight selection.

Although preferred embodiments of this invention have been described above with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. Joinder references (e.g., attached, coupled, connected, mounted and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. An adjustable dumbbell apparatus, comprising:

a dumbbell comprising:

at least one weight plate; and a selector selectively associated with the at least one weight plate to provide a desired weight load, the selector including a disc with at least one engagement portion; and a base configured to receive the dumbbell and including an engagement member, wherein:

the engagement member and the at least one engagement portion of the disc are configured such that engagement of the engagement member with the at least one engagement portion secures the dumbbell to the base and disengagement of the engagement member from the at least one engagement portion unsecures the dumbbell from the base;

when the dumbbell is secured to the base by engagement of the engagement member with the at least one engagement portion, a user is unable to readily remove the dumbbell from the base; and when the dumbbell is unsecured from the base by disengagement of the engagement member from the at least one engagement portion, the user may readily remove the dumbbell from the base.

2. The adjustable dumbbell apparatus of claim 1, wherein the engagement member comprises a protrusion.

3. The adjustable dumbbell apparatus of claim 1, wherein the at least one engagement portion comprises a plurality of teeth.

4. The adjustable dumbbell apparatus of claim 3, wherein the plurality of teeth are positioned proximate an outer radial portion of the disc.

5. The adjustable dumbbell apparatus of claim 4, wherein the plurality of teeth extend transversely from the outer radial portion of the disc.

6. The adjustable dumbbell apparatus of claim 1, wherein the selector further comprises a user operable selector element operatively associated with the disc.

7. The adjustable dumbbell apparatus of claim 6, wherein the user operable selector element comprises a knob.

8. The adjustable dumbbell apparatus of claim 7, wherein the selector further comprises at least one weight engagement element operatively associated with the selector element.

9. The adjustable dumbbell apparatus of claim 8, wherein the at least one weight engagement element comprises a collar.

10. The adjustable dumbbell apparatus of claim 1, wherein the dumbbell further comprises a handle operatively associated with the selector, the handle and the selector configured so that the selector is rotatable relative to the handle, and selective rotation of the selector relative to the handle rotates the disc relative to the handle.

11. An adjustable dumbbell apparatus, comprising:

at least one weight plate;

a selector selectively associated with the at least one weight plate to provide the selector with a desired weight load;

a disc operatively associated with the selector, the disc including a plurality of teeth; and a base configured to receive the at least one weight plate and including an engagement member, wherein:

the engagement member, the selector and the disc are configured such that engagement of at least one of the plurality of teeth of the disc with the engagement member secures the selector to the base and disengagement of the at least one of the plurality of teeth of the disc from the engagement member unsecures the selector from the base;

when the dumbbell is secured to the base by engagement of the engagement member with the at least one of the plurality of teeth, a user is unable to readily remove the selector from the base; and when the dumbbell is unsecured from the base by disengagement of the engagement member from the at least one of the plurality of teeth, the user may readily remove the selector from the base.

12. The adjustable dumbbell apparatus of claim 11, wherein the engagement member comprises a protrusion.

13. The adjustable dumbbell apparatus of claim 11, wherein the plurality of teeth are positioned proximate an outer radial portion of the disc.

14. The adjustable dumbbell apparatus of claim 13, wherein the plurality of teeth extend transversely from the outer radial portion of the disc.

15. The adjustable dumbbell apparatus of claim 11, wherein the selector comprises a user operable selector element operatively associated with the disc.

16. The adjustable dumbbell apparatus of claim 15, wherein the user operable selector element comprises a knob.

17. The adjustable dumbbell apparatus of claim 11, further comprising a handle operatively associated with the selector, the handle and the selector configured so that the selector is rotatable relative to the handle, and selective rotation of the selector relative to the handle rotates the disc relative to the handle.

18. The adjustable dumbbell apparatus of claim 11, further comprising a handle, and the disc is rotatably joined to the handle.

19. The adjustable dumbbell apparatus of claim 18, wherein the disc is positioned proximate the handle.

20. The adjustable dumbbell apparatus of claim 18, wherein the plurality of teeth include a first end portion joined to the disc and a second end portion that is distal the first end portion, and the plurality of teeth extend away from the disc in a direction such that the second end portion is closer to the handle than the first end portion.

* * * * *